US009140253B2

(12) United States Patent
Wentworth et al.

(10) Patent No.: US 9,140,253 B2
(45) Date of Patent: Sep. 22, 2015

(54) CONTROL DEVICE, OIL WELL WITH DEVICE AND METHOD

(75) Inventors: Lloyd Wentworth, Orange, CA (US); Craig Lamascus, Orange, CA (US)

(73) Assignee: HAROLD WELLS ASSOCIATES, INC., Orange, CA (US)

( * ) Notice: Subject to any disclaimer, the term of this patent is extended or adjusted under 35 U.S.C. 154(b) by 872 days.

(21) Appl. No.: 12/911,684

(22) Filed: Oct. 25, 2010

(65) Prior Publication Data

US 2011/0103974 A1 May 5, 2011

(51) Int. Cl.

| | |
|---|---|
| ***F04B 49/02*** | (2006.01) |
| ***F04B 47/02*** | (2006.01) |
| ***F04B 49/20*** | (2006.01) |
| ***F04B 49/06*** | (2006.01) |

(52) U.S. Cl.

CPC ..... *F04B 47/02* (2013.01); *F04B 49/065* (2013.01); *F04B 49/20* (2013.01); *F04B 2201/0201* (2013.01)

(58) Field of Classification Search

CPC ... F04B 47/02; F04B 49/20; F04B 2201/0201

USPC ..... 417/214, 237, 44.1, 45, 411, 904; 166/68.5, 105

See application file for complete search history.

(56) References Cited

U.S. PATENT DOCUMENTS

| | | | |
|---|---|---|---|
| 4,490,094 | A | 12/1984 | Gibbs |
| 4,973,226 | A | 11/1990 | McKee |
| 5,246,076 | A | 9/1993 | Watson |
| 5,251,696 | A | 10/1993 | Boone et al. |
| 5,252,031 | A | 10/1993 | Gibbs |

(Continued)

FOREIGN PATENT DOCUMENTS

WO PCT/US2010/053981 3/2010

OTHER PUBLICATIONS

Intl. Search Report and Written Opinion, Wells Associates.

(Continued)

*Primary Examiner* — Charles Freay
*Assistant Examiner* — Christopher Bobish
(74) *Attorney, Agent, or Firm* — John J. Connors; Connors & Assoc. pc

(57) ABSTRACT

A method of operating an oil well comprises applying through a regenerative variable frequency drive AC electrical energy from a power grid to an AC electric motor to operate a drive mechanism of an oil well pump. The motor speed is regulated in a manner to optimize fluid production and maximize the operational life of the drive mechanism, decreasing motor speed by transferring the electrical energy to the power grid and increasing motor speed by transferring the electrical energy from the power grid to the motor. The drive mechanism has a predetermined stroke cycle and, over the course of each stroke cycle, the motor is operated at different regulated speeds initiated when the drive mechanism is at a predetermined position.

1 Claim, 54 Drawing Sheets

(56) References Cited

U.S. PATENT DOCUMENTS

| | | | | |
|---|---|---|---|---|
| 5,281,100 | A | 1/1994 | Diederich | |
| 5,425,623 | A * | 6/1995 | London et al. | 417/18 |
| 6,414,455 | B1 * | 7/2002 | Watson | 318/432 |
| 6,890,156 | B2 * | 5/2005 | Watson et al. | 417/42 |
| 7,330,779 | B2 | 2/2008 | Schulz | |
| 2002/0030364 | A1 * | 3/2002 | Bosley et al. | 290/7 |
| 2004/0062657 | A1 * | 4/2004 | Beck et al. | 417/42 |
| 2005/0095140 | A1 | 5/2005 | Boren et al. | |
| 2005/0146221 | A1 | 7/2005 | Pettigrew | |
| 2006/0067834 | A1 * | 3/2006 | Boyer et al. | 417/44.1 |
| 2007/0193744 | A1 | 8/2007 | Bridges | |
| 2008/0240930 | A1 * | 10/2008 | Palka et al. | 417/42 |
| 2008/0262857 | A1 | 10/2008 | Perera | |

OTHER PUBLICATIONS

U.S. Appl. No. 12/605,882 Office Action, Mar. 29, 2012, Lloyd Wentworth.

Weaterford, Rotaflex Long-Stroke Pumping Unit, Reciptocating Rod Lift, 4 pages.

IEEE Power Engineering Society, IEEE Recommended Practices and Requirements for Harmonic Control in Electrical Power Systems, IEEE Std 519-1992, 2 pages.

E Production Solutions, Epac Variable Frequency Drive Apr. 2008, 39 pages.

* cited by examiner

Upstroke Position
R
202
200
204
11b

PU1
WC
Upstroke Position
R

Drive
Chain
DC
AC Motor
Gear Box

Downstroke Position
WC
3M
100
R

Fluid Over Pump
Pump Fill - 100%
Pumping Requirement - Maximum SPM

Fluid At Pump
Pump Fill - 50% to 100% (Partial Fill)
Pumping Requirement - Modulate SPM to Maintain Fill

No Fluid (aka Fluid Pound)
Pump Fill - less than 25%
Pumping Requirement - Decrease SPM to increase fluid level Fig, 12

Fig, 14

3704 - X1 - End of Section 1 ---33
3705 - Y1 - Speed of Section 1 - 100
3706 - X2 - End of Section 2 ---140
3707 - Y2 - Speed of Section 2 - 140
3708 - X3 - End of Section 3 - 181
3709 - Y3 - Speed of Section 3 - 55
3710 - X4 - End of Section 4 - 225
3711 - Y4 - Speed of Section 4 - 140
3712 - X5 - End of Section 5 - 305
3713 - Y5 - Speed of Section 5 - 133
5309 - Y6 - Speed of Section 6 - 50

CONTROL DEVICE, OIL WELL WITH DEVICE AND METHOD

RELATED PATENT APPLICATION & INCORPORATION BY REFERENCE

This utility application claims the benefit under 35 USC 120 of U.S. Utility patent application Ser. No. 12/605,882, entitled "PUMP CONTROL DEVICE, OIL WELL WITH DEVICE AND METHOD," filed Oct. 26, 2009. This related application is incorporated herein by reference and made a part of this application. If any conflict arises between the disclosure of the invention in this utility application and that in the related provisional application, the disclosure in this utility application shall govern. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The words "substantially" and "essentially" have equivalent meanings.

The words "oil well" include natural gas wells, and oil and gas wells including water or other fluids.

The words regenerative variable frequency AC drive means an electrical control unit that acts to draw power from an electrical power grid or return power to an electrical power grid.

BACKGROUND

There are many different methods used to produce fluid from an oil well. Some wells require no pumping at all. These types of wells are called "free flowing" and are usually highly desirable by oil production companies. Most wells, however, are not free-flowing wells. Most wells require some sort of method to lift oil or other fluid from the well and to the surface. These methods are broadly included in a wide spectrum of methods called "artificial lift." Artificial lift is needed in cases when wells are not free-flowing at all, or are free-flowing but determined to be insufficiently free-flowing. There are many different types of artificial lift pumping systems. The type of artificial lift that is relevant to our device is pumping units used in reciprocating rod-lift pumping systems. A pumping unit providing this artificial lift is driven by an alternating current (AC) electric motor energized by alternating current from an AC electric power grid. Some pumping units are located where there is no electricity available. In those cases, the pumping unit may be driven by an IC (Internal Combustion) engine. There are many pumping units powered with IC engines. Our device does not apply to such IC engine drive pumping units.

A well manager unit is ordinarily used to monitor and regulate the operation of the oil well in response to conditions in the well. For example, well parameters such as the speed of the motor, the amount of fill of the pump, amount of gas in the well, down-hole well pressure, etc. are monitored and controlled as required. The commonly used rod pumps are a long-stroke pumping unit and a beam pumping unit. Many, in fact the majority, of pumping units do not require speed regulation. These pumping units operate at an average speed that is fixed, typically driven by an AC Motor. These pumping units are controlled by a well manager by ON/OFF control. When the AC Motor is "on," it runs at a fixed average speed. When the AC Motor is "off," the speed is fixed at zero. The well manager will "regulate" the well by controlling the amount of "off" time versus "on" time. This is often called "duty-cycle" control.

Both the average speed of a pumping unit and its instantaneous speed must be taken into consideration when operating the pumping unit in the best way under the prevailing well conditions. The primary reason for modulating the average speed of a pumping unit is to control the volume of fluid produced by the pumping unit over a given period time. In other words, the pump takes out of the well all of the fluid that the well is capable of producing. In some cases, the pump may be oversized relative to the well. In those cases, the pumping unit may be required to slow down. Consequently, the well manager may slow down the average speed of the pumping unit. The primary reason for modulating the instantaneous speed of a pumping unit is to avoid creating rod compression, excessively high rod tension, excessive rod tension gradients, excessively low rod tension, mechanical stress in the pumping unit or otherwise damaging equipment. In some cases, it is necessary to regulate the speed of the electric motor to avoid creating compression of the pumping unit's rod or otherwise damaging equipment. This may require braking to slow the motor speed and then increasing the motor speed, depending on the position of the rod during the course of each stroke cycle. Each stroke cycle includes an upstroke to a predetermined top rod position where the direction of movement of the rod reverses and begins a downstroke until the rod reaches a predetermined bottom rod position. Then the rod's upstroke is again initiated.

Normally braking is accomplished by directing electrical energy through resistors that dissipate this electrical energy as heat to the surrounding environment. This, however, is a fire hazard. It is also a waste of electrical energy. Some pumping units with AC motors and variable frequency AC drives operate without any braking at all. In these cases, the pumping units are operated at very low average and/or low instantaneous speeds. Or, if the pumping units are operated at higher speeds, mechanical damage is simply tolerated as a consequence of the additional stress.

Certain types of pumping units are more prone to damage at high speed operation without braking. Other types of pumping units are less prone to damage at high speed operation without braking. The type of braking produced by an AC motor with a variable frequency AC drive is sometimes called "dynamic braking." This is done to distinguish the two main types of brakes, "dynamic brakes" and "holding brakes." All pumping units are equipped with mechanical holding brakes that hold the pumping unit in position when the holding brake is engaged. Dynamic braking is the process of the AC motor, under the control of the variable frequency AC drive, removing energy from the mechanical system thereby slowing or retarding the motor shaft's rotation. The variable frequency AC drive converts this energy into heat, when the braking method is resistive. In addition to all of the reasons listed: In standard practice, when braking resistors are used, the braking resistors are usually not adequately sized to dissipate the necessary amount of energy to allow for optimum pumping unit control. Use of braking resistors involves a compromise between the size and cost of braking resistors and associated electrical components and pumping unit performance.

This background discussion is not intended to be an admission of prior art.

SUMMARY

We have invented a method and control device for operating an oil well, and an oil well using our control device, that overcomes the problems of fire hazard and energy waste associated with conventional methods and control devices. Moreover, higher yields may be obtained from an oil well using our method and device than would be achieved otherwise with less wear and tear on production equipment. Our method and control device for operating an oil well, and a well using our control device, has one or more of the features depicted in the embodiments discussed in the section entitled "DETAILED DESCRIPTION OF SOME ILLUSTRATIVE EMBODIMENTS." The claims that follow define our method and control device for operating an oil well, and an oil well using our control device, distinguishing them from the prior art; however, without limiting the scope of our method and control device for operating an oil well, and oil well using our control device, as expressed by these claims in general terms, some, but not necessarily all, of their features are:

One, our device does not apply to pumping units in which the speed of an AC motor is not modulated by a regenerative variable frequency AC drive. Our device regulates average pumping unit speed according to a speed signal from the well manager, or other equipment, controlling the pumping unit. Our device does regulate instantaneous speed, and any excess electrical energy that is generated is fed into an electric power grid upon braking by the regenerative variable frequency AC drive. Use of the regenerative variable frequency AC drive, which eliminates the compromise imposed by braking resistors, is capable of dissipating as much energy in the form of electricity as the AC motor is capable of generating. This applies when considering peak energy or average energy.

Two, our oil well includes a pump having a drive mechanism operably connected to an AC electric motor powered by AC electrical energy from a power grid, and a regenerative variable frequency AC drive that controls the AC electrical energy applied to the motor to decrease motor speed by transferring the electrical energy to the power grid and to increase motor speed by transferring the electrical energy from the power grid to the motor. The regenerative variable frequency AC drive is programmed to regulate the motor speed in a manner to optimize fluid production and maximize the operational life of the drive mechanism. Our device may be used with many different pumping units, for example, long-stroke and beam pumping units. Although it enhances the performance of beam pumping units, its improvement of long-stroke pumping units is potentially revolutionary.

Three, the drive mechanism has a predetermined stroke cycle and a signal generator provides a position signal when the drive mechanism is at a predetermined position in the stroke cycle, for example, at the end of the downstroke. The variable frequency drive regulates the instantaneous velocity of the motor based on a calculated position of the rod over the course of each stroke cycle. Since the speed of the AC motor actuating the drive mechanism correlates to rod position, control of the instantaneous velocity of the motor may be based on a calculated or measured position of the drive mechanism. The calculation is initiated when the rod is at the predetermined position as indicated by the position signal. The instantaneous velocity is regulated over the course of each stroke cycle, increasing and decreasing the motor speed to maximize fluid production and minimize tension in the rod on the upstroke and maximize tension in the rod on the downstroke, thereby minimizing mechanical stress on the pumping unit drive mechanism on the downstroke. A microprocessor calculates rod position throughout the entire stroke cycle according to the equation $$X=K\int_0^{T_o} V dt$$

where

X=rod position based on percent of cycle (0 to 100%)

V=motor speed (instantaneous revolutions per minute (rpm)

K=scaling constant, $T_o$=time at which "end of stroke" signal is received.

In general, modern-day reciprocating rod pumped wells use one of two types of pumping units: the long-stroke pumping unit using a revolving chain drive mechanism or the beam pumping unit using a revolving crank drive mechanism. The rod is operably connected to the chain or crank mechanism, as the case may be.

Four, the variable frequency drive is controlled by the microprocessor, and one embodiment comprises the combination of a regenerative variable frequency AC drive connected to an electric motor having a rotating drive shaft that drives a mechanism along a predetermined recurring path of travel. Our control device controls the operation of the AC drive to direct current (power) to and from a power grid as a function of a calculated instantaneous position of the mechanism along its recurring path of travel. The microprocessor is adapted to receive a position signal indicating that the mechanism is at a selected recurring position along its path of travel, and the microprocessor is programmed to calculate the instantaneous position of the mechanism according to the following mathematical formula:

$$X=K\int_0^{T_o} V dt$$

where

X=instantaneous position of the mechanical system along the path of travel,

V=estimated instantaneous motor shaft speed (revolutions per minute),

K=scaling constant, $T_o$=time at which the position signal is received.

The mechanism may reciprocate linearly, for example, the long-stroke pumping unit, or it may rotate, for example, the beam pumping unit. In these examples, the microprocessor calculates rod position indirectly as chain position for long-stroke pumping units and crank position for beam pumping units throughout the entire stroke cycle according to the equation $$X=K\int_0^{T_o} V dt$$

where X=instantaneous chain position for long-stroke pumping units based on percent of cycle (0 to 100%);

instantaneous crank position for beam pumping units based on percent of cycle (0 to 100%)

V=instantaneous motor speed (revolutions per minute)

K=scaling constant, $T_o$=time at which "end of stroke" signal is received.

There are other methods of calculating position. If average speed is not known, or the available representation of speed is not sufficiently accurate, position of the pumping unit can be determined by simply counting the number of motor revolutions. In other words, instead of motor speed, motor shaft position can be used to calculate the position of the drive mechanism or rod of the pumping unit position. This motor revolution method used to determine position may consist of simply counting the number of motor revolutions. Since the number of motor revolutions per stroke is a fixed and known number, each revolution of the motor corresponds to a different position. This is a more direct method of determining pumping unit position. Considered mathematically, this method can be represented as follows:

$$X_{0\%-100\%}=K^{*}\text{MotorPosition}_{0-R}$$

Where:

R=number of motor revolutions per stroke $\text{MotorPosition}_n$=nth pulse during stroke K=Scaling Constant $X_n$=instantaneous chain or crank position described previously for the nth pulse during stroke (units of percent).

The above position calculation is reset to 0% upon receiving the end of stroke signal.

If a sufficiently accurate estimate of average motor speed is available, however, position may be calculated according to the following mathematical formula:

$$X=\int_0^T K^{*}\text{Motor}RPMdt$$

Where:

MotorRPM=the estimated motor speed from the motor control

K=Scaling Constant

X=instantaneous chain or crank position described previously (units of percent)

T=time at which the end of stroke signal is received.

The formula to calculate rod position as a function motor position through a single stroke of a beam pumping unit:

$$RodPosition=\frac{RodStroke}{2}\cdot(1-\cos(X\cdot 360^{\circ}))$$

Where:

Rod Position=distance of rod from bottom of stroke (units of inches)

Rod Stroke=rod stroke length (units of inches)

X=instantaneous chain position (units of percent)

Formula to calculate rod position as a function motor position through single stroke of long stroke pumping unit:

For $0\%\leq X\geq 50\%$ $$\text{RodPosition}=2^{*}X^{*}(\text{RodStroke})$$

For $50\%<X\geq 100\%$ $$\text{RodPosition}=2^{*}(1-X)^{*}(\text{RodStroke})$$

Where:

Rod Position=distance of rod from bottom of stroke (units of inches)

Rod Stroke=rod stroke length (units of inches)

X=instantaneous chain position described previously (units of percent)

One rod stroke is defined as the rod moving through a complete cycle. Typically, the rod is considered to start and end its stroke at the lowest position of the rod, this is also called "bottom of stroke". The rod starts its stroke at this bottom of stroke and begins to move upwards. This particular motion of the rod upwards is called the "upstroke". The rod moves upwards a distance that is determined by the pumping unit. At the exact moment the rod moves upwards to its highest position the rod is said to be at "top of stroke". The distance the rod moves from the bottom of stroke to the top of stroke is called the "length of stroke" or "stroke length." The stroke length is typically given in inches. After the rod goes through the top of stroke position the rod begins to move downwards. This particular motion of the rod downwards is called the "downstroke." The rod continues to move downwards until it reaches bottom of stroke. This complete cycle, starting at bottom of stroke proceeding upwards to the top of stroke and then continuing back down to the bottom of stroke is one complete stroke. The length of stroke is the distance from bottom of stroke to the top of stroke. The amount of time that is required to move through one complete stroke is the period of the stroke. Typically pumping unit speed is measured in strokes per minute (SPM). The SPM is given by the formula:

$$\text{SPM}=60/\text{Period of Stroke}$$

Rod position need not be directly calculated in our control method and device. In the present implementation of our control device the technician who initially programs the software has the option during initial setup to "map" a speed reference for each increment of a degree from 0° to 360° of position calculations. Each of these position calculations does correlate to a specific position of the rod and a specific position of the pumping unit. However, our software program does not calculate or display rod position or pumping unit position. Our software program only displays position as discussed above. It is at the technician's discretion to determine what speed is required at each position calculation. The technician will consider the rod-string, pumping unit, power consumption, AC motor and overall production when programming our device. There are many subjective aspects the technician is required to consider when initially programming our device to maximize pump displacement while minimizing stress on the rod-string, pumping unit and AC motor.

Rod position and drive mechanism position are related through the equations described above. If one knows the position of the drive mechanism, whether by measurement or calculation, then one can calculate the position of the rod. Or conversely, if one knows the position of the rod, whether by measurement or calculation, then one can calculate the position of the drive mechanism. As it relates to our device, the use of rod position or drive mechanism position is a useful and effective means which can be used as the input to a speed map. A controller for the AC regenerative drive provides an estimated speed of the motor. Using this estimated speed as an input to an integrator in a control circuit as means to calculate drive mechanism position is a reliable method of controlling pumping units. However, other means may be used. Any method of calculating or measuring either rod position or drive mechanism position may be equally effective.

Five, the AC electrical motor moves the drive mechanism through its stroke cycle. For example, in the case of the long-stroke unit its rod moves through a stroke cycle having an upstroke and a downstroke, and it is operably connected to the rod through a motor that rotates a known number of revolutions with each stroke cycle. A first sensor provides an end of stroke (EOS) signal each time the rod is at an end of the downstroke during each stroke cycle. A well manager control unit controls the operation of the oil well in response to conditions of the well and provides for each stroke cycle a speed signal corresponding to an optimum average motor speed to maximize fluid production under the then present well conditions. A microprocessor with an input at which the speed signal is received and an input at which the end of stroke signal uses these signals to control the operation of our device. For each individual well using our control device, the microprocessor is programmed so that optimization of fluid production and maximum operational life of the drive mechanism is achieved. Specifically, the microprocessor is programmed to drive the electrical motor over the course of each stroke cycle at different speeds as a function of a calculated or measured position of the drive mechanism, either the long-stroke pumping unit or pumping units with a crank (gear box output), decreasing the motor speed by transferring electrical energy to the power grid and increasing the motor speed by transferring electrical energy from the power grid to the motor.

Six, the microprocessor's program varies the instantaneous velocity of the motor based on (i) the speed signal and (ii) a calculated or measured position of drive mechanism over the course of each stroke cycle, increasing and decreasing the motor speed to maximize fluid production and limit maximum tension in the rod on the upstroke and maximize tension in the rod on the downstroke. The calculation of the position of the drive mechanism is initiated each time the "end of stroke" signal is received. Also, the microprocessor's program sets the motor at a predetermined minimum speed whenever (a) the calculated or measured drive mechanism indicates a rotation greater than a known fixed number of revolutions and (b) the "end of stroke" signal has not been received. After setting the motor speed at the predetermined minimum speed, and once again after receiving the "end of stroke" signal, the microprocessor's program varies the instantaneous velocity of the motor based on (i) the speed signal and (ii) a calculated or measured rod position of the drive mechanism. A second sensor may be used that monitors tension in the rod and provides a tension signal corresponding to the measured tension. The microprocessor may have an input that receives the tension signal and is programmed to take into account the measured tension.

Seven, our control device may include a circuit that controls the waveform of the input AC current to reduce low order harmonic current drawn from the power grid. One embodiment includes IGBT transistors that are switched on and off in such a manner that results in current flow and voltage that is substantially sinusoidal. This embodiment may include an inductive and capacitive filter that reduces voltage distortion caused by switching a converter circuit directly to the input AC current.

Eight, our method of operating an oil well comprises the steps of (a) applying through a variable frequency drive AC electrical energy from a power grid to an AC electric motor operating a drive mechanism of a pump that pumps fluid from the well, and (b) regulating the motor speed in a manner to optimize fluid production and maximize the operational life of the drive mechanism, decreasing motor speed by transferring the electrical energy to the power grid and increasing motor speed by transferring the electrical energy from the power grid to the motor.

The drive mechanism has a predetermined stroke cycle and, over the course of each stroke cycle, the motor is operated at different regulated speeds initiated when the drive mechanism is at a predetermined position in each stroke cycle.

These features are not listed in any rank order nor is this list intended to be exhaustive.

DESCRIPTION OF THE DRAWING

Some embodiments of our method and control device for operating an oil well, and a well using our control device, are discussed in detail in connection with the accompanying drawing, which is for illustrative purposes only. This drawing includes the following figures (Figs.), with like numerals indicating like parts:

FIG. 3A' is a perspective view of a conventional long-stroke pumping unit similar to FIG. 3A except its housing is removed to show an internal chain drive mechanism.

FIG. 3B' is a perspective view of the conventional long-stroke pumping unit shown in FIG. 3B with its rod at the end of the rod's downstroke and its drive belt in a down position.

DETAILED DESCRIPTION OF SOME ILLUSTRATIVE EMBODIMENTS

Figure 1:
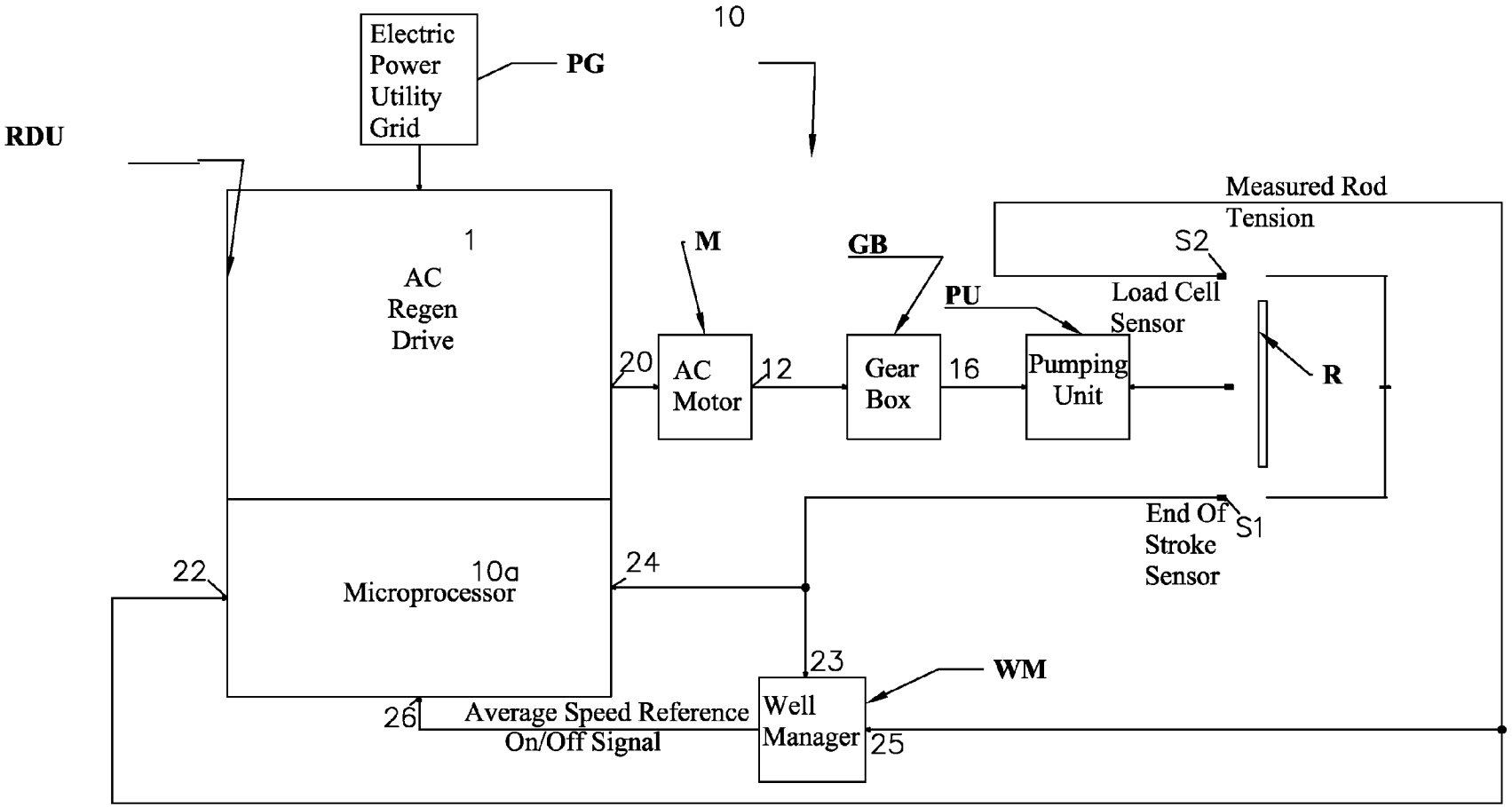
FIG. 1 is a schematic diagram depicting our control device and method of operating an oil well.
Figure 4A:
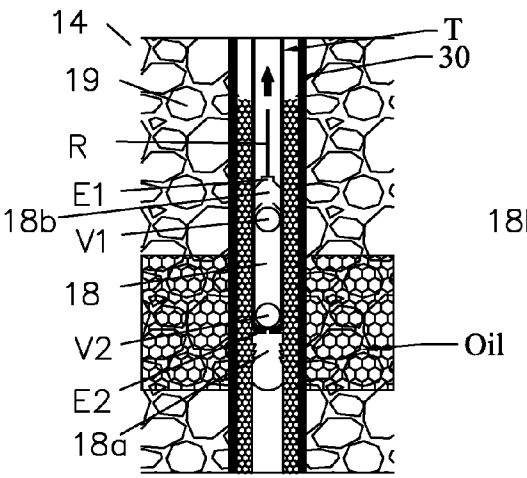
FIG. 4A is an enlarged cross-sectional view of the down hole position of the end of the rod with the fluid level above the rod's end.
Figure 4B:
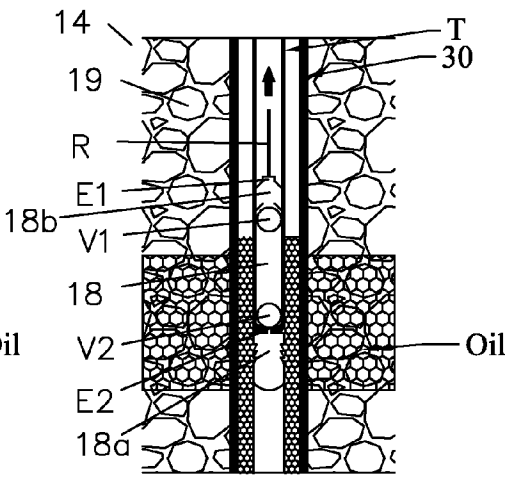
FIG. 4B is an enlarged cross-sectional view similar to that of FIG. 4A with the relationship between the rod's end and the fluid level such that maximum fluid production is achieved.
Figure 4C:
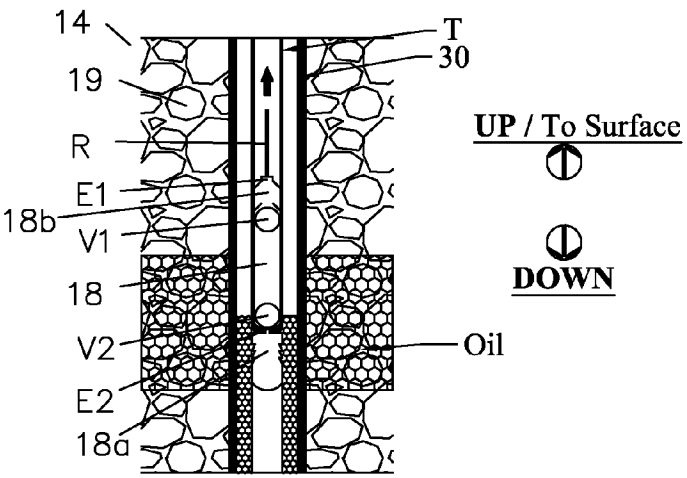
FIG. 4C is an enlarged cross-sectional view similar to that of FIG. 4A showing the fluid level below the rod's end.

As shown best in FIG. 1, one embodiment of our control device designated by the numeral 10 controls the operation of a pumping unit PU (long-stroke or beam) of an oil well 14 (FIGS. 4A through 4C). Our control device 10 includes a regenerative variable frequency AC drive unit RDU, which is a conventional programmable apparatus such as, for example, sold by ABB OY DRIVES of Helsinki Finland, under the designations ACS800-U11-0120-5 and ACS800-U11-0120-5+N682. In accordance with our method, the regenerative variable frequency AC drive unit RDU is controlled by a microprocessor 10*a* programmed to transfer electrical energy to and from an AC power grid PG in a manner to optimize fluid production and maximize the operational life of the pumping unit PU. The regenerative variable frequency AC drive unit RDU is operatively connected to an AC electric motor M that drives the pumping unit PU. The number of strokes per minute (SPM) of the pumping unit PU is increased or decreased as determined by a conventional well manager unit WM, for example, sold by Lufkin Automation of Houston, Tex., USA, under the designation SAM™ Well Manager.

Our device may use the estimated motor speed from the drive unit's motor control 60 (FIGS. 2A and 2B) as the input to our mathematical formula that calculates position. The motor speed is estimated; therefore, the position calculation is estimated as well. The accuracy of our position determination is important to the overall performance of our device. Observed error in the accuracy of the position calculation in the field when using a NEMA Design B motor (manufactured by Weatherford of Geneva, Switzerland) has been found to be less than 0.2%. The error in position accuracy is increased with certain types of AC motors. In general, the lower the rated slip for the motor, the lower or position error will be. We have successfully used our device on NEMA Design B, NEMA Design C and NEMA D motors. Observed error in position accuracy has been as high as 0.7% when using NEMA Design D motors. However, even at this level of position error the control system of our device is still effective in controlling and operating the pumping unit PU.

Measured speed could be used as the input to the mathematical formula that calculates position as well. In fact, using measured speed may result in higher levels of accuracy of the resulting position calculations. However, based on experience to date, the use of measured speed has not been necessary. In many cases, the well manager that our device interfaces uses measured speed to calculate position. There are a variety of ways to monitor an AC Motor as it turns. Two separate methods are depicted in FIG. 1A.

One measuring method employs an encoder EN (FIG. 1A) that produces electrical pulses, or some other means of transmitting position information, as the motor revolves. Some encoders produce thousands of pulses per motor revolution. Most encoders produce in the range of 1000 to 2000 pulses per motor revolution. For example, if the encoder EN produces 1024 pulses per revolution and a single motor rotation is considered to be 360°, then 2.844 pulses from the encoder represents 1 degree of rotation of the motor. Most encoders are designed to transmit direction information as well; forward rotation or reverse rotation. Encoders are usually constructed, installed and wired in such a way that two separate channels are used to transmit electrical pulses. There is usually a phase shift between these two channels that indicates direction of rotation. For example, while rotating "forward" the A channel will lead the B channel by 90° in phase. However, when rotating "reverse" the A channel will lag the B channel by 90° in phase.

Figures 1A, 9A, 9B:
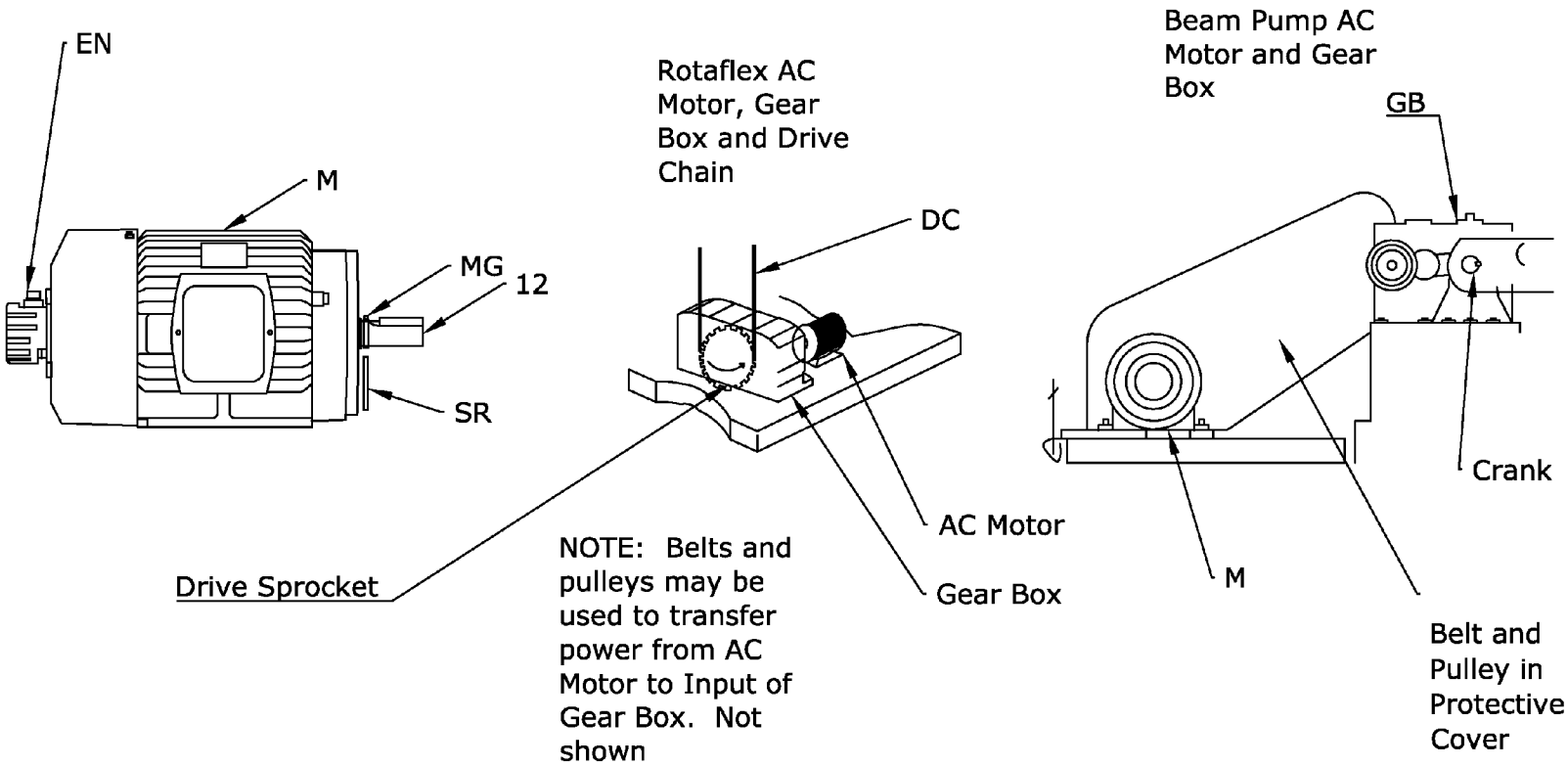
FIG. 1A is a side view of an AC electric motor equipped with sensor apparatus for measuring the number of revolutions of the motor's drive shaft.
FIG. 9A is a schematic diagram illustrating measuring chain position of a long-stroke pumping unit.
FIG. 9B is a schematic diagram illustrating measuring crank position of a beam pumping unit.

Another measuring method also depicted in FIG. 1A is in the form of a magnet MG and sensor SR. This method of monitoring uses the magnet MG, or some other like device, mounted and fixed to the drive shaft 12 of the AC motor M. Therefore the magnet MG rotates exactly with the motor shaft 12 and produces a pulse in the adjacent sensor SR mounted nearby the shaft and fixed to the motor's case. The sensor SR and magnet MG are physically arranged in such a way that the magnet actuates the sensor one time per revolution of the shaft 12.

Monitoring motor revolutions, either by use of an encoder, magnet or some other shaft sensor is a reliable method of obtaining position information. If the pulse count is initiated at some point in time, then simply counting motor revolutions will result in a count that is proportional to the number of revolutions the motor has turned. Thus, scaling the pulse count to determine position of any mechanical mechanism that rotates with the motor. In the case of an oil pumping unit, the motor revolution counting process is initiated with an "end of the stroke" signal. The pulses are simply counted. The pulse count is proportional to the chain position for a beam pumping unit, and the pulse count is proportional the chain position in the long-stroke pumping unit. The pulse count is scaled and used as the input to mathematical formula to determine position of the drive mechanisms, or indirectly the rod position.

Estimated motor speed may also be used as the input to the microprocessor 10*a*, for example, to an integrator 50 (FIG.

2A) that is used to calculate the position of the pumping unit's drive mechanism within a single stroke cycle. Modern regenerative variable frequency AC drives are often equipped with very sophisticated motor controllers. These advanced controllers are often called vector control, flux vector control, direct torque control or true torque control. These advanced controllers adjust the motor voltage in such a way that the magnetic flux and mechanical torque of the motor can be precisely controlled. Often, these advanced motor controllers offer an estimated motor speed that is remarkably dynamic, accurate and consistent. The estimated motor speed from these advanced motor control methods is often sufficiently accurate to allow for use of the estimated speed as the only input to the integrator 50. In fact, we have found, through experience, that the internal estimated motor speed generated by the regenerative variable frequency AC drive to more useful and reliable than external methods of measuring motor position or counting revolutions of the motor within a stroke.

Pumping Units

Figures 3A, 3B, 3D:
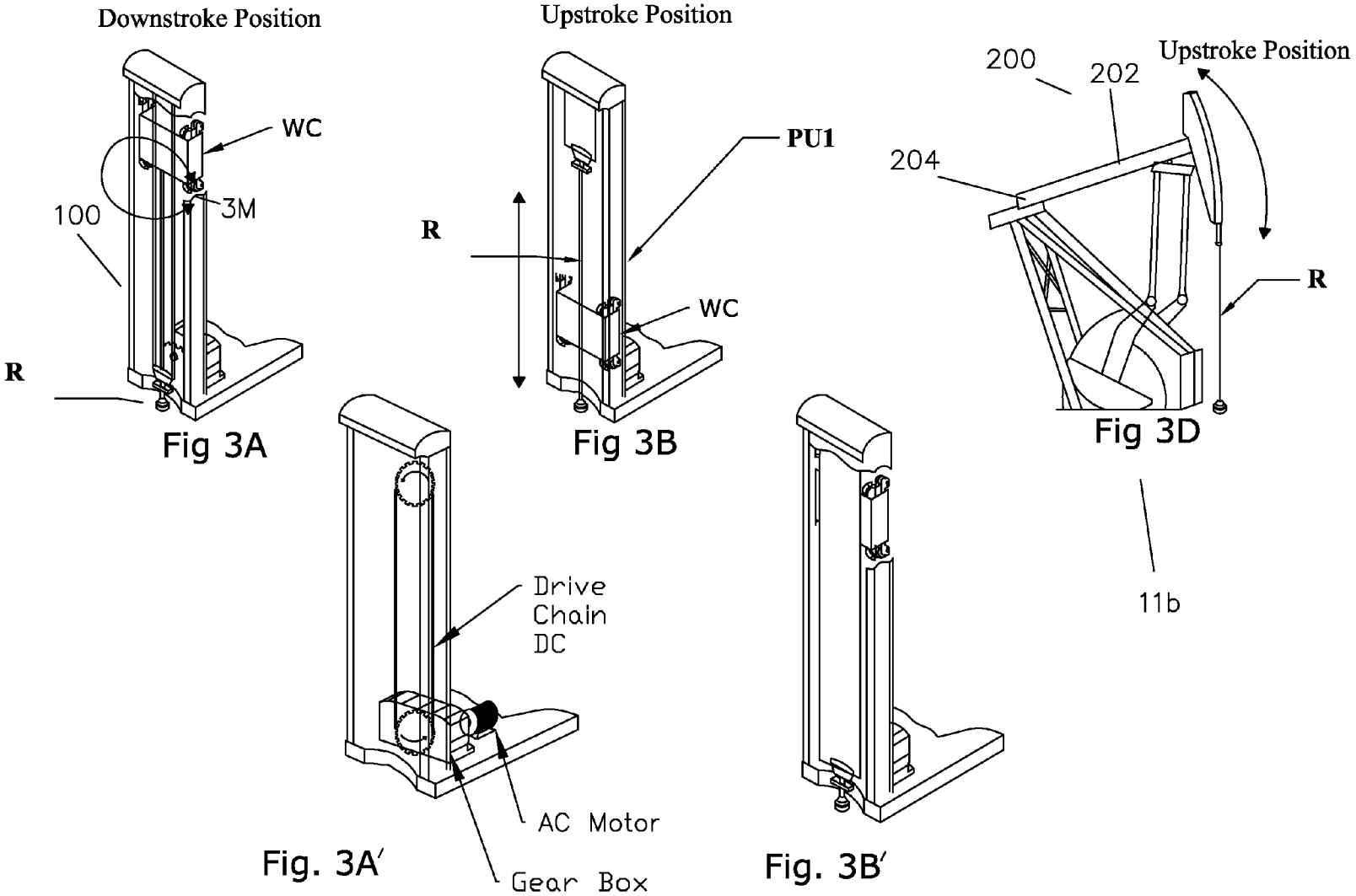
FIG. 3A is a perspective view of a conventional long-stroke pumping unit with its rod at the end of the rod's downstroke.
FIG. 3B is a perspective view of the conventional long-stroke pumping unit shown in FIG. 3A with its rod at the end of the rod's upstroke and its drive belt in an up position.
FIG. 3D is a perspective view of a Mark II beam pumping unit pivoting near its rear end.
Figure 3E:
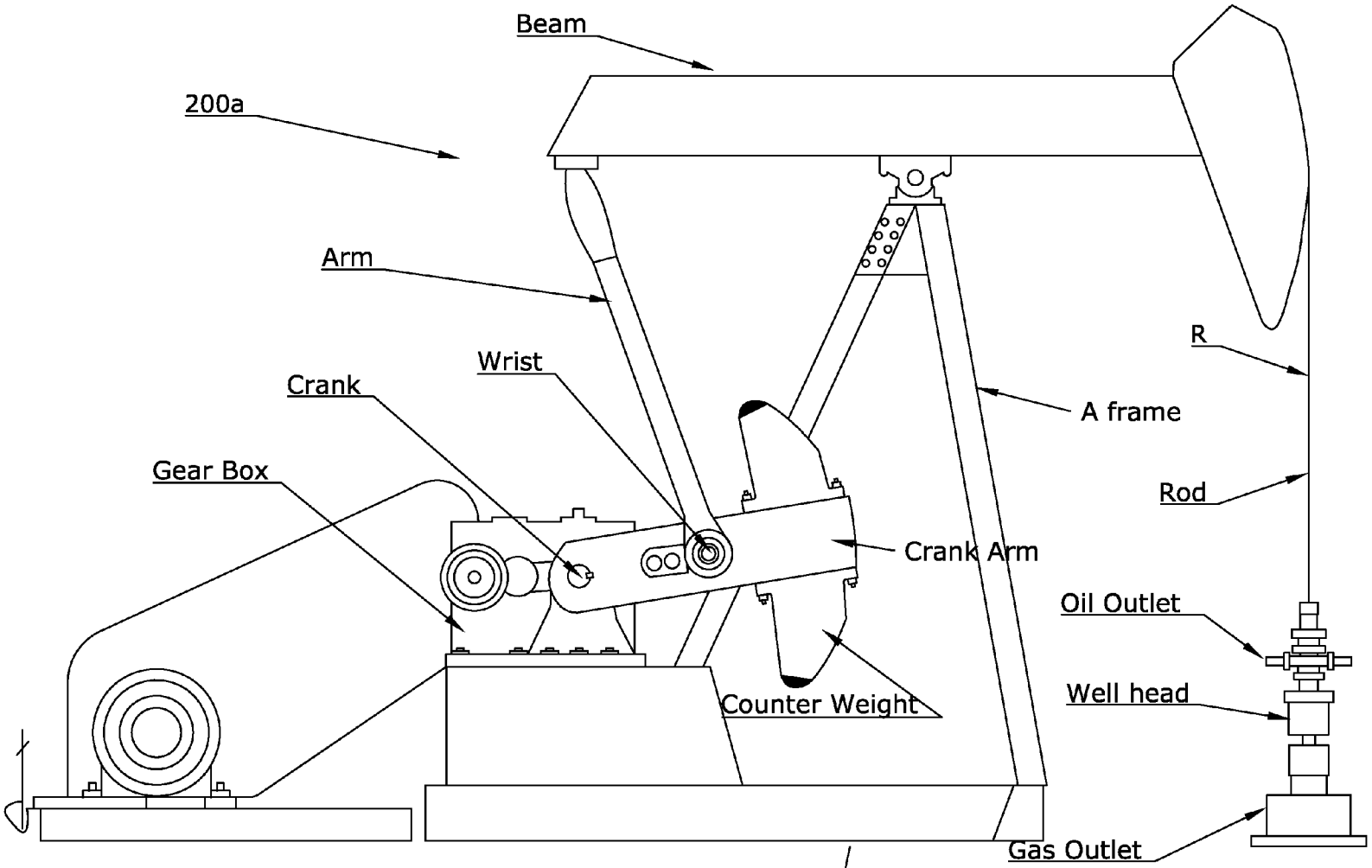
FIG. 3E is a side view of a conventional counterweight pumping unit using a beam that pivots near its midpoint.
Figure 3F:
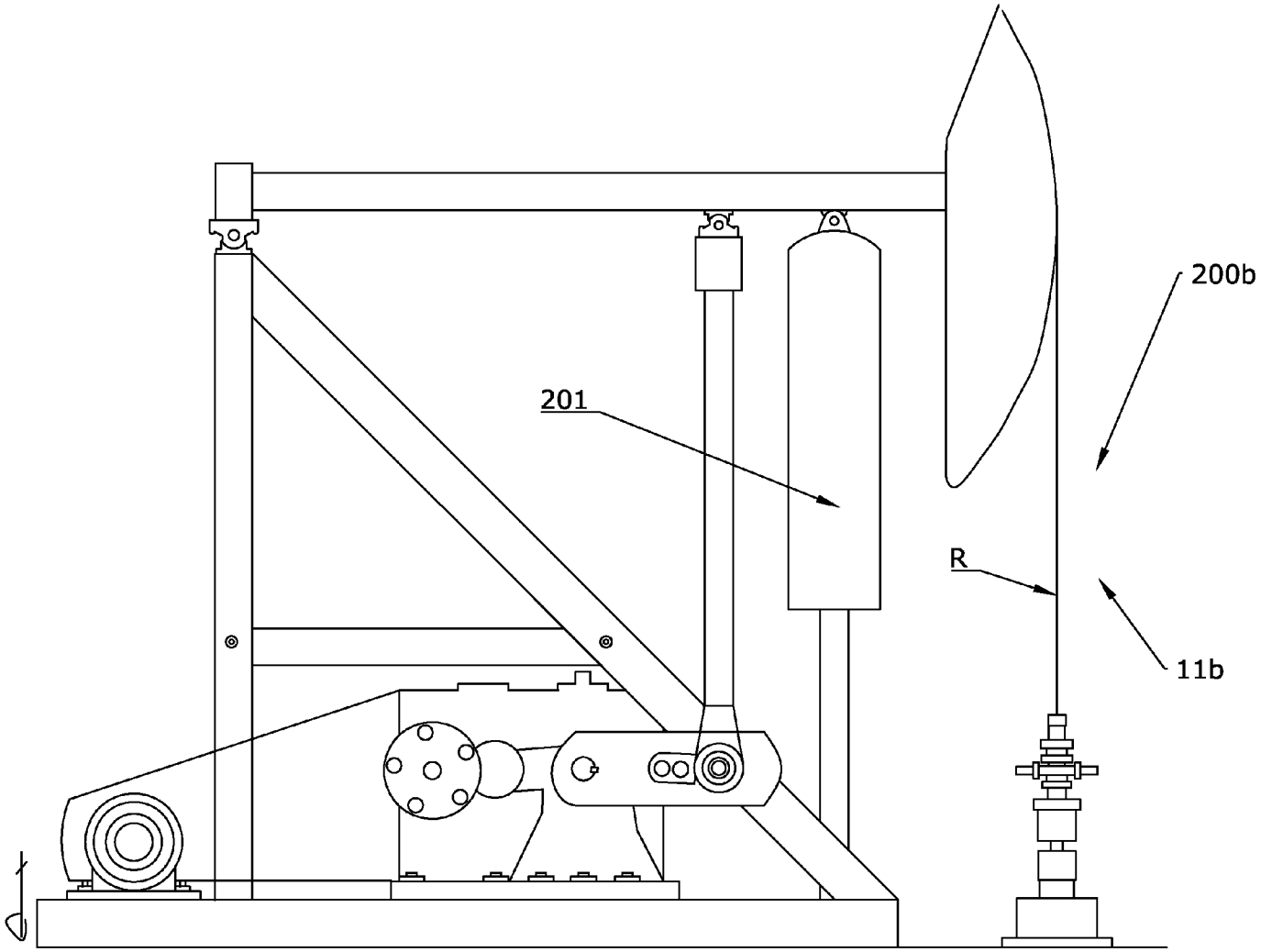
FIG. 3F is a side view of an air balance pumping unit using a beam that pivots near its rear end.

The pumping unit PU may be, for example, a long-stroke pumping unit 100 (FIGS. 3A and 3B) or a beam pumping unit, for example, a Mark II unit 200 (FIG. 3D) pivoting at an end, or a counter-weight pumping unit 200*a* (FIG. 3E) pivoting at its midpoint, or an air balance pumping unit 200*b* (FIG. 3F). All have a rod R that extends below ground level into the well formation 19. In the long-stroke pumping unit 100 the direction of movement of its rod R is reversed by a mechanical transfer mechanism 3M (FIG. 3A). In the beam pumping unit 200 (FIG. 3D) the direction of movement of its rod R is reversed as its lever arm 202 pivots about a pivot mechanism 204. The embodiment illustrated in FIGS. 3A and 3B and designated by the numeral 11*a* shows our control device for the long-stroke pumping unit 100, for example, a Rotaflex® unit. The embodiment illustrated in FIGS. 3D, 3E and 3F, and 5B and designated by the numeral 11*b* shows our control device for the beam pumping units 200, 200*a*, 200*b*. The microprocessor 10*a* is programmed differently in each of these embodiments as discussed subsequently in greater detail.

Figures 8A, 8B:
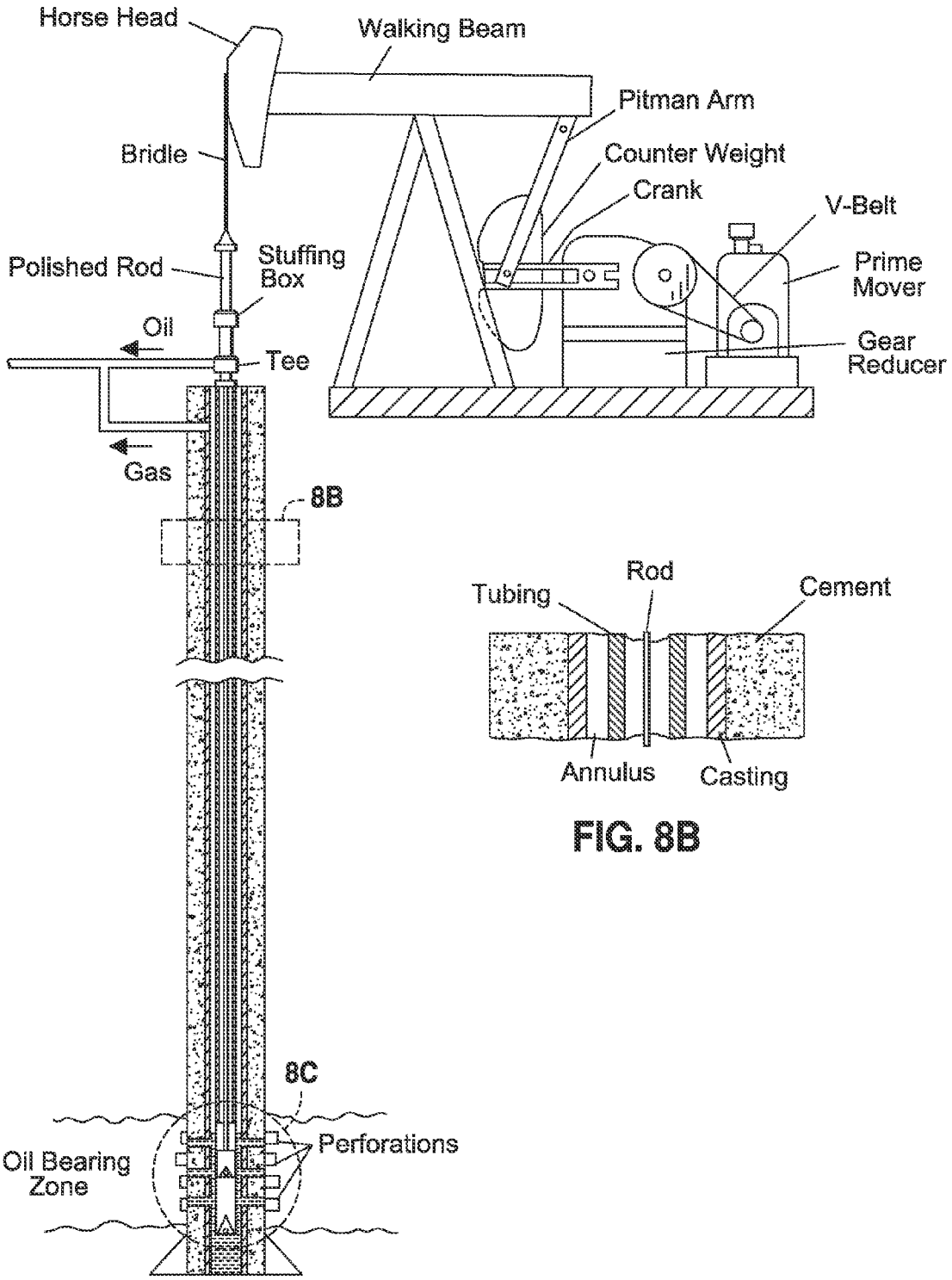
FIG. 8A is a schematic diagram of an oil well.
FIG. 8B is a schematic diagram depicting an enlarged cross-section through a down hole portion of the oil well depicted in FIG. 8A.

The AC electric motor M has its drive shaft 12 operatively connected to a gearbox GB having its drive shaft 16 operating a drive mechanism of the pumping unit PU to pump fluid from the well 14. As illustrated in FIGS. 4A through 4C, the drive mechanism for both the long-stroke pumping unit 100 and beam pumping unit 200 includes a rod R having a terminal end attached to an upper end E1 of a plunger 18*b* seated inside a stationary barrel or pump chamber 18 located near the bottom of the well. There are inlet orifices 18*a* at the pump chamber's lower end E2. Within the pump chamber 18 is a pair of spaced apart check valves, a traveling valve V1 and a standing valve V2, respectively near the ends E1 and E2. The rod R, which is driven up and down by the pumping unit PU located at the surface, is connected to the plunger 18*b*, which moves with the up and down movement of the rod R. The standing valve V2 and traveling valve V1 operate in a coordinated manner with the motion of the plunger 18*b* to cause fluid in the well to flow into a tubing T and eventually to the surface. As shown in FIG. 8B, the tubing is surrounded by the open area or annulus between the tubing and the well's casing 30

This type of rod pump has physical dimensions that are specified during the construction of the pump. The pump will have a diameter and stroke length, usually in units of inches. The stroke length of the pumping unit at the surface and the stroke length of the rod pump at the bottom of the well are not identical due to rod stretch. The amount of fluid produced from a rod pump is measured as "gross displacement." The gross displacement of a rod pump/well combination is typically measured in barrels per day (BPD). The following is the formula for calculating the BPD of a rod pump:

The following formula applies to an ideal pump, not taking into account "pump efficiency."

$$BPD = L \times \pi \times \left(\frac{D}{2}\right)^2 \times SPM \times 60 \times 24 \times \frac{1}{9702}$$

L=Pump Stroke (inches)
D=Pump Diameter (inches)
SPM=Strokes Per Minute
60 is the number of minutes per hour
24 is the number of hours per day (operational hours)
9702 is the number of cubic inches per barrel If pump efficiency is taking into account, the formula changes to:

$$BPD = L \times \pi \times \left(\frac{D}{2}\right)^2 \times SPM \times 60 \times 24 \times \frac{1}{9702} \times \mu$$

L=Pump Stroke (inches)
D=Pump Diameter (inches)
SPM=Strokes Per Minute
60 is the number of minutes per hour
24 is the number of hours per day (operational hours)
9702 is the number of cubic inches per barrel
μ is pump of efficiency The pumping unit PU cycles through one entire stroke as determined by the ratio of the gears in the gearbox GB and motor revolutions. For example, a fixed number of revolutions of the motor drive shaft 12 equals one stroke cycle. The regenerative variable frequency AC drive unit RDU provides a variable frequency and voltage current that varies the instantaneous velocity of the motor M over the course of each cycle of the pumping unit PU as this unit moves through a single stroke cycle. Since the gearbox GB rotates through a known and fixed number of rotations, which can be measured in degrees of rotation, with each stroke cycle, the position of the rod R may be calculated over the course of each stroke cycle. Namely, at 0° the rod is at the beginning of the stroke cycle (0% of cycle), at a known and fixed number of rotations, which can be measured in degrees of rotation, the rod is at the end of the stroke cycle (100% of cycle, for example, the end of the downstroke of the rod R). Half this known and fixed number of rotations, the pumping unit is half way through its cycle (50% of cycle), etc.

Figure 2A:
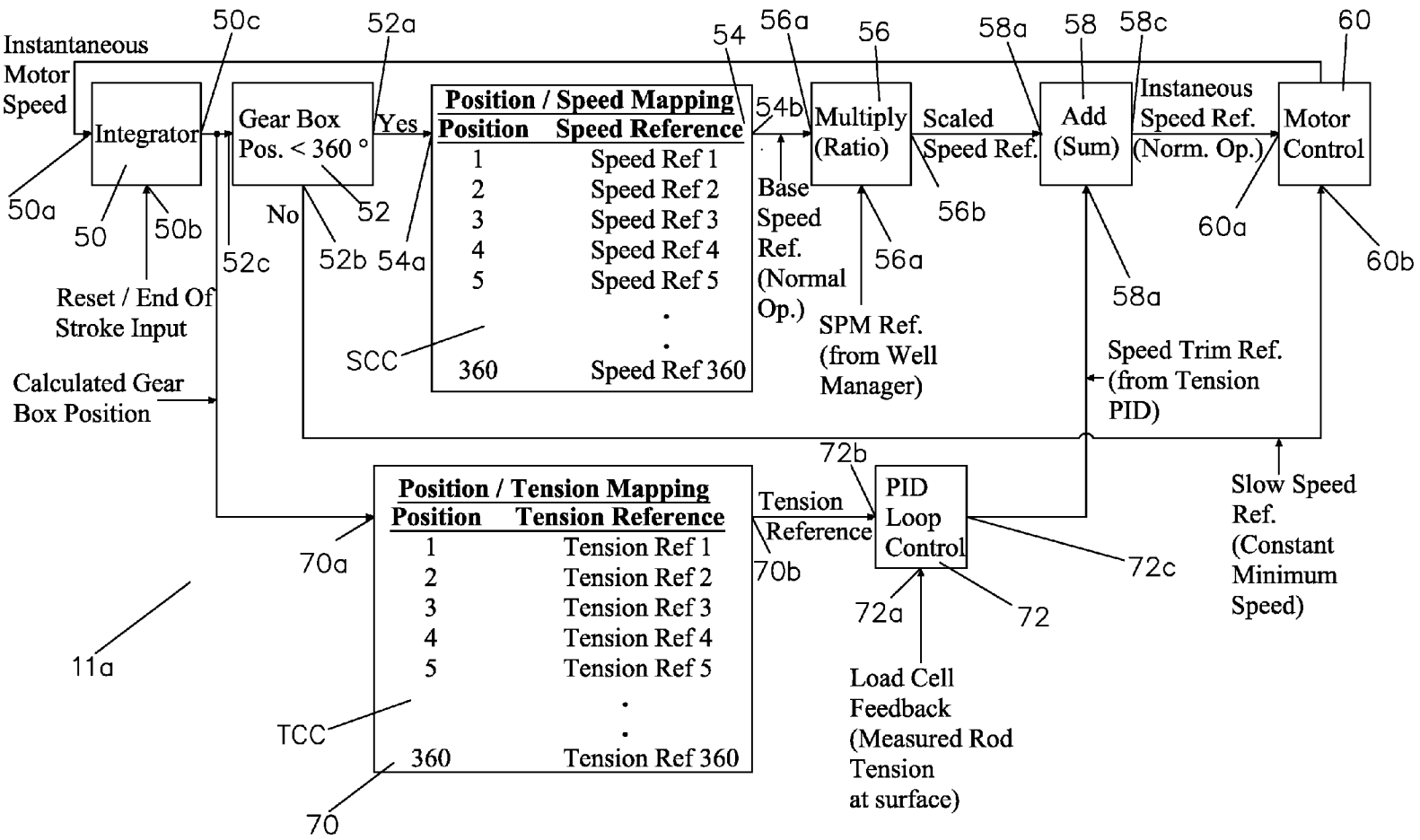
FIG. 2A is a diagram depicting the function of a microprocessor used to control a regenerative AC drive unit programmed to operate a pumping unit that includes tension monitoring.
Figure 2B:
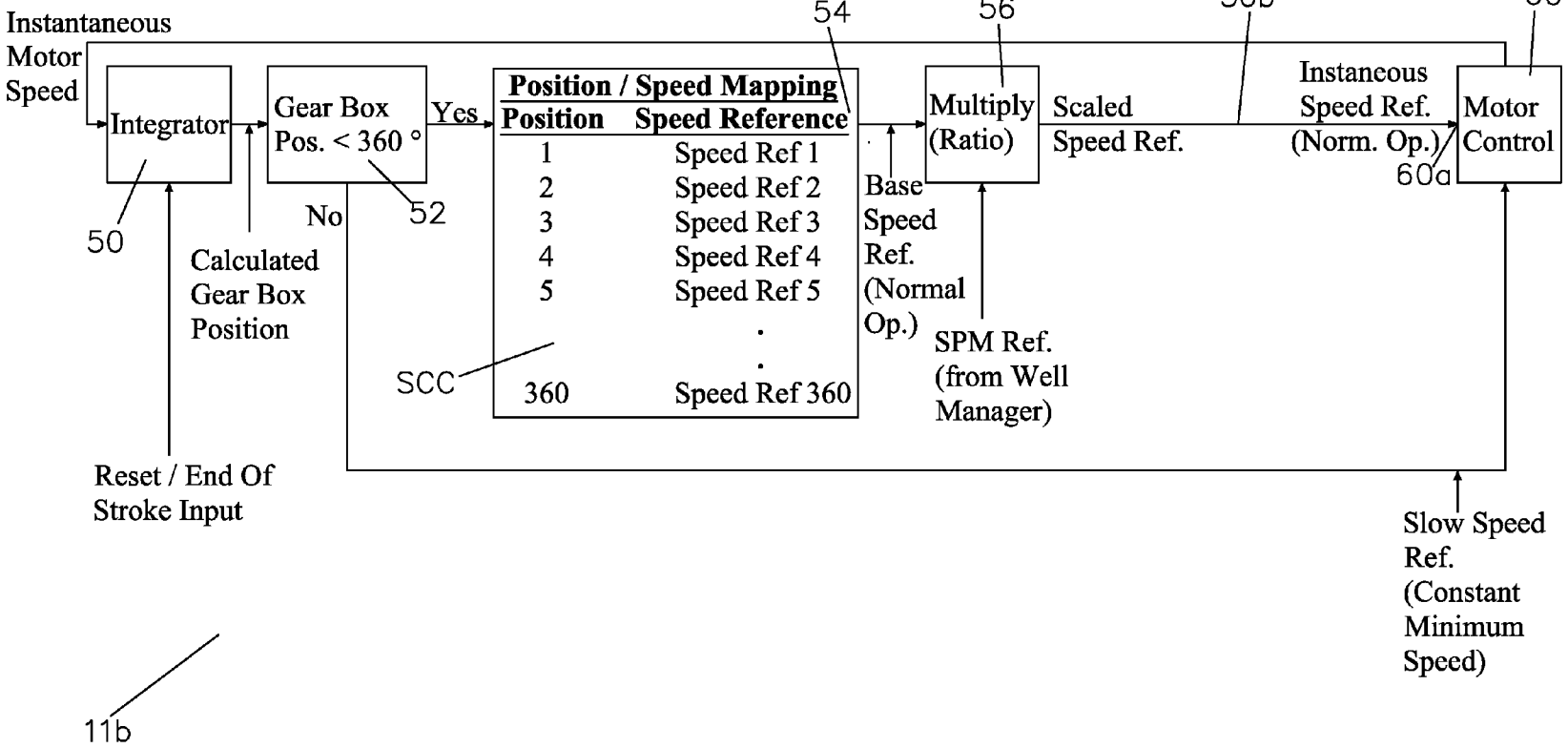
FIG. 2B is a diagram depicting the function of a microprocessor used to control a regenerative variable frequency AC drive unit programmed to operate a pumping unit that does not include tension monitoring.
Figure 2C:
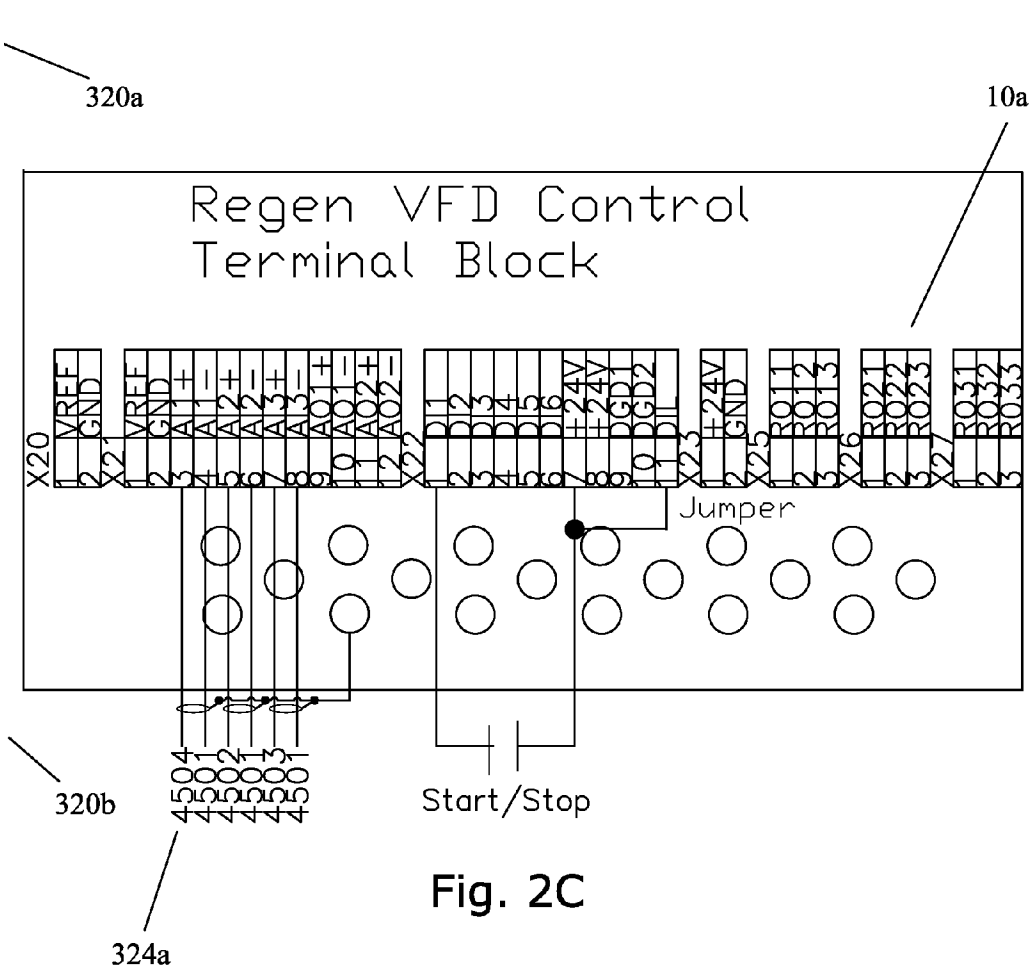
FIG. 2C is an enlarged diagram showing the terminal connections between the microprocessor and other components of the control circuit depicted in FIGS. 6A, 6B and 6C.

In accordance with our method, regardless of the type of pumping unit PU employed, long-stroke or beam, there is a sensor S1 (FIG. 1) that functions as a location detector. The sensor S1 detects when the rod R is at a predetermined position in the stroke cycle and provides a signal each time the rod is at this predetermined position, for example, at the end of the downstroke and provides a signal (herein the "end of stroke" signal). This "end of stroke" signal is sent to an input 23 of the well manager unit WM and to an input 24 of the microprocessor 10*a*, which is used to control the regenerative variable frequency AC drive unit RDU. Optionally, a second sensor S2 (FIG. 1) may be deployed to detect predetermined rod conditions. For example, the sensor S2 may be a load cell that detects the surface tension in the rod R and sends a signal (herein "tension" signal) to an input 25 of the well manager unit WM and to an input 22 of the microprocessor 10*a* which is used to control the regenerative variable frequency AC drive unit RDU. Tension monitoring and control may be used with either a long-stroke or beam pumping unit. FIG. 2A illustrates the embodiment using tension monitoring and control and FIG. 2B illustrates the embodiment without such tension monitoring and control.

The well manager control unit WM is used to monitor and control well parameters in accordance with conventional procedures. For example, when the pump chamber 18 is completely filled, or the amount of fill is above the desired fill as illustrated in FIG. 4A, the well manager unit WM, which is in communication with the microprocessor 10*a*, sends a signal (herein "speed" signal) to the regenerative variable frequency AC drive unit RDU to increase the motor's average speed (rpm's), or maintain the motors average speed in the case when the motor is already operating at its maximum average speed. Moreover, when the pump chamber 18 is only partially filled as illustrated in FIG. 4C, the "speed" signal sent to the regenerative variable frequency AC drive unit RDU indicates a decrease in the motor's average speed (rpm's). Ideally, the "speed" signal corresponds to an optimum average motor speed to maximize fluid production under the then present well conditions. The "end of stroke" signal indicates that the rod R is in a predetermined position that is the same for each stroke cycle. The "tension" signal may be applied to the microprocessor's input 22 and the microprocessor 10*a* may be programmed to take into account the measured tension indicated by the "tension" signal to minimize tension in the rod R on the upstroke and maximize tension in the rod on the downstroke.

For each stroke cycle the well manager control unit WM designates what the average speed of the pumping unit PU should be over the course of an individual stroke cycle, mainly ranging substantially from 600 to 1600 rpm. The well manager unit WM may, with each cycle, change the "speed" signal to either increase or decrease the average motor speed or maintain the average speed as previously established. The microprocessor 10*a* is programmed to respond to the "speed" signal from the well manager unit WM to control the instantaneous motor speed in an optimum manner. In other words, over the course of each stroke cycle at different calculated or measured chain or crank position, as the case may be when indirectly determining rod position, the motor M is operated at regulated same or different instantaneous velocities (speed mapping) initiated when the drive mechanism is at a predetermined position in each stroke cycle, typically at the end of the downstroke of the rod R, as indicated by the "end of stroke" signal. Upon receiving the "end of stroke" signal, the "speed" signal from the well manager unit WM is applied to an input 26 of the microprocessor 10*a* to initiate regulating the instantaneous motor velocity in accordance with a predetermined speed map for the then present well conditions.

During each stroke cycle, the regenerative variable frequency AC drive unit RDU converts input AC current from the AC power grid PG that is at a standard frequency and voltage to a variable AC current having different frequencies and voltages as established by the program of the microprocessor 10*a*. The microprocessor 10*a* controls the operation of the regenerative variable frequency AC drive unit RDU by applying the variable AC current to the motor M at an output 20 to decrease instantaneous motor velocity, transferring electrical energy to the power grid PG, and to increase instantaneous motor velocity, transferring electrical energy from the power grid to the motor. Based on pre-established parameters, for example, the type of well, conditions of the well, the set point (percent fill) for filling the chamber 18, the "speed" signal indicates for each stroke cycle whether to (1) increase or decrease the average motor speed or (2) maintain the average motor speed as is. Referring to FIG. 4B, at the end of the stroke cycle the valve V1 is open so fluid flows into the moving portion of the pump the plunger 18*b*. On initiation of the upstroke of the rod R the open valve V1 closes and the valve V2 opens. As the rod R continues to move up, fluid flows from the plunger 18*b* into the tubing T. As the plunger 18*b* moves up during the upstroke, valve V2 is open allowing fluid from the formation 19 to flow into the pump's inflow section 18*a* and then into the pump. When the rod R reverses its direction of movement at the transition between the upstroke and downstroke, the valve V2 closes and the valve V1 opens. With valve V1 open and V2 closed, the plunger 18*b* of the pump fills as it falls. The plunger 18*b* of the pump is filled on the downstroke with the fluid that filled the pump during the upstroke.

Figure 8C:
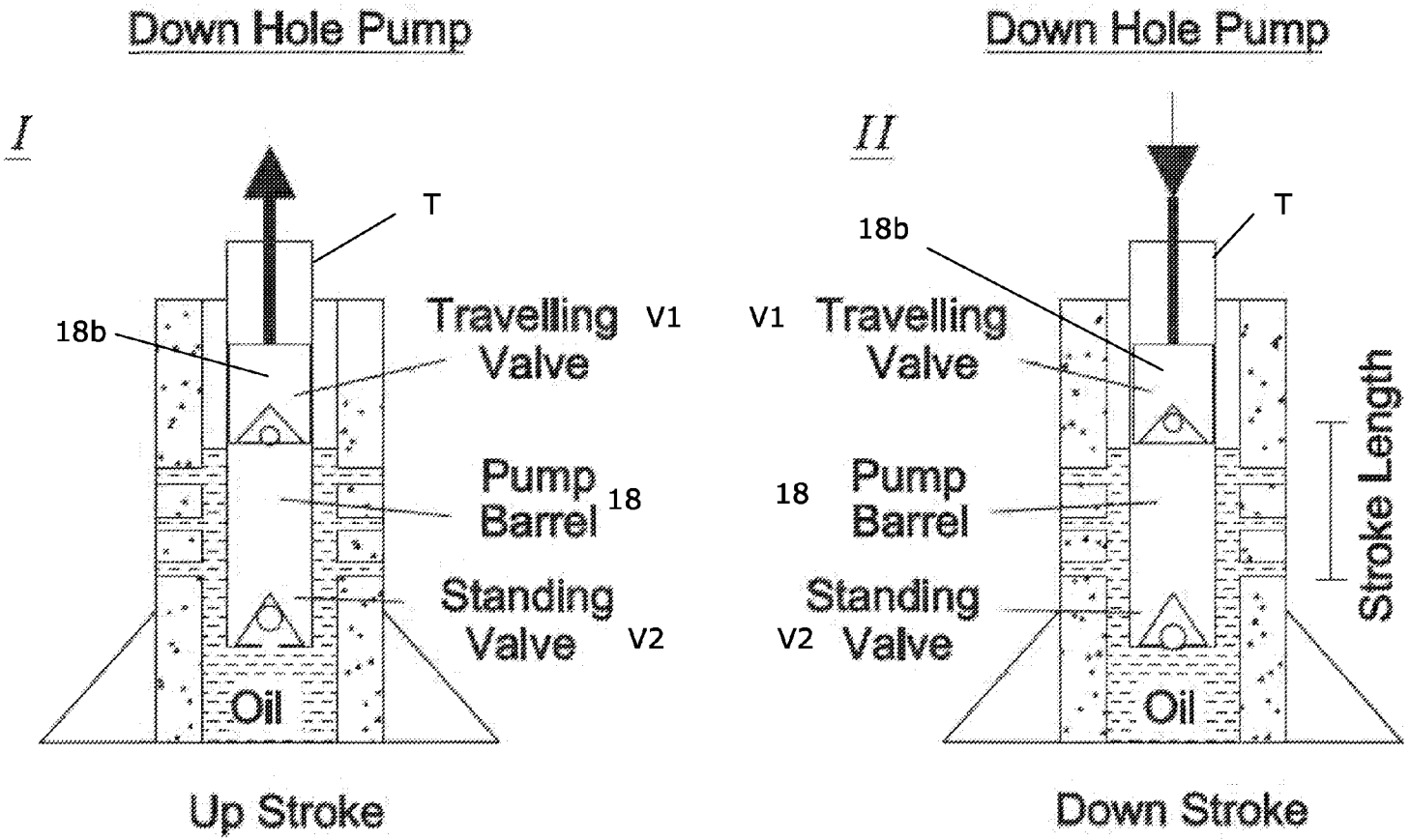
FIG. 8C is a schematic diagram depicting the pump chamber under two different oil levels identified as condition I and condition II.

Natural Gas is produced from wells using a process similar to the process used to produce oil. In the case of natural gas, however, the gas need not be pumped to the surface in the tubing. Natural gas will flow out of the formation 19 and into the well through perforations 21 (FIG. 8C) deliberately made in the well's casing 30. Once natural gas is in the well, the properties of natural gas cause the gas to flow toward the surface naturally in the annulus of the well. In this way, the gas can simply be recovered at the surface by simply connecting a means of collecting gas to the annulus through the well's casing. For this reason, the natural gas, and other gases, are sometimes called "casing gas." The natural gas well will have higher production of gas when the level of fluid in the annulus is low. As the fluid in the annulus is lowered, by removing fluid from the well through the process of pumping the well with the pump and the pumping unit described previously, the pressure in the annulus is decreased, thereby allowing more natural gas to flow into the annulus. Said another way, if the level of fluid in the annulus is high, then the rate of gas production will tend to be lower than if the level of fluid in the annulus were lower. This is because, as the fluid fills the annulus, the natural gas is less likely to flow from the formation through the perforations into the annulus of the well to displace the fluid in the well's annulus. In the case of natural gas well, the fluid recovered from the wells tubing may include no oil, or very little oil. The fluid recovered from the tubing may be 95% to 99% water and other fluids. However, even in these cases, the well may be economically operated due to the amount of natural gas being produced. The more oil, water and other fluid pumped by a natural gas well, the more natural gas the well will tend to produce.

In accordance with our method, the microprocessor 10*a* is programmed to control the motor's instantaneous velocity (V) over the course of each stroke cycle as established by a speed map provided by the microprocessor's program. The speed maps are different as determined by the type of pumping unit PU our control device 10 is controlling. Over the course of each stroke cycle initiated each time the "end of stroke" signal is received by the microprocessor 10*a*, the microprocessor's program modulates the frequency and voltage of the variable output AC current at the output 20. This frequency and voltage is modulated as a function of (i) a signal (herein "instantaneous velocity" signal) provided by a motor controller 60 (FIGS. 2A and 2B) of the microprocessor 10*a* and (ii) a calculated or measured chain or crank positions, as the case may be. The drive mechanism's position is calculated according to the equation $$X=K\int_0^{T_o} V dt$$

where

X=instantaneous chain position for long-stroke pumping units based on percent of cycle (0 to 100%);
instantaneous crank position for beam pumping units based on percent of cycle (0 to 100%), V=instantaneous motor speed (revolutions per minute), K=scaling constant, $T_o$=time at which the "end of stroke" signal is received.

By rapidly increasing and decreasing the motor's instantaneous velocity, yet maintaining the average motor speed set by the well manager unit WM, the yield of fluid from many wells may be increased without damage to the pumping unit. Increases in yield vary depending on the type of well, pumping unit, and other factors, but increases have been substantially from 10% to 50% percent. It is important that the speed of the motor M be carefully controlled to avoid damage to the rod R or other components of the pumping unit PU, especially during the transition between the downstroke and upstroke and the transition between the upstroke and downstroke. In general for long-stroke pumping units, at the start of the upstroke, the motor's speed is increased, then at about ⅔ through the upstroke portion of the cycle, the motor's speed is decreased until the transition between the upstroke and downstroke occurs. After this first transition, the motor speed is increased until the transition between the downstroke and upstroke occurs. For example, when the well manager unit WM indicates the chamber 18 is set to be filled to approximately 85% capacity (FIG. 4B), the "speed" signal will indicate increasing the average speed if the chamber 18 is actually filled to 100% capacity as shown in FIG. 4A and will indicate decreasing the average speed if the chamber is actually filled to less than 85% capacity as shown in FIG. 4C. When the well manager unit WM indicates that the chamber 18 is at approximately 85% capacity as shown in FIG. 4B, the "speed" signal indicates that the average speed should remain the same under the present well conditions.

The microprocessor's operation for the long-stroke pumping unit 100 and for the beam pumping unit 200 are as follows:

Long-Stroke Pumping Unit

The microprocessor 10*a* for a long-stroke pumping unit, as depicted FIG. 2A, includes a speed control circuit SCC and a tension control circuit TCC. The speed control circuit SCC includes the integrator 50, a comparator 52, a position/speed map 54, a multiplier 56, an adder 58, and the motor controller 60. The comparator 52 has an input 52*c* connected to an output 50*c* of the integrator 50, an output 52*a* connected to an input 54*a* of the position/speed map 54, and an output 52*b* connected to an input 60*b* of the motor controller 60. The position/speed map 54 has an output 54*b* connected to an input 56*a* of the multiplier 56, which has an output connected to an input 58*a* of the adder 58. An output of the adder 58 is connected to an input 60*a* of the motor controller 60, and the adder 58 applies a "scaled instantaneous speed reference" signal to the input 60*a* of the motor controller 60.

In this embodiment an optional tension control circuit TCC may be used, but is not required. The tension control circuit TCC includes a position/tension map 70 and a proportional integral derivative (PID) loop controller 72 having an input 72*a* at which the "tension" signal from the sensor S2 is applied. The position/tension map 70 has an input 70*a* connected to an output 50*c* of the integrator 50 and an output 70*b* connected to an input 72*b* of the integral derivative loop controller 72. The PID loop controller 72 has an output 72*c* connected to an input 58*a* of the adder 58. The signal at the input 60*a* of the motor controller 60 from adder 58 is thus a function of both the tension in the rod R and the calculated or measured position of the chain in the case of long-stroke pumping units and the crank in the case of beam pump units based on the instantaneous velocity of the motor M over the course of a single stroke.

The motor controller 60 is a component of the regenerative variable frequency AC drive unit RDU that interacts with other components of the regenerative variable frequency AC drive unit RDU to govern the frequency and voltage of the AC current at the regenerative drive unit's output 20. In response to the signals at the motor controller's inputs 60*a* and 60*b* (and other pre-established parameters of the regenerative variable frequency AC drive unit RDU), the instantaneous velocity (V) of the motor M is increased and decreased over the course of each stroke cycle in accordance with a "speed map" that is determined by the "instantaneous velocity" signal applied to the input 50*a* of the integrator 50 and initiated upon applying to the input 50*b* of the integrator the "end of stroke" signal from the sensor S1. The "instantaneous velocity" signal applied to the input 50*a* of the integrator 50 indicates the actual instantaneous motor velocity (V).

Upon the "end of stroke" signal being applied to the input 50*b* of the integrator 50, the integrator 50 starts calculating the drive mechanism's position X. At the same time, the "speed" signal from the well manager unit WM is applied to the multiplier's input 56*a*. When microprocessor's integrator 50 calculates that the stroke cycle has reached 100%, another "end of stroke" signal should be applied to the input 50*b* of the integrator 50 to indicate that another individual stroke cycle is about to begin. This again initiates the operation of the integrator 50, which once again recalculates the drive mechanism's position X over the course of the next individual stroke cycle. In other words, each time the "end of stroke" signal is applied to the input 50*b*, a speed map is generated for that individual stroke cycle. Failure to receive an end of the stroke signal by the time the integrator 50 calculates that 100% of the stroke cycle has been completed, results in the comparator 52 discontinuing signaling the position/speed map 54 and applying via the output 52*b* a "low speed" signal that indicates to the motor controller 60 to operate the motor at a constant safe speed that avoids damage to the pumping unit PU. The pumping unit PU is maintained at this constant safe low speed until an "end of stroke" signal is again applied to the input 50*b* of integrator 50. Thus, the microprocessor 10*a* is programmed to operate the motor M at a predetermined minimum safe speed whenever the "end of stroke" signal is not received by the time the gearbox GB has completed a known number of revolutions measured in degrees that corresponds to one complete rod stroke cycle.

Figure 5A:
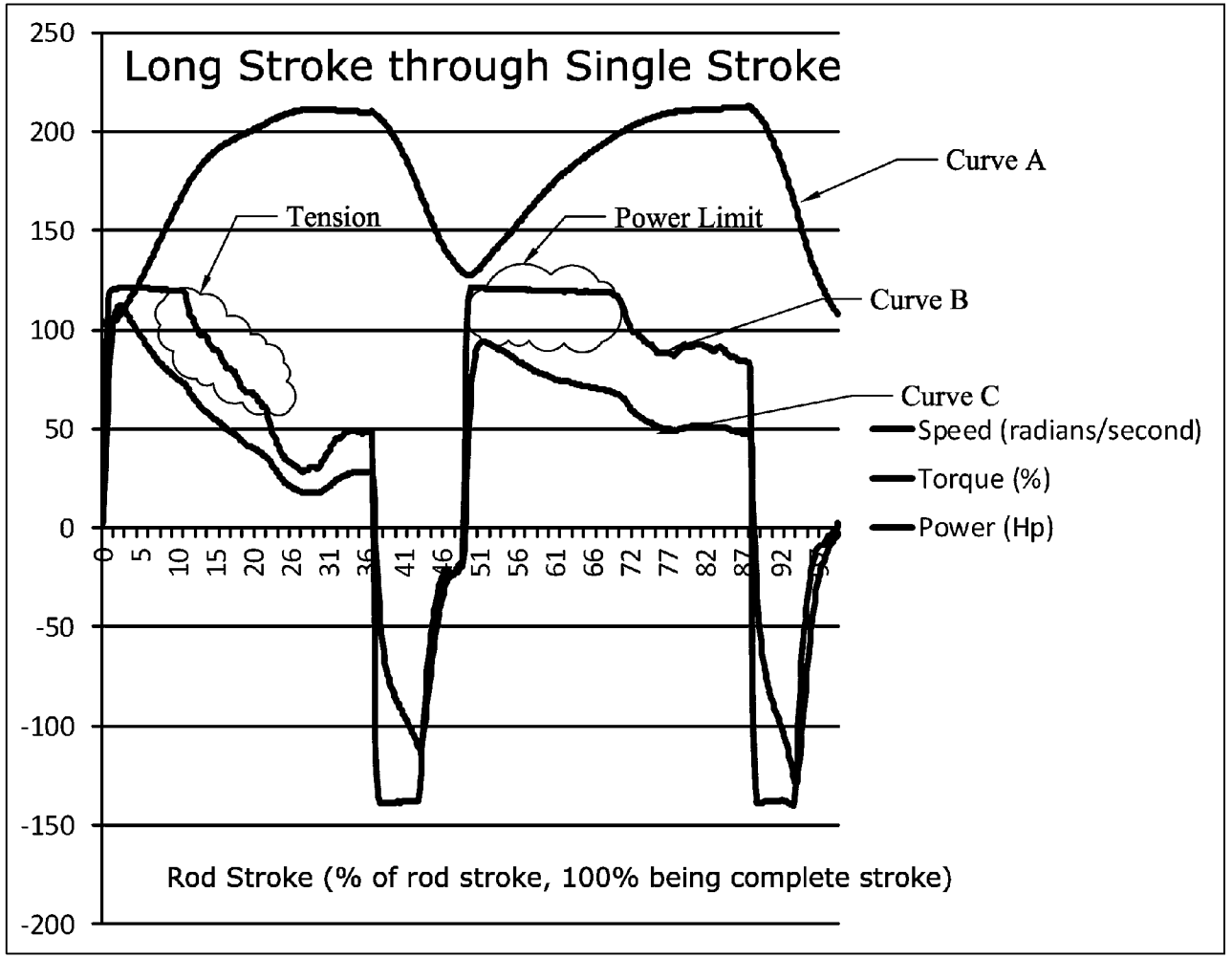
FIG. 5A is a graph showing the instantaneous velocity of the motor for a long-stroke pumping unit over the course of a single stroke.

If the "speed" signal from the well manager unit WM indicates that the average speed of the motor M should remain the same over the course of the stroke cycle, for example, if the well conditions are as shown in FIG. 4B, the instantaneous velocity of the motor will be increased and decreased in a controlled manner as depicted by the Curves A, B and C of FIG. 5A. Curve A shows speed along the Y axis and the drive mechanism's position along the X axis as a percent of the stroke cycle (0% equals beginning of the cycle, 50% the end of the upstroke, and 100% the end of the cycle). Curve A shows that on the upstroke, from about 0% to about 15% of the stroke cycle, the motor's speed rapidly increases. From about 15% to about 40% of the stroke cycle the motor's speed, although still increasing, its rate of increase slows, so that at about 40% of the stroke cycle, the motor decelerates rapidly. This indicates braking of the motor M as the end of the upstroke is reached. At 50% of the cycle, the motor's speed is again rapidly increased on the downstroke from about 50% to about 60% of the stroke cycle. Then from about 60% to about 90% of the stroke cycle the motor's speed, although still increasing, its rate of increase slows, so that at about 90% of the stroke cycle, the motor decelerates rapidly. This indicates braking of the motor M as the end of the downstroke is reached. Curve B shows the output power of the motor M over the course of the stroke cycle, and Curve C shows the motor's torque over the course of the stroke cycle. Curves B and C illustrate that, on initiation of the upstroke, energy is rapidly transferred from the power grid PG to the motor M. Then as braking occurs, the motor acts as a generator and transfers energy to the power grid as indicated by the valleys B' and C', respectively of these curves, dipping below the X axis into the negative energy scale region along the Y axis. This indicates that energy is being transferred to the power grid PG. For as long as the "speed" signal indicates the same average motor speed, the Curves A, B and C will be the same each stroke cycle. If, however, the "speed" signal indicates a change in the average motor speed, the shapes of these curves are altered in accordance with the program of the microprocessor 10*a* for this new average speed.

The tension control circuit TCC is advantageously employed with the long-stroke pumping unit 100. In response to a signal provided at the output 50*c* of the integrator 50 indicating the end of a stroke cycle and the instantaneous velocity of the motor M, the position/tension map 70 calculates the drive mechanism's position over the course of the cycle and provides a corresponding "tension reference map" signal at its output 70*b*. Upon receiving the "tension" signal at its input 72*a* and the "tension reference map" signal at its input 72*b*, the PID loop controller 72 applies a "speed trim reference" signal to the input 58*a* of the adder 58 to modify the "scaled instantaneous speed reference" signal being applied to the input 60*a* of the motor controller 60. Thus, the motor's instantaneous velocity (V) over the course of each stroke cycle is constantly adjusted to optimize fluid production and maximize the operational life of the pumping unit PU, taking into account the actual tension in the rod R over the course of the stroke cycle.

Beam Pumping Unit

The microprocessor 10*a* for the beam pumping unit 200 as depicted FIG. 2B only includes a speed control circuit SCC'. It does not employ a tension control circuit TCC; however, it may employ a suitable tension control circuit TCC modified as required for a beam type pumping unit. The speed control circuit SCC' includes an integrator 50', a comparator 52', a position/speed map 54', a multiplier 56', and the motor controller 60. The comparator 52' has an input 52*c*' connected to an output 50*c*' of the integrator 50', an output 52*a*' connected to an input 54*a*' of the position/speed map 54', and an output 52*b*' connected to an input 60*b*' of the motor controller 60. The speed control circuit SCC' functions in essentially the same way as discussed above in connection with the speed control circuit SCC, except the actual tension in the rod R is not measured or used to modify or "trim" the motor's instantaneous velocity (V).

Figure 5B:
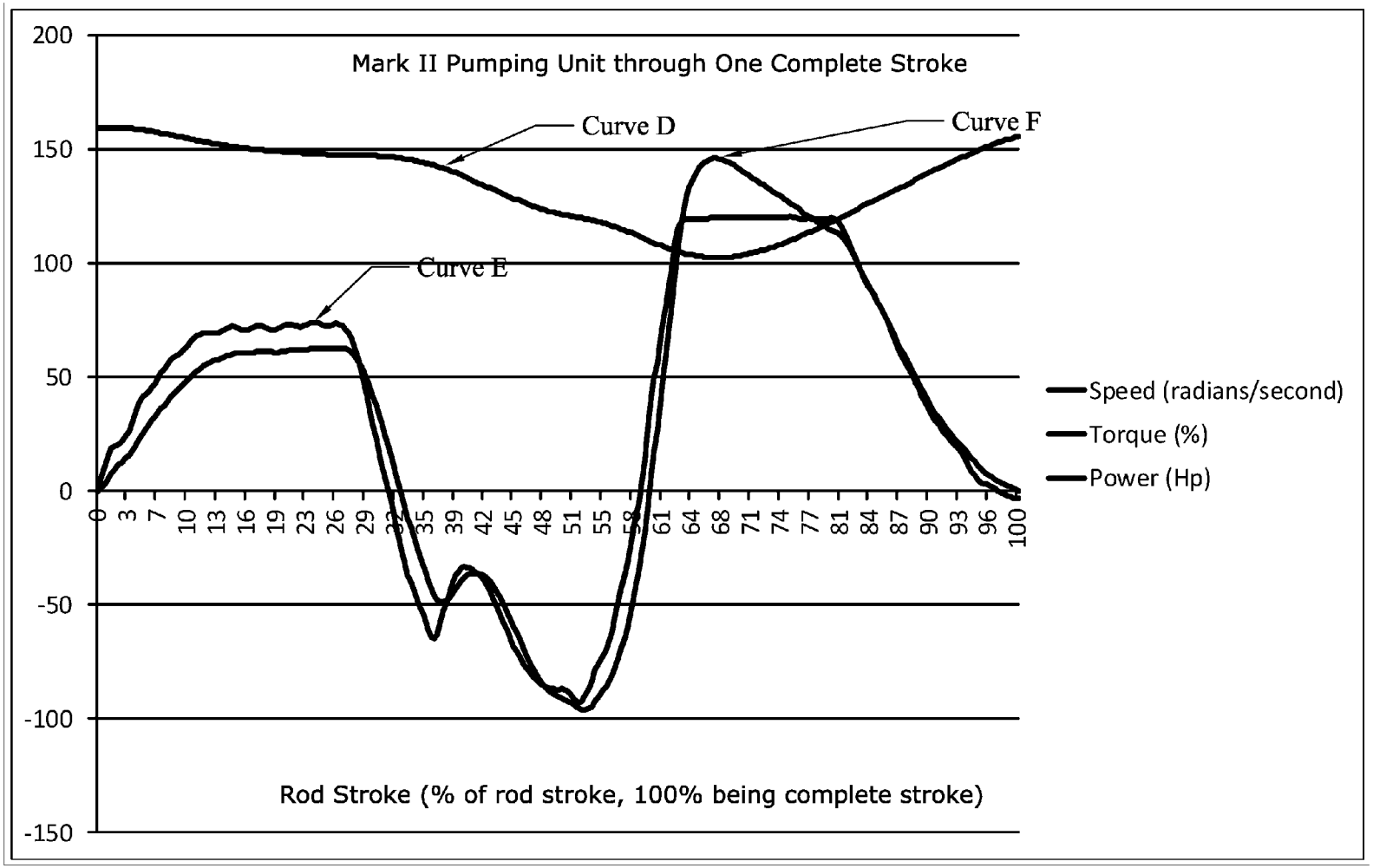
FIG. 5B is a graph showing the instantaneous velocity of the motor for a beam pumping unit over the course of a single stroke.

As shown in FIG. 5B, the instantaneous velocity (V) is controlled in a different fashion for the beam pumping unit 200 than the long-stroke pumping unit 100. If the "speed" signal from the well manager unit WM indicates that the average speed of the motor M over the course of the stroke cycle should remain the same, for example, if the well conditions are as shown in FIG. 4B, the instantaneous velocity of the motor will be increased and decreased in a controlled manner as depicted by the Curves D, E and F of FIG. 5B. Curve E shows the output power of the motor M over the course of the stroke cycle, and Curve F shows the motor's torque over the course of the stroke cycle. Curve D for a beam pumping unit shows speed along the Y axis and the drive mechanism position along the X axis as a percent of the stroke cycle (0% equals beginning of the cycle, 50% the end of the upstroke, and 100% the end of the cycle). Curve D is very different than speed Curve A for the long-stroke pumping unit 100. In the case of the beam pumping unit 200 the instantaneous velocity (V) is at its highest instantaneous velocity at the initiation of the upstroke (0% of the stroke cycle) and gradually decreases to its slowest instantaneous velocity at about 60% of the stroke cycle. The motor's instantaneous velocity (V) then gradually increases to again attain its highest instantaneous velocity (V) at 100% of the cycle.

Curves E and F illustrate that, on initiation of the upstroke, energy is rapidly transferred from the power grid PG to the motor M as the stroke cycle proceeds between 0% and about 10% of the cycle. Then there is a leveling off of energy transfer from the power grid PG to the motor M between about 10% and about 30% of the cycle. The declining slop of the Curves E and F between about 30% and about 50% of the cycle, dipping below the X axis into the negative energy scale region along the Y axis, indicates that braking occurs and the motor M acts as a generator and transfers energy to the power grid PG. With the rod R reversing its direction of movement at 50% of the cycle, energy is again rapidly transferred from the power grid PG to the motor M. For as long as the "speed" signal indicates the same average motor speed, the Curves D, E and F will be the same each stroke cycle. If, however, the "speed" signal indicates a change in the average motor speed, the shapes of these curves are altered in accordance with the program of the microprocessor 10*a* for this new average speed.

Circuit Design

Figure 6B:
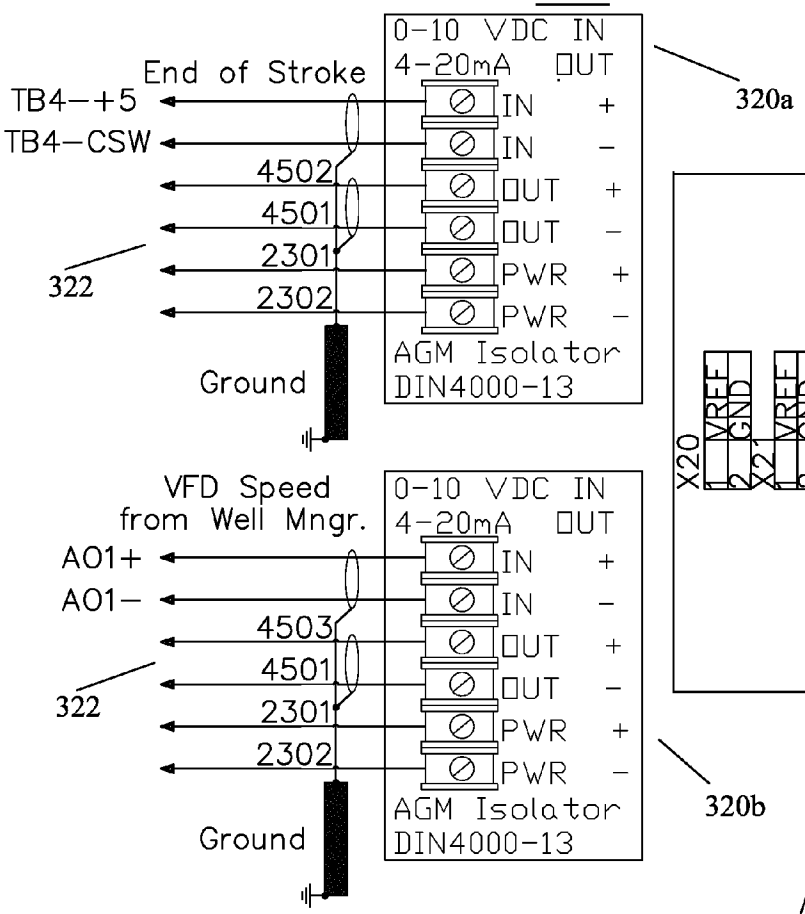
FIGS. 6A, 6B and 6C taken together represent a simplified wiring diagram of the control circuit for our control device.
Figure 6A:
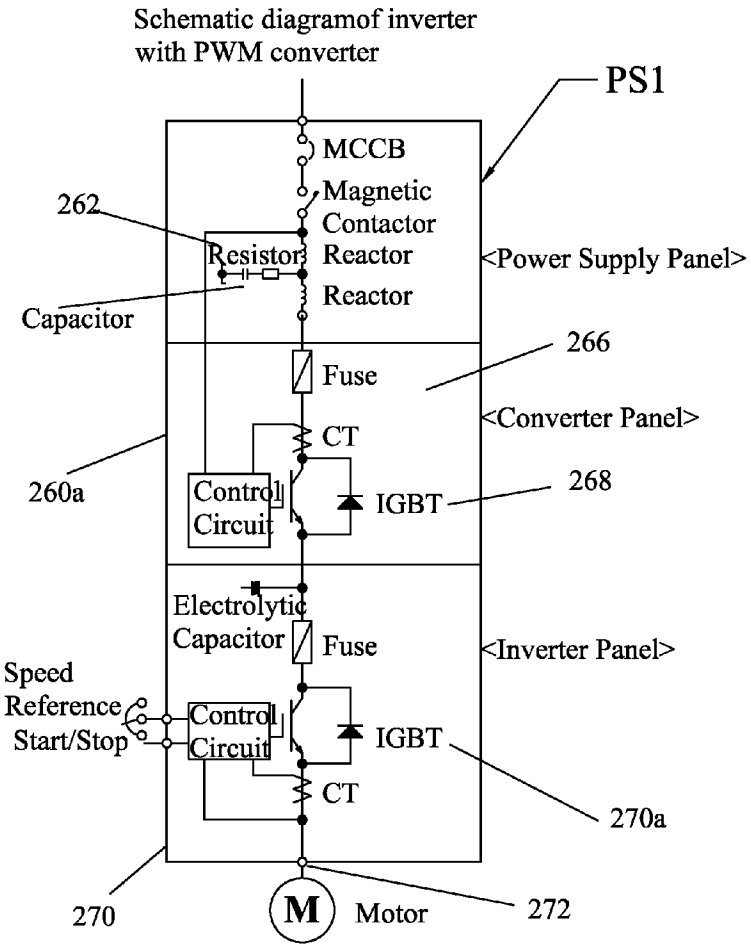

As depicted in FIGS. 1 and 6A through 6B, a control circuit 260 (FIG. 6C) controls the operation of our control device 10. As shown in FIG. 6A, the regenerative variable frequency AC drive unit RDU includes a sub-circuit 260*a* that reduces low order harmonic current drawn from the power grid PG. This sub-circuit 260*a* controls the waveform of the input AC voltage and current to provide the sinusoidal waveforms illustrated in FIG. 7. The sub-circuit 260*a* has an inductive and capacitive filter 262 that reduces voltage distortion caused by switching of a converter circuit 266 directly to the input AC current. Some AC drives use a line converter employing diodes to form a line side bridge rectifier. The use of diodes in the line side rectifier results in current flow that is not uniform and characterized as non-linear. This non-linear current is composed of a fundamental component and harmonic components. Allowable levels of harmonic distortion are set forth in the IEEE Std 519-1992 (Jun. 15, 2004) publication. This is the established American National Standard (ANSI).

Figure 7:
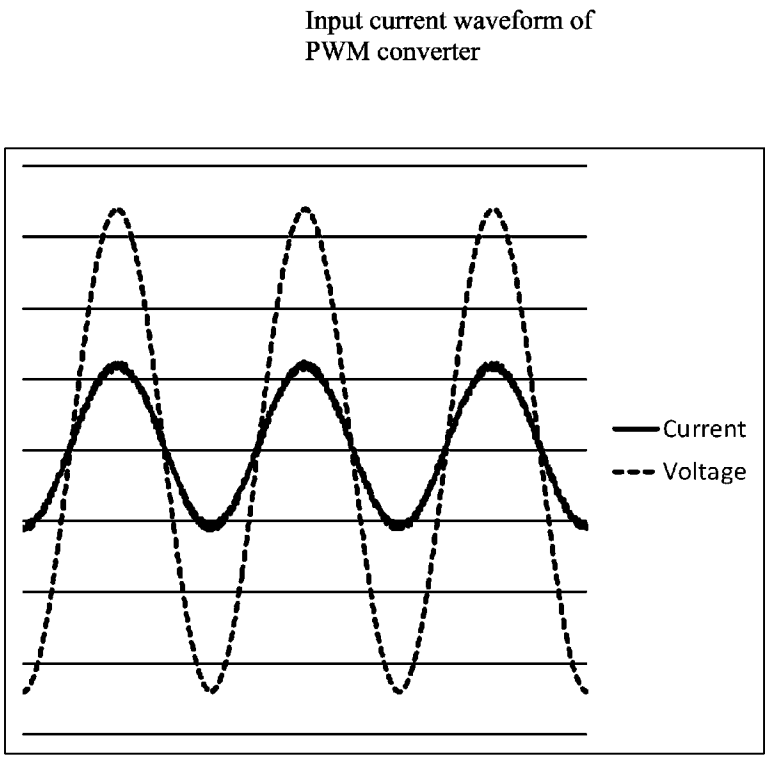
FIG. 7 is graph depicting input current and voltage waveforms.

The regenerative variable frequency AC drive unit RDU equipped with the sub-circuit 260*a* is advantageously used to allow the power grid to meet the established IEEE 519-1992 Standard. The sub-circuit 260*a* has a DC power supply circuit PS1 connected to the low LCL filter 262. The output of the power supply circuit PSI is connected to the converter circuit 266 employing high speed IGBT type transistors 268. The converter circuit 266 has its output connected to an inverter circuit 270 that also employs high speed IGBT type transistors 270*a*. The inverter circuit 270 has its output 272 connected to the motor M. The transistors 268*a* and 270*a* are switched on and off in such a manner that results in current flow and voltage that is nearly sinusoidal as shown in FIG. 7. The result is exceptionally low line harmonic content that is advantageously used to allow the power grid to comply with the IEEE 519-1992 standard. Thus, our control device 10 does not require isolation transformers, phase shifting isolation transformers, or an additional external input filter for harmonic mitigation.

The converter IGBT transistors 268 are controlled in such a way as to maintain a constant DC voltage level in the electrolytic capacitors shown in the inverter panel 270. The DC voltage controller (not shown) implemented in the converter is extremely responsive, stable and dynamic. As the inverter 270 controls the motor in such a way as to supply power to the AC Motor in a "motoring" mode, the DC voltage level measured on the electrolytic capacitors will tend to drop. As the DC voltage level measured on the electrolytic capacitors begins to drop, the DC Voltage level controller functioning in the converter 266 will automatically switch the converter high speed IGBT type transistors 268 to allow power to flow from the power grid into the converter 266, thereby maintaining the DC voltage level measured in the electrolytic capacitors at the DC voltage set-point. Conversely, as the inverter 270 controls the AC motor M in such a way as to consume power from the AC motor in a "braking" mode, the DC voltage level measured on the electrolytic capacitors will tend to increase. As the DC voltage level measured on the electrolytic capacitors begins to increase, the DC voltage controller functioning in the converter 266 will automatically switch the converter high speed IGBT type transistors 268 to allow power to flow to the power grid from the converter 266, thereby maintaining the DC voltage level measured in the electrolytic capacitors at the DC voltage set-point. It is because of the DC voltage controller in the converter that the regenerative variable frequency AC drive unit RDU is capable of operation in both motoring modes and braking modes in a reliable, seamless, stable and dynamic manner.

Figure 6C:
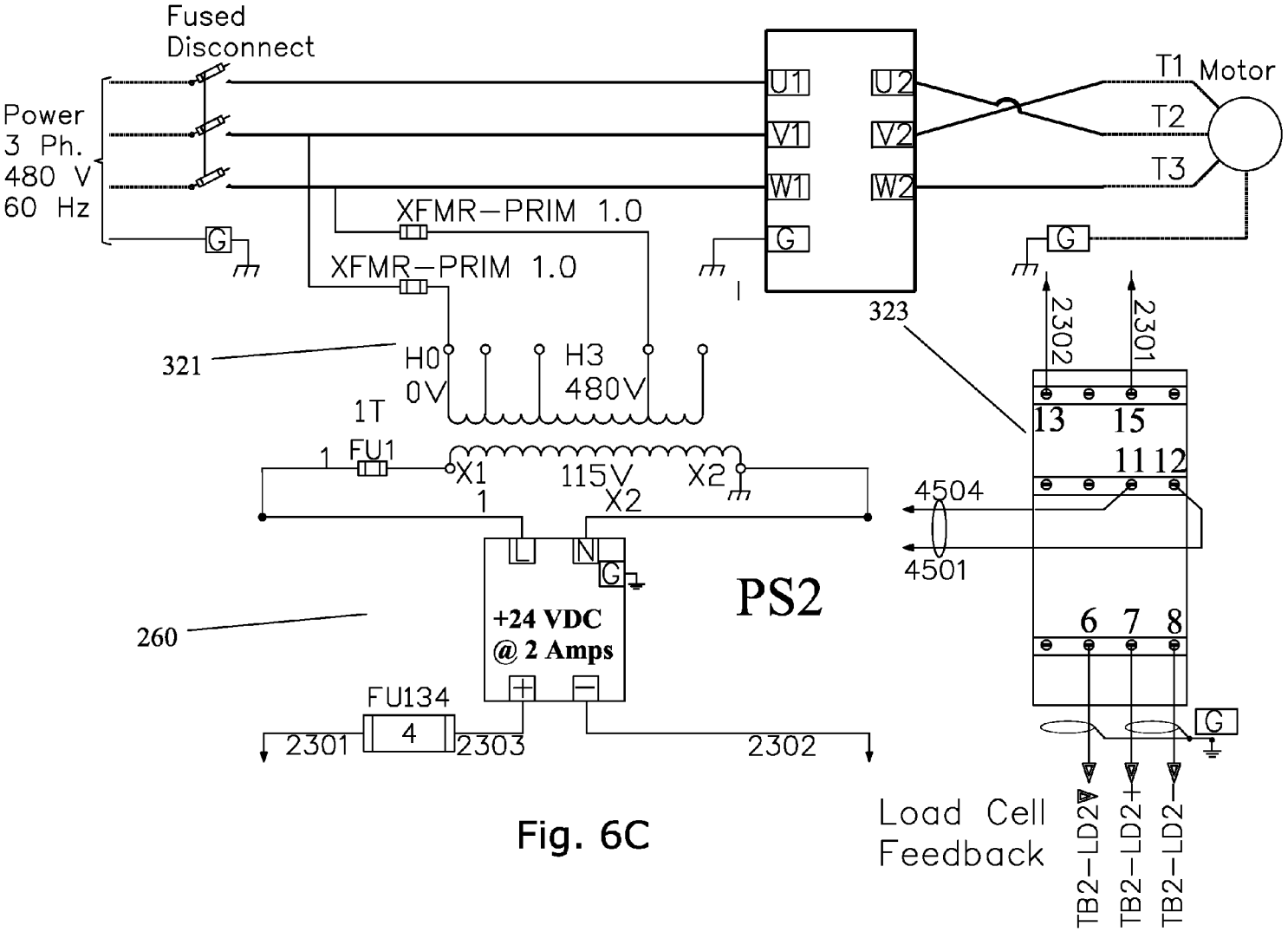

As shown in FIGS. 6A, 6B and 6C, the control circuit 260 includes a pair of isolators 320*a* and 320*b* (FIG. 6B) that suppresses noise, a DC power supply PS2 for the isolators coupled to a transformer 321 connected between the power grid PG through fused lines L1, L2 and L3 connected to the Regenerative variable frequency AC drive unit RDU, and an amplifier 323 for the tension signal. The isolators 320*a* and 320*b* are, respectively, in communication with the end of stroke signal and the speed signal provided by the well manager WM. The outputs 322 of the isolators 320*a* and 320*b* are connected to terminals 324*a* (FIG. 6C) of the microprocessor 10*a* as indicated by the identifying numerals 4501, 4502 and 4503.

The Appendices set forth programs for optimization of fluid production and maximizing the operational life of the pumping units discussed above, and the manuals used to program the microprocessor 10*a*. In accordance with conventional practices the programs called for in Appendices are installed in the microprocessor 10*a*. Appendix 1 lists the parameters for the long-stroke pumping unit 100 that has not been enabled to compensate for tension and uses the ABB OY DRIVE designated as ACS800-U11-0120-5. Appendix 2 lists the parameters for the long-stroke pumping unit 100 that has been enabled to compensate for tension and uses the ABB OY DRIVE designated as ACS800-U11-0120-5. Appendix 3 lists the parameters for the beam pumping unit 200 and uses the ABB OY DRIVE designated as ACS800-U11-0120-5. The programs enable the microprocessor 10*a*, through the control circuit 260, to drive the electrical motor M over the course of each stroke cycle at the same or different speeds as a function of calculated or measured chain position as it applies to a long-stroke pumping units, crank (gear box output) position as it applies to a beam-pump pumping units, decreasing the motor speed by transferring electrical energy to the power grid and increasing the motor speed by transferring electrical energy from the power grid to the motor. In the Appendices 1, 2 and 3 under the heading Parameters, 84: ADAPTIVE PROGRAM and Parameters, 85: USER CONSTANTS lists are provided of the required parameters for varying speed in accordance with our method, indicating how to program the microprocessor 10*a* for pumping units 100 and 200 discussed above.

The Appendices 5, 6 and 7 are different than Appendices 1 through 3, and the code in these appendices was generated using the manual of Appendix 8, i.e., the manual for the ABB OY DRIVE designated as ACS800-U11-0120-5+N682. The more recent versions of the ABB OY regenerative variable frequency AC drive designated ACS800-U11-0120-5+N682 has greater programming capacity. As depicted in FIG. 19, the programming flow diagram illustrates the manner in which this ACS800-U11-0120-5+N682 is programmed by following the instructions in the revised manual of Appendix 8 to generate a revise code according to the Appendices 5, 6, and 7. In the Appendices 5, 6 and 7 under the heading Parameters 55 through 60: ADAPTIVE PROGRAM and Parameters, 37 and 53: USER CONSTANTS lists are provided of the required parameters for varying speed in accordance with our method, indicating how to program the microprocessor 10*a* for pumping units 100 and 200 discussed above.

Position vs. Speed Map

Our device and method rely on reasonably accurate, reliable and consistent position information, either measured or calculated, and use this information in a unique way to operate a regenerative AC motor control drive. Our device does not determine rod position directly, and it is not necessary to do so. Rather motor revolutions that correlate to rod position are determined. In one embodiment our device calculates motor revolutions. In another embodiment our device measures motor revolutions directly.

The number of revolutions of the motor that are required to make one complete stroke of the rod is a fixed number. This number of motor revolutions is a, function of the mechanical system used in the pumping process. This includes power transmission, geometry of the pumping and the type of the pumping unit. This mechanical system does not change during the normal pumping process. Any change to the mechanical system that changes the relationship of motor revolutions to rod position requires the intervention of a mechanic and/or engineer. If the mechanical system is changed then our device, and its software, will require programming changes.

Our device takes advantage of the fact that one complete stroke of the rod requires a fixed number of motor revolutions, regardless of the type of pumping unit and its associated power transmission. In one embodiment of our device during initial start-up its software is programmed in such a way that the number of motor revolutions to complete one stroke of the rod is internally scaled to 360°. This is best explained by means of an example. For instance, a given pumping unit may require 226.23 revolutions of the motor to complete one rod stroke. Internally the software calculates instantaneous position. This method can be used if this type of feedback is available. Considering mathematically the example, this method can be represented as follows:

$$X=K\int_0^{T_o} V dt$$

where X=instantaneous chain position for long-stroke pumping units based on percent of cycle (0 to 100%);

instantaneous crank position for beam pumping units based on percent of cycle (0 to 100%)

V=instantaneous motor speed (revolutions per minute)

K=scaling constant, $T_o$=time at which "end of stroke" signal is received.

Tuning of the Speed Loop

Figure 18:
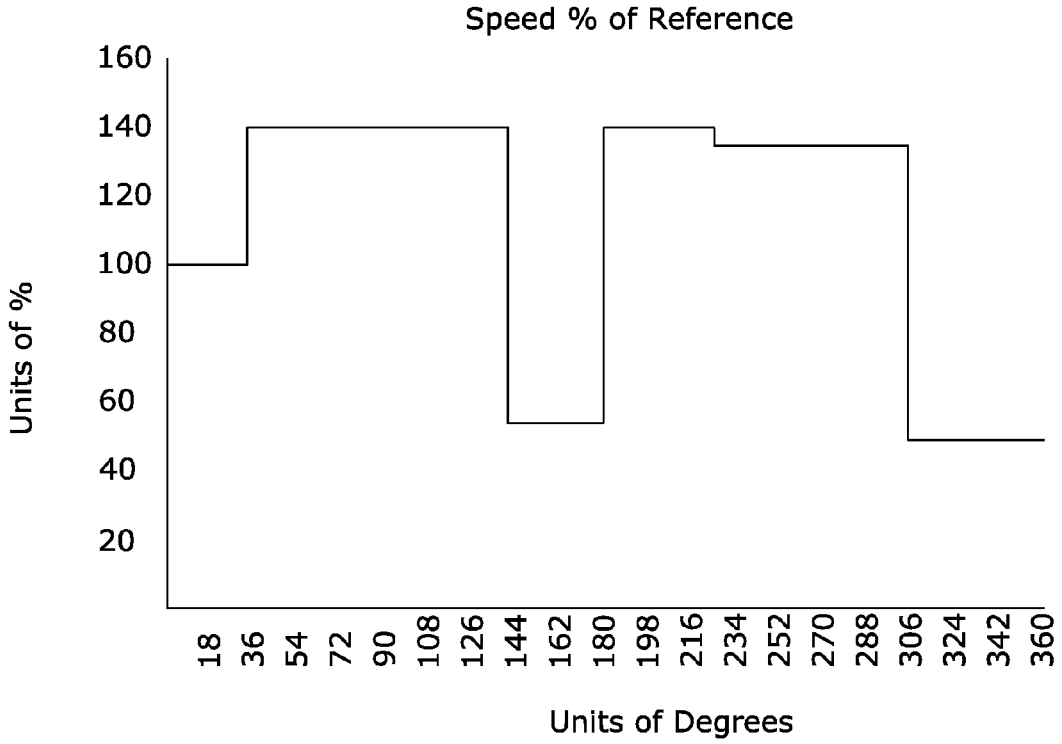
FIG. 18 is a speed map depicting how a speed reference changes based on position.
Figure 19A:
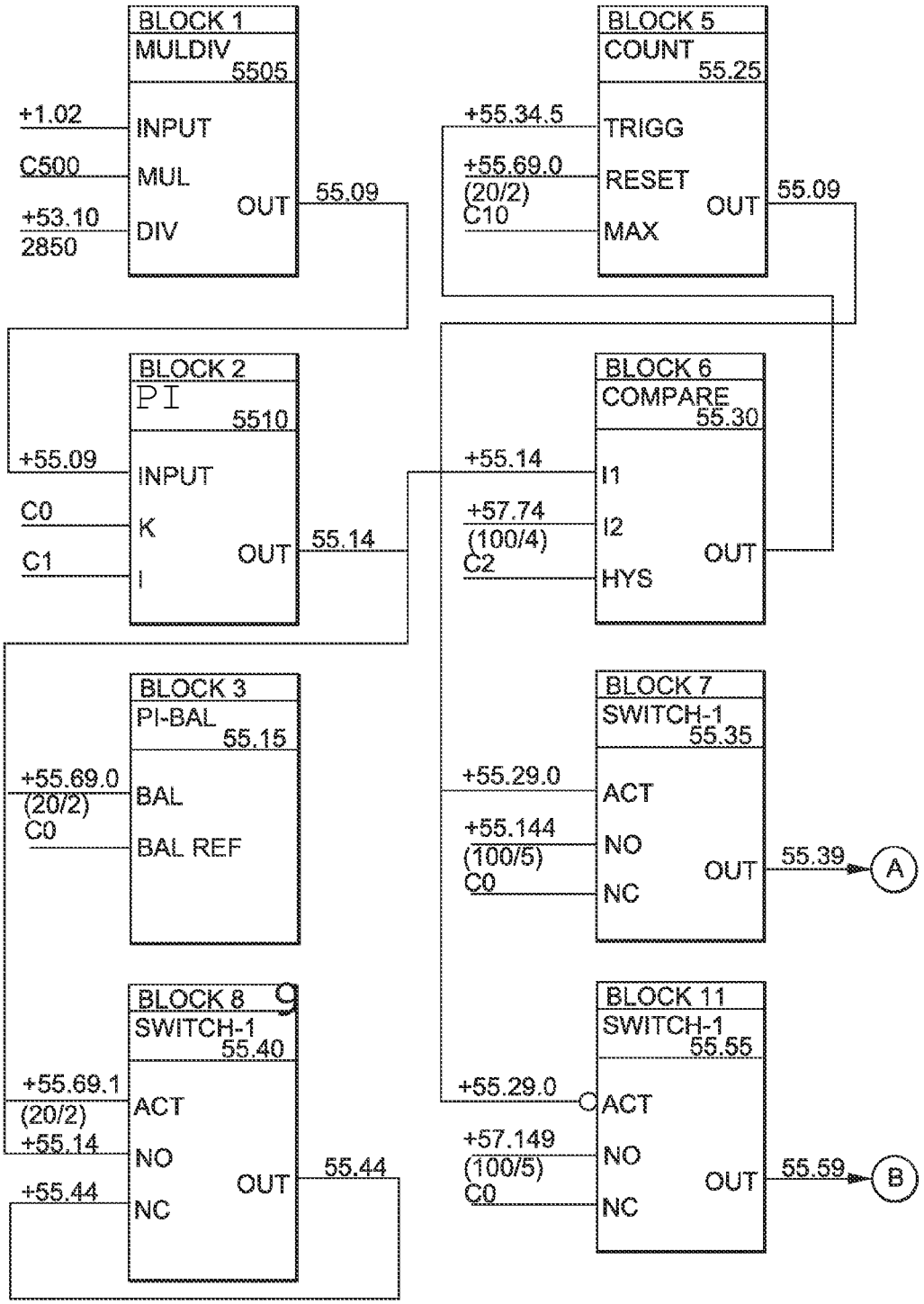
FIGS. 19A through 19V is a series of block diagrams depicting how the microprocessor is programmed.
Figure 19B:
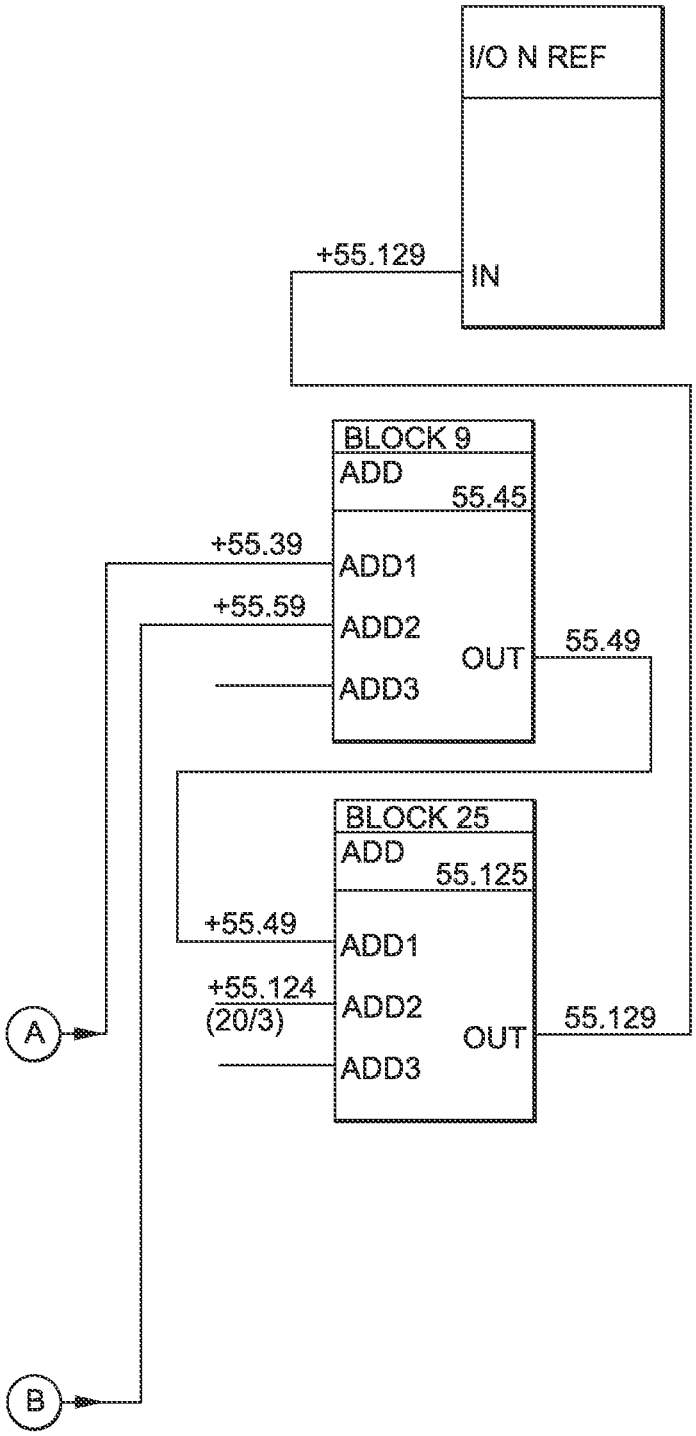
Figure 19C:
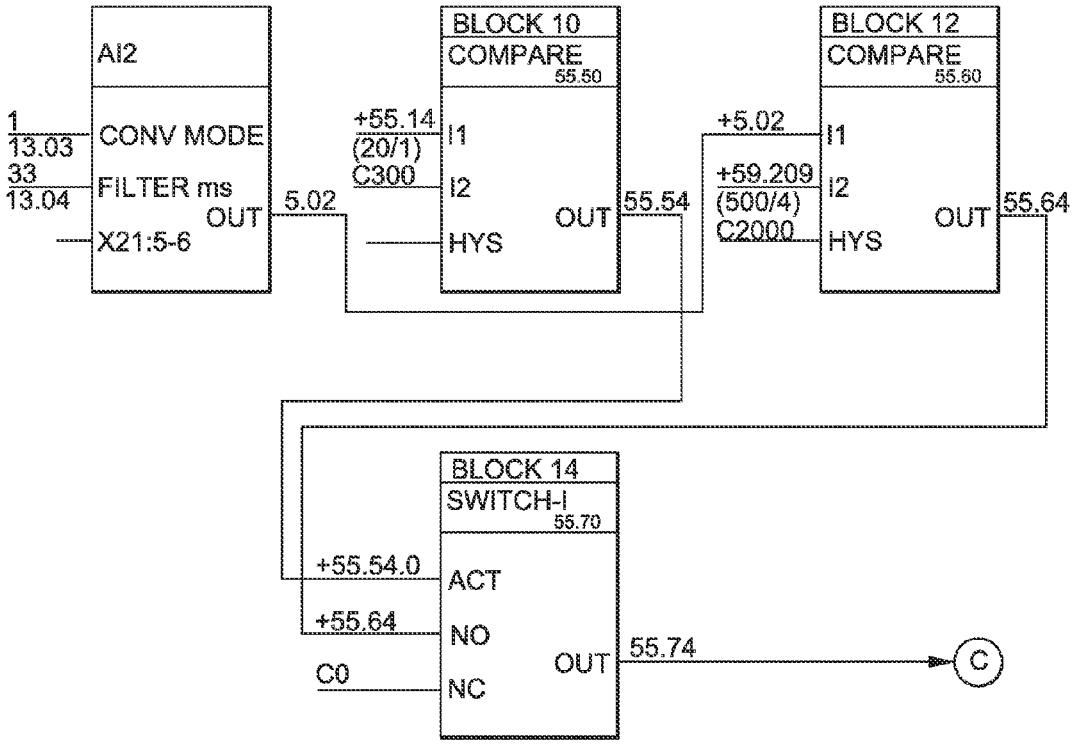
Figure 19D:
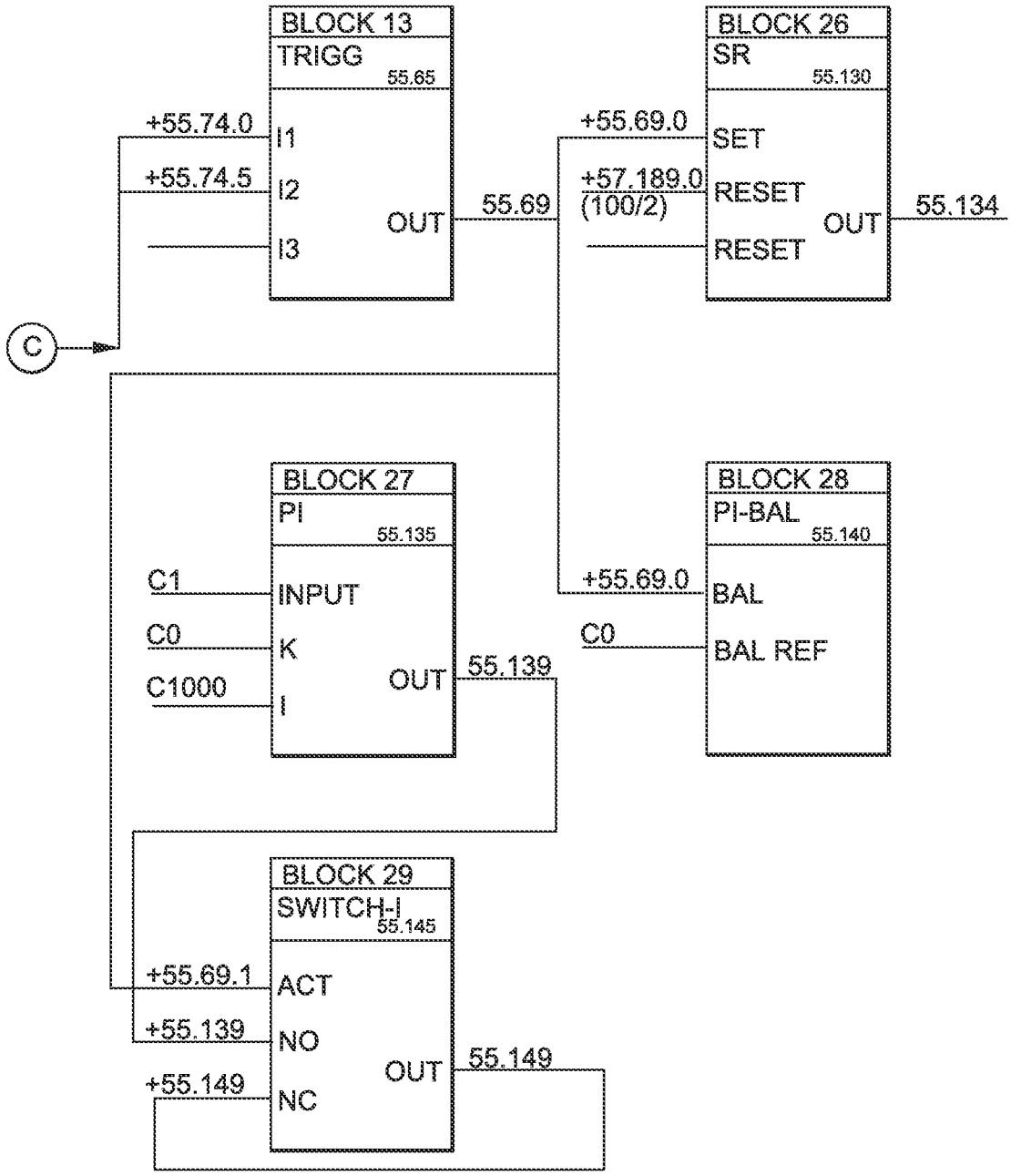
Figure 19E:
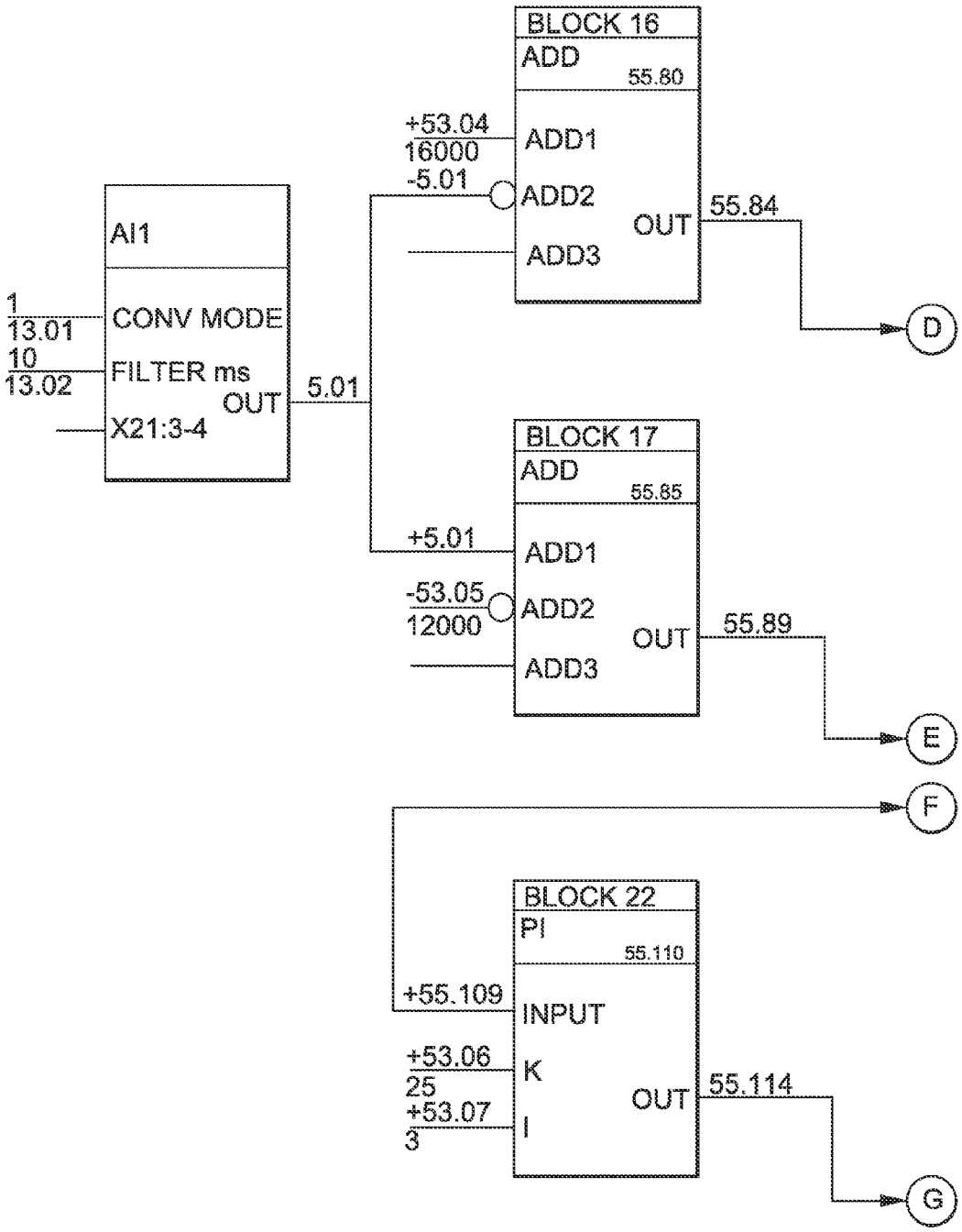
Figure 19F:
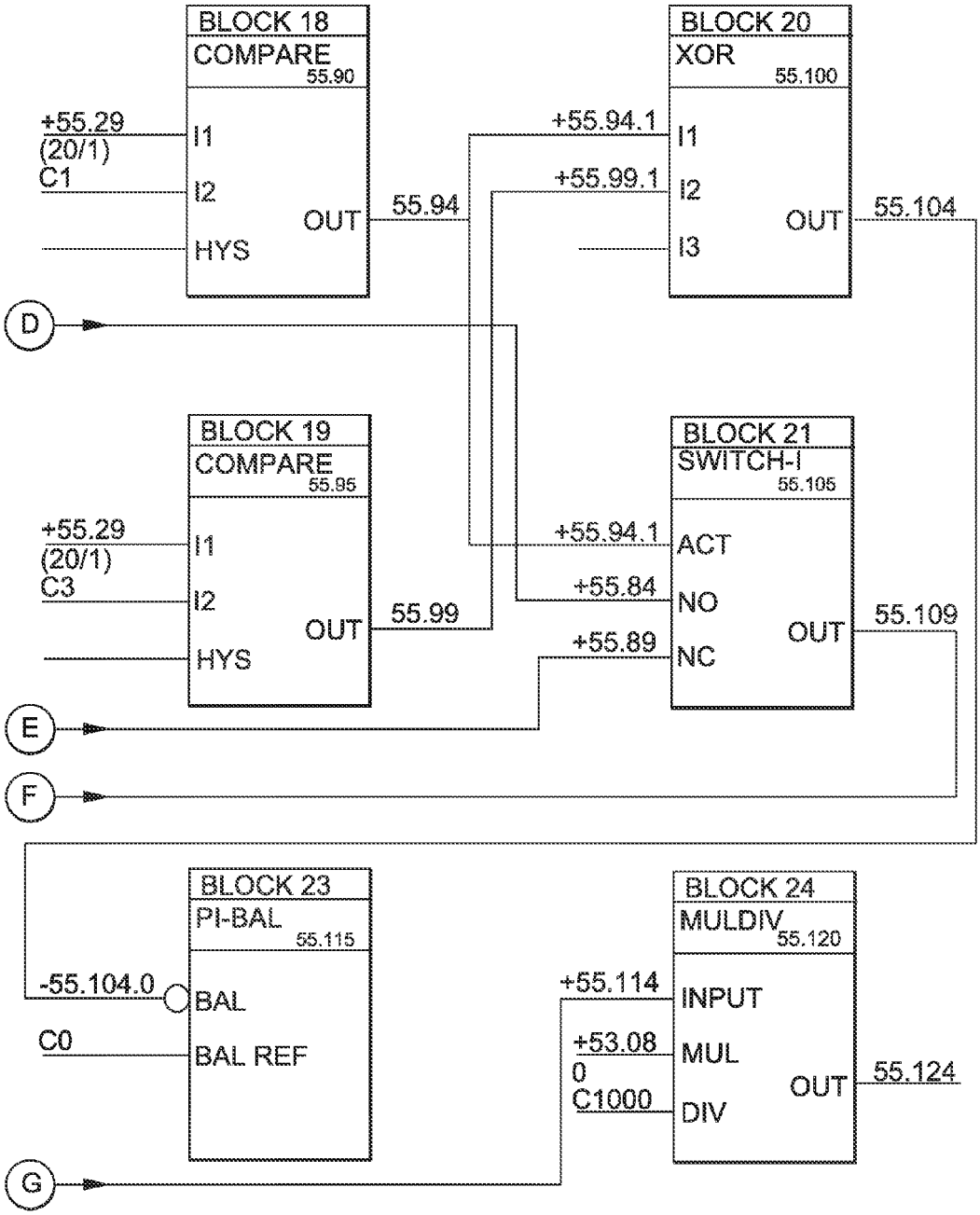
Figure 19G:
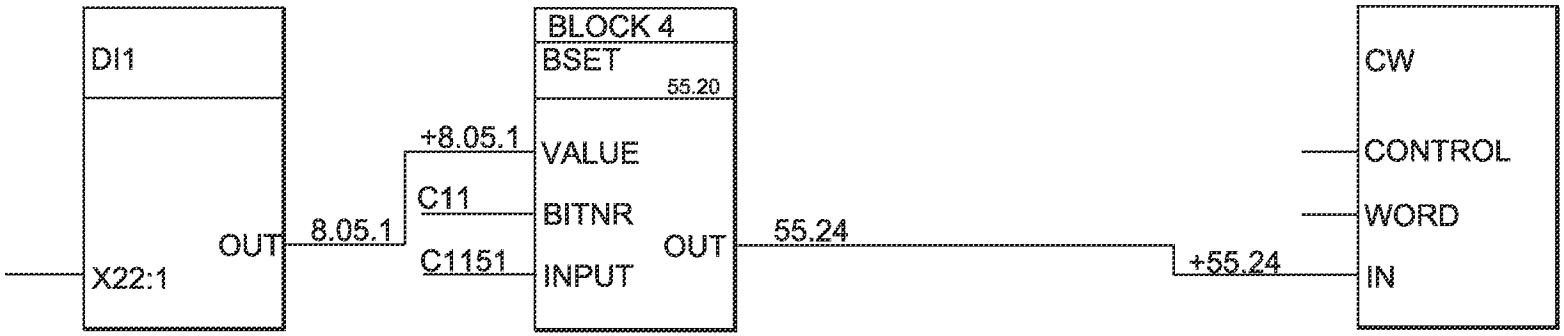
Figure 19H:
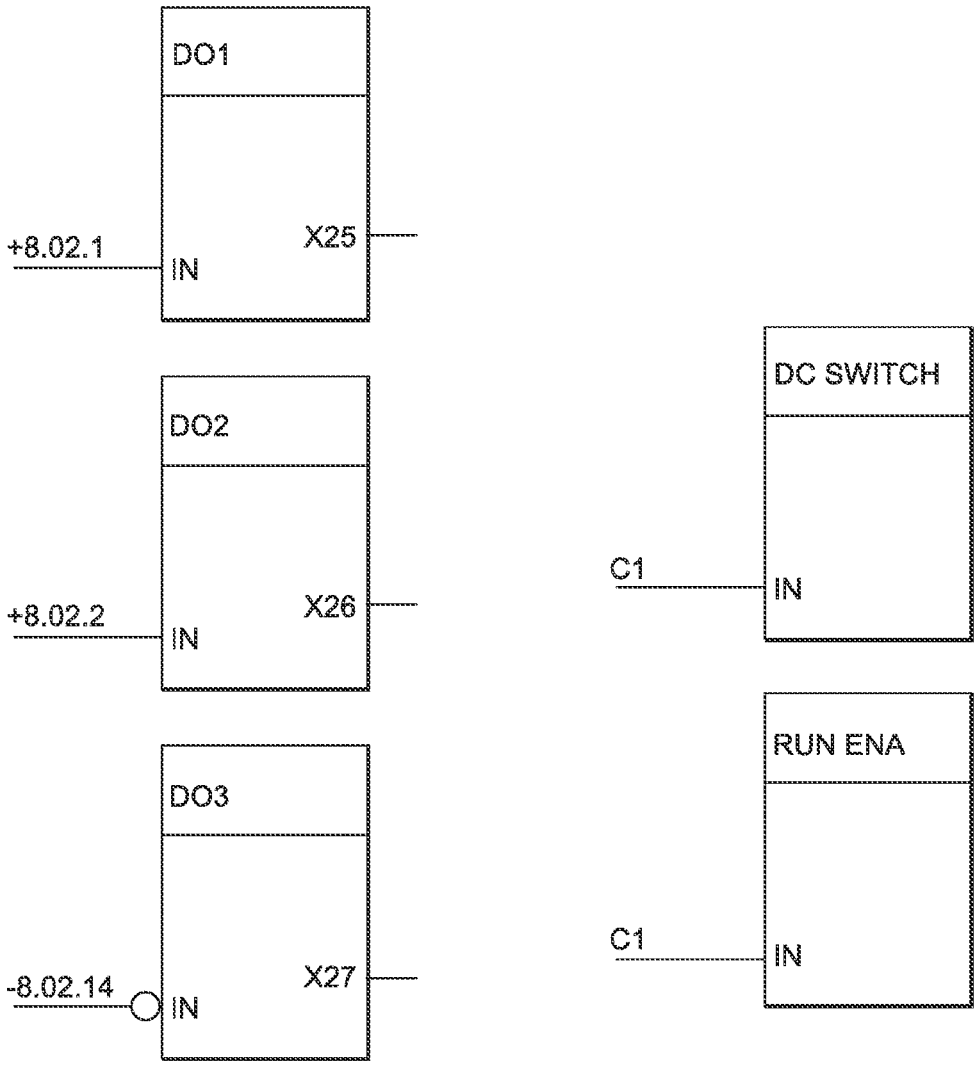
Figure 19I:
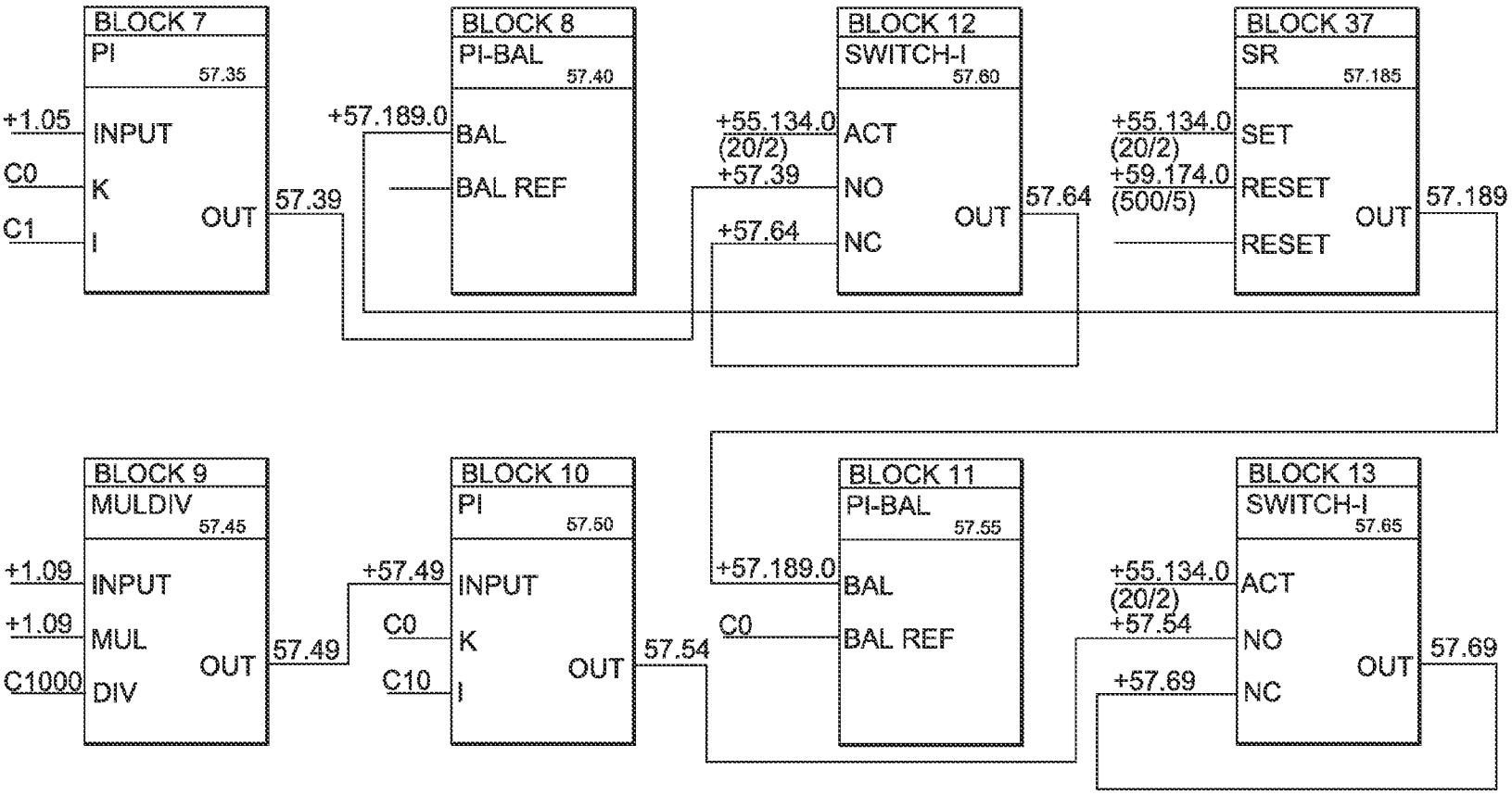
Figure 19J:
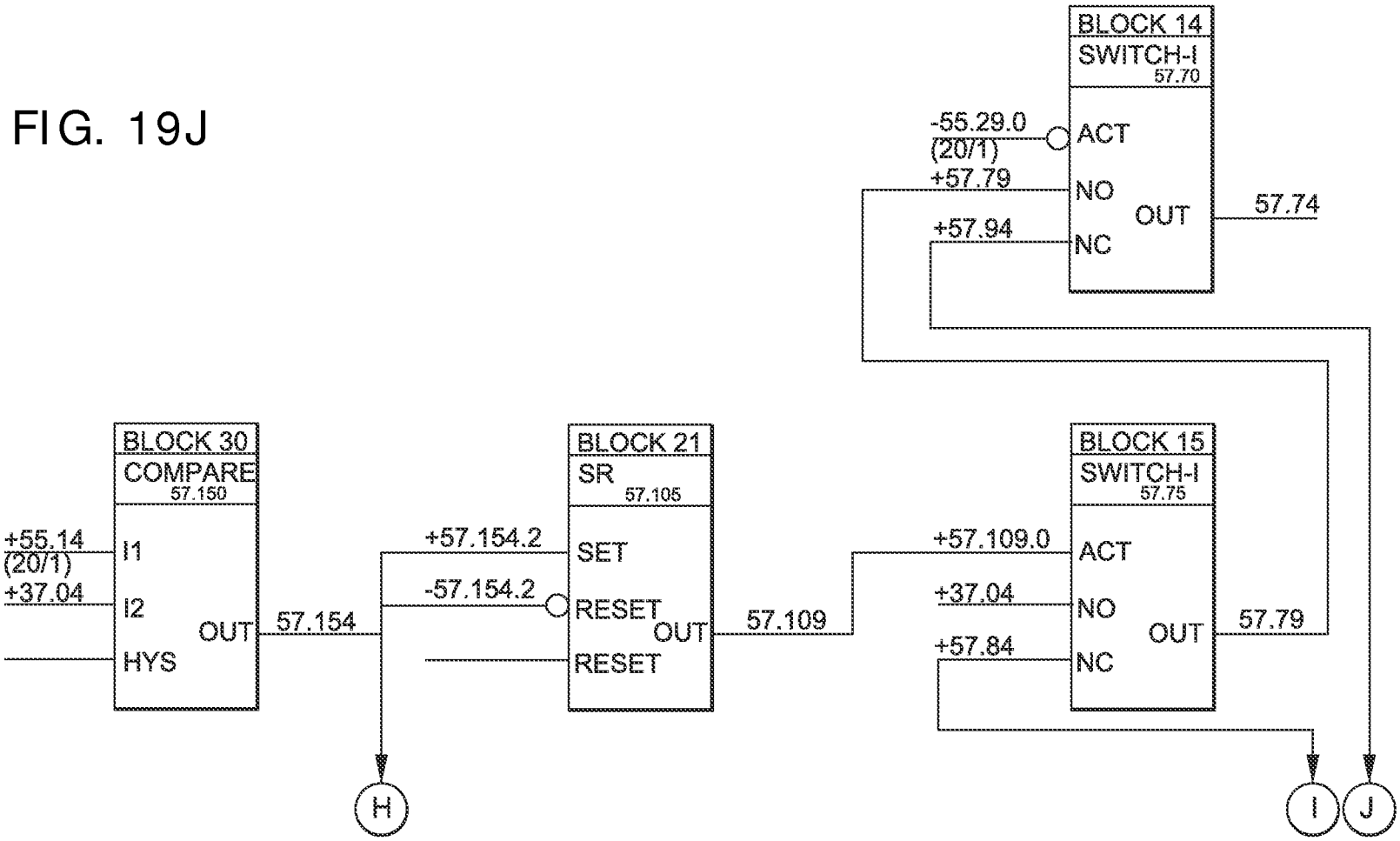
Figure 19K:
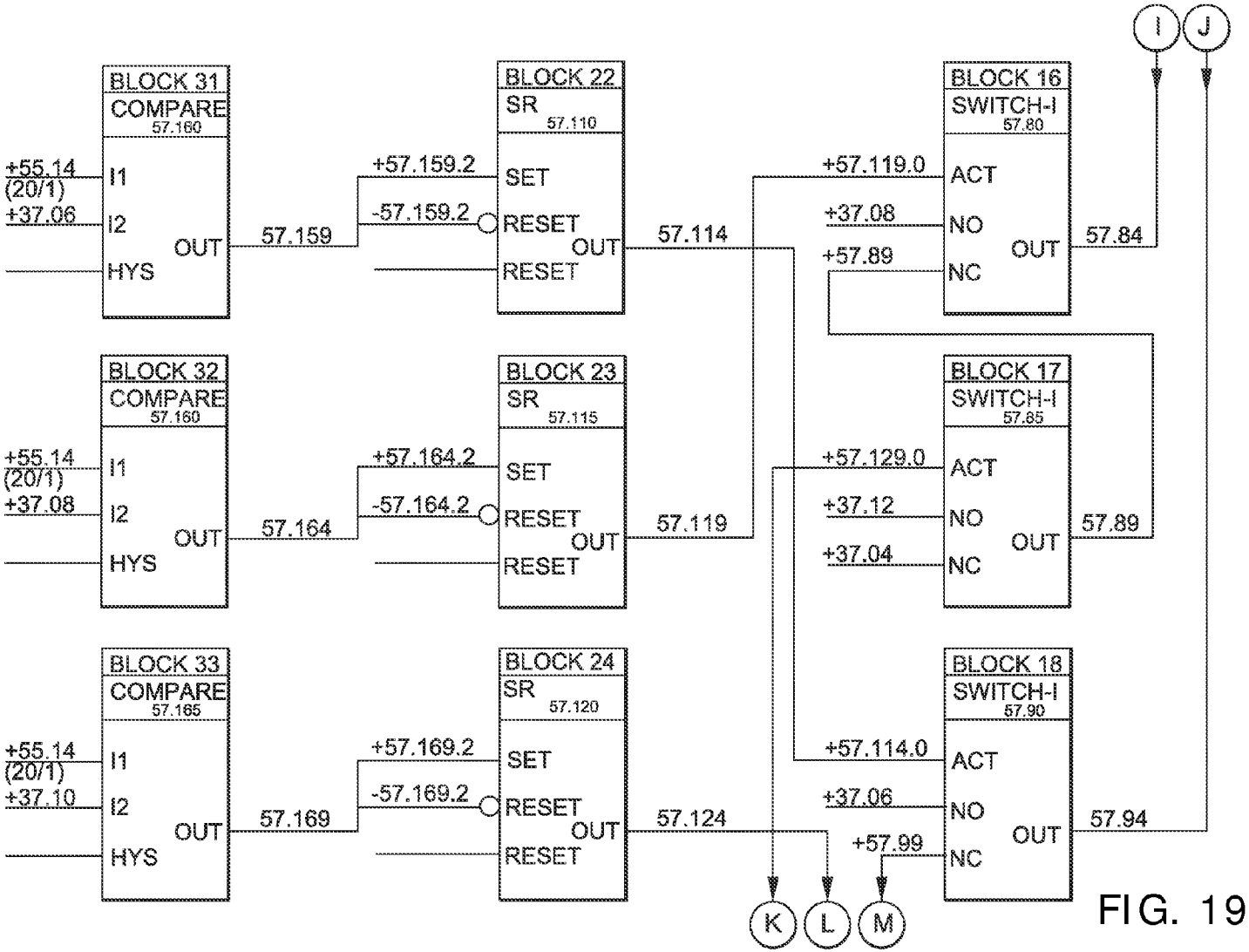
Figure 19L:
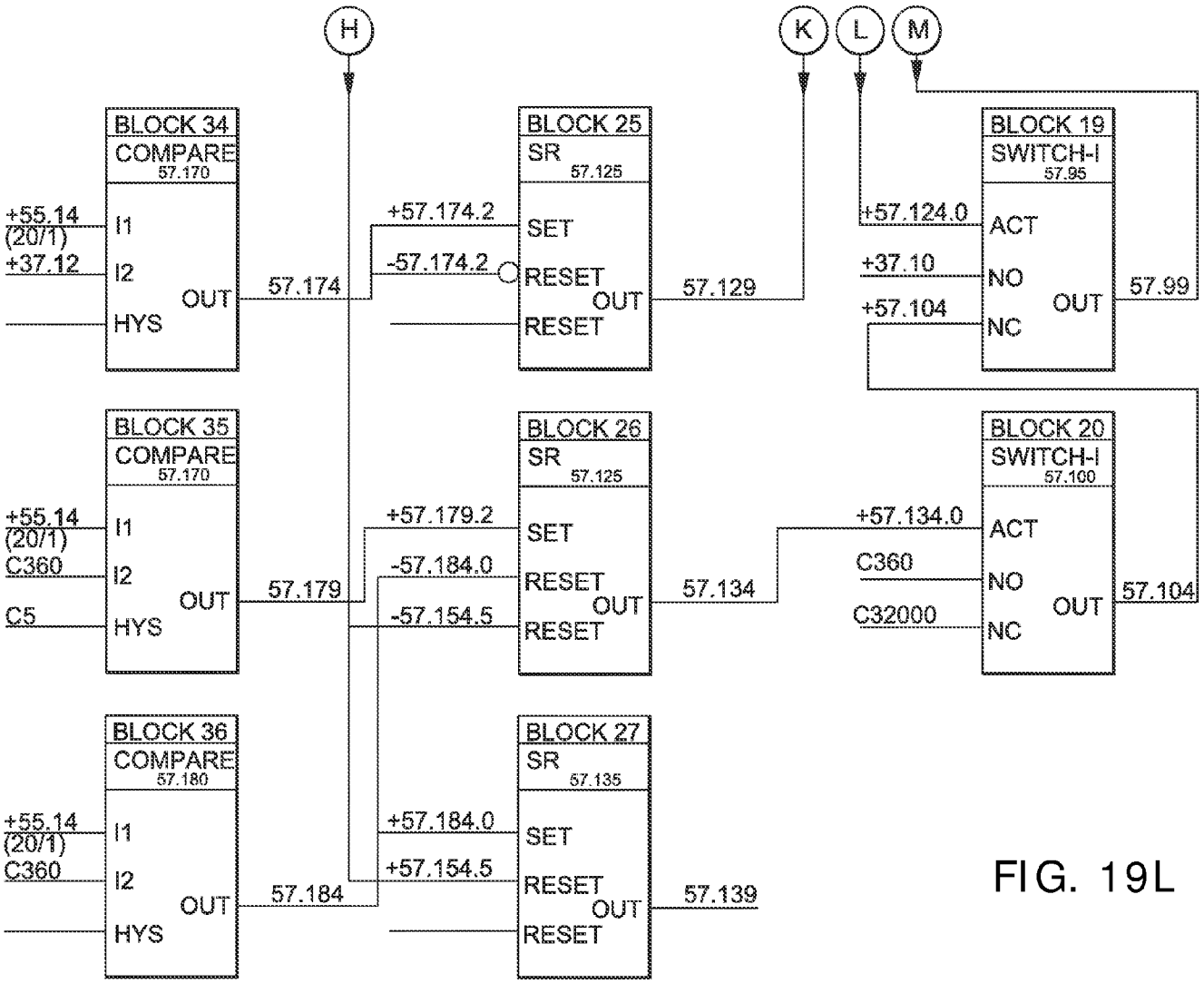
Figure 19M:
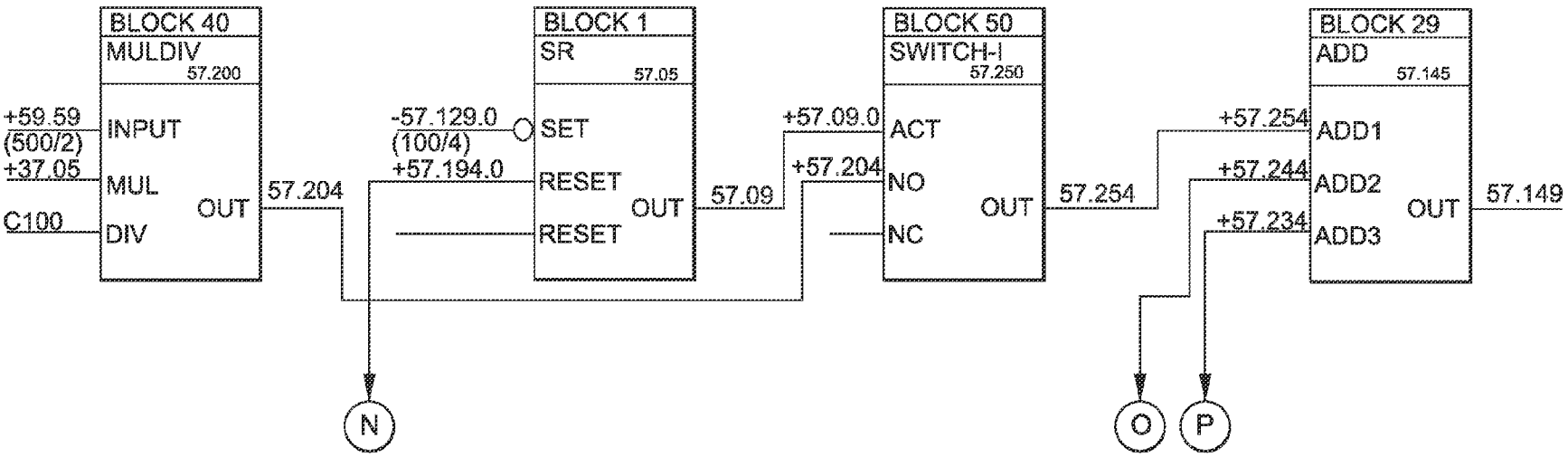
Figure 19N:
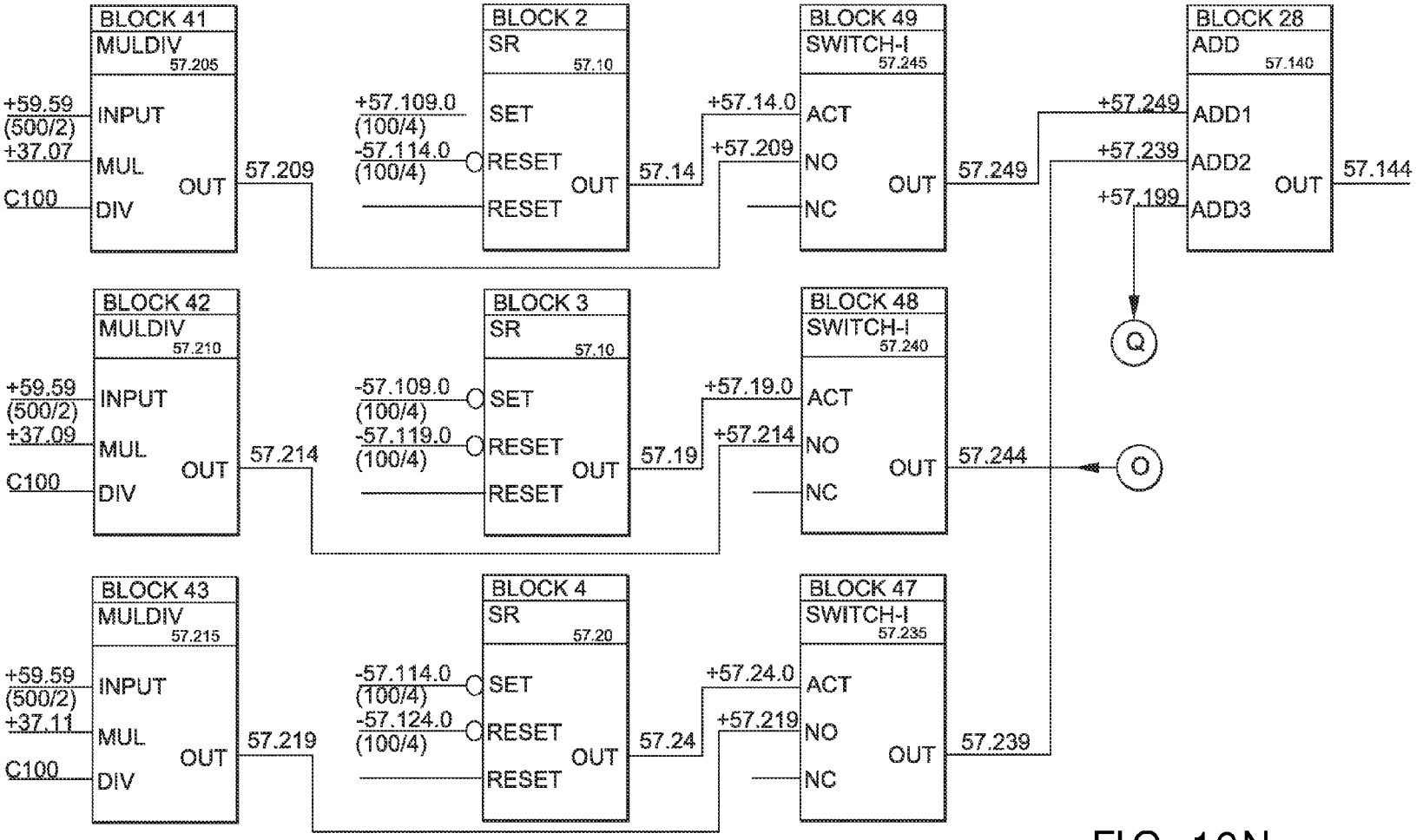
Figure 19O:
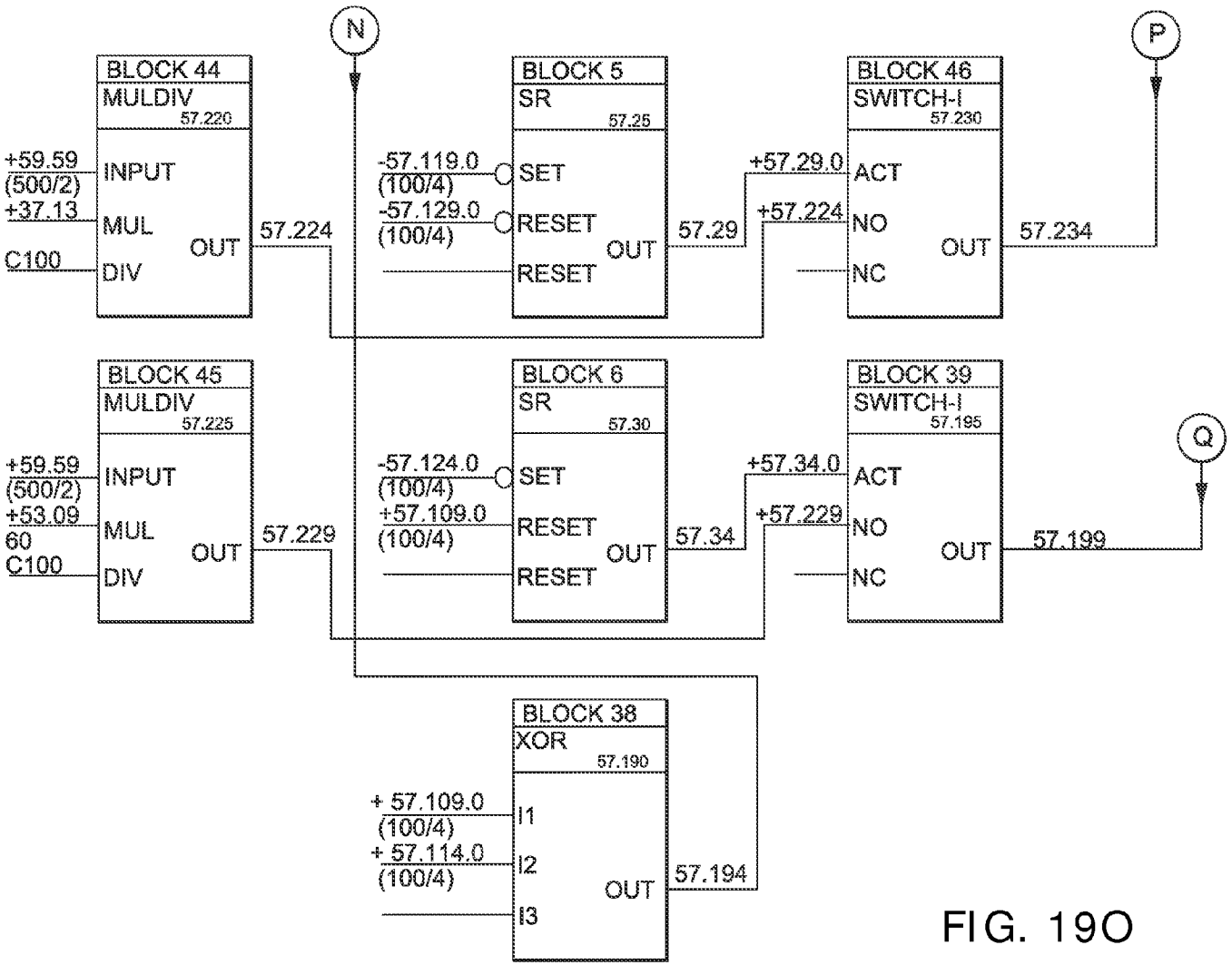
Figure 19P:
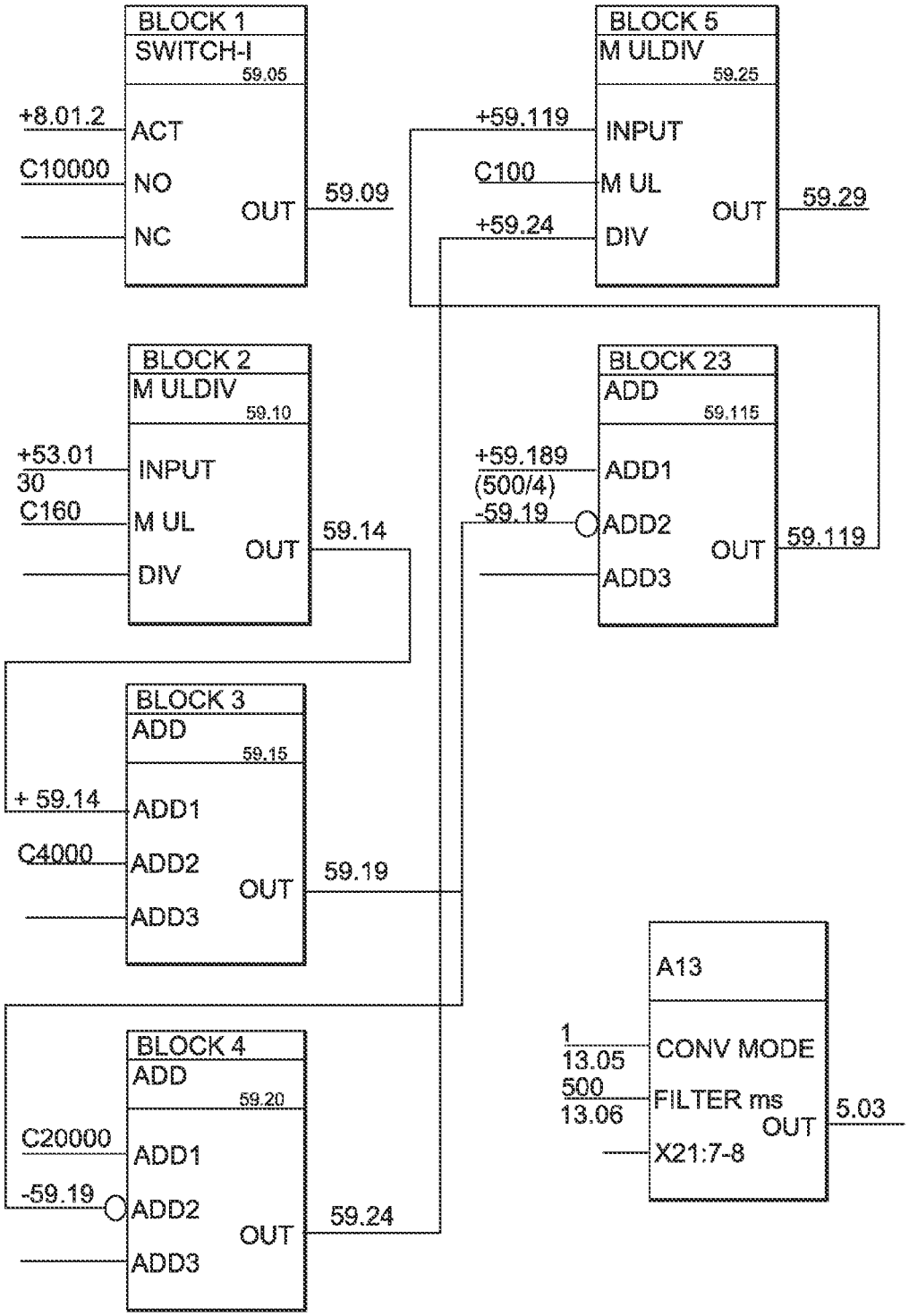
Figure 19Q:
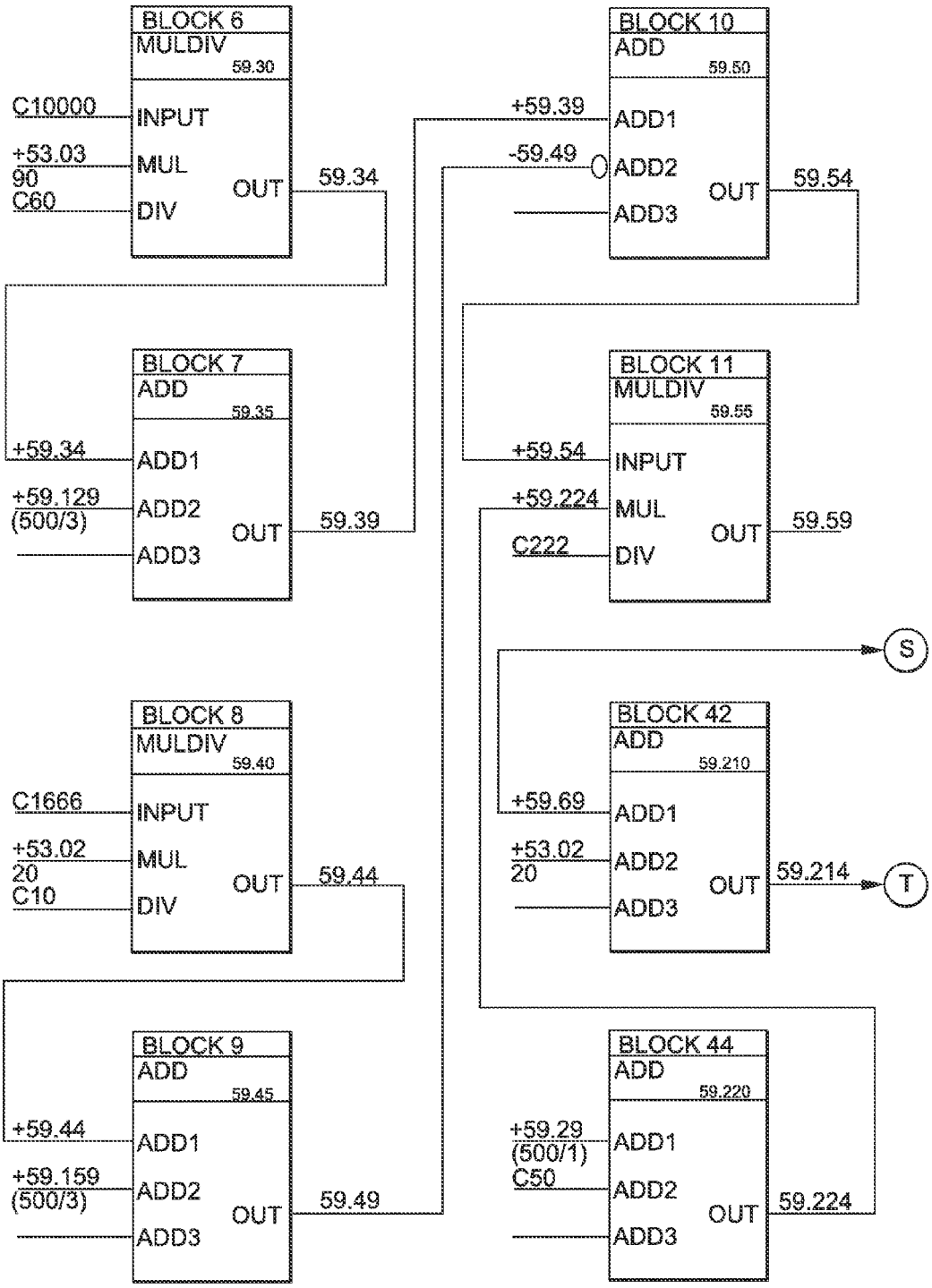
Figure 19R:
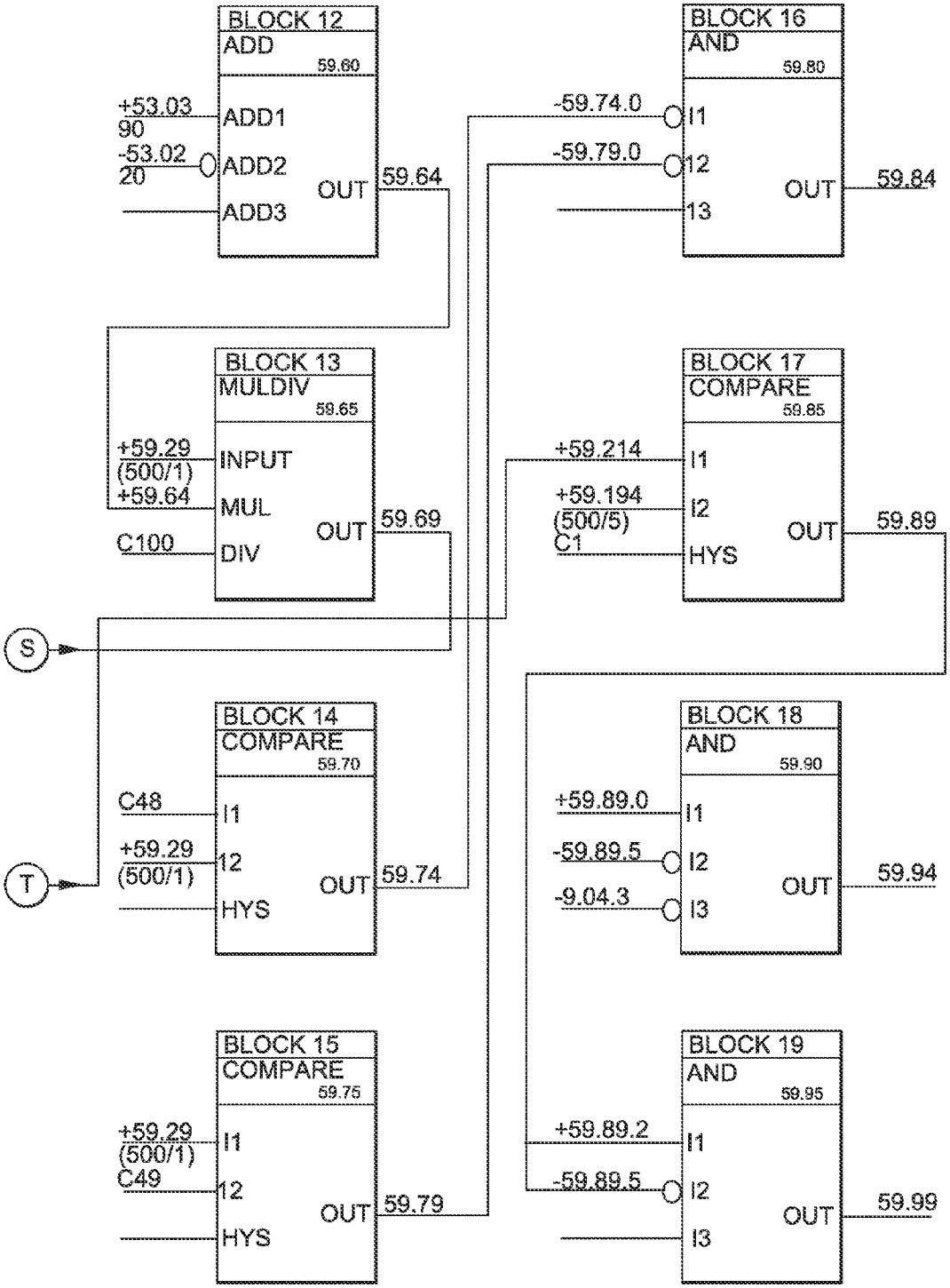
Figure 19S:
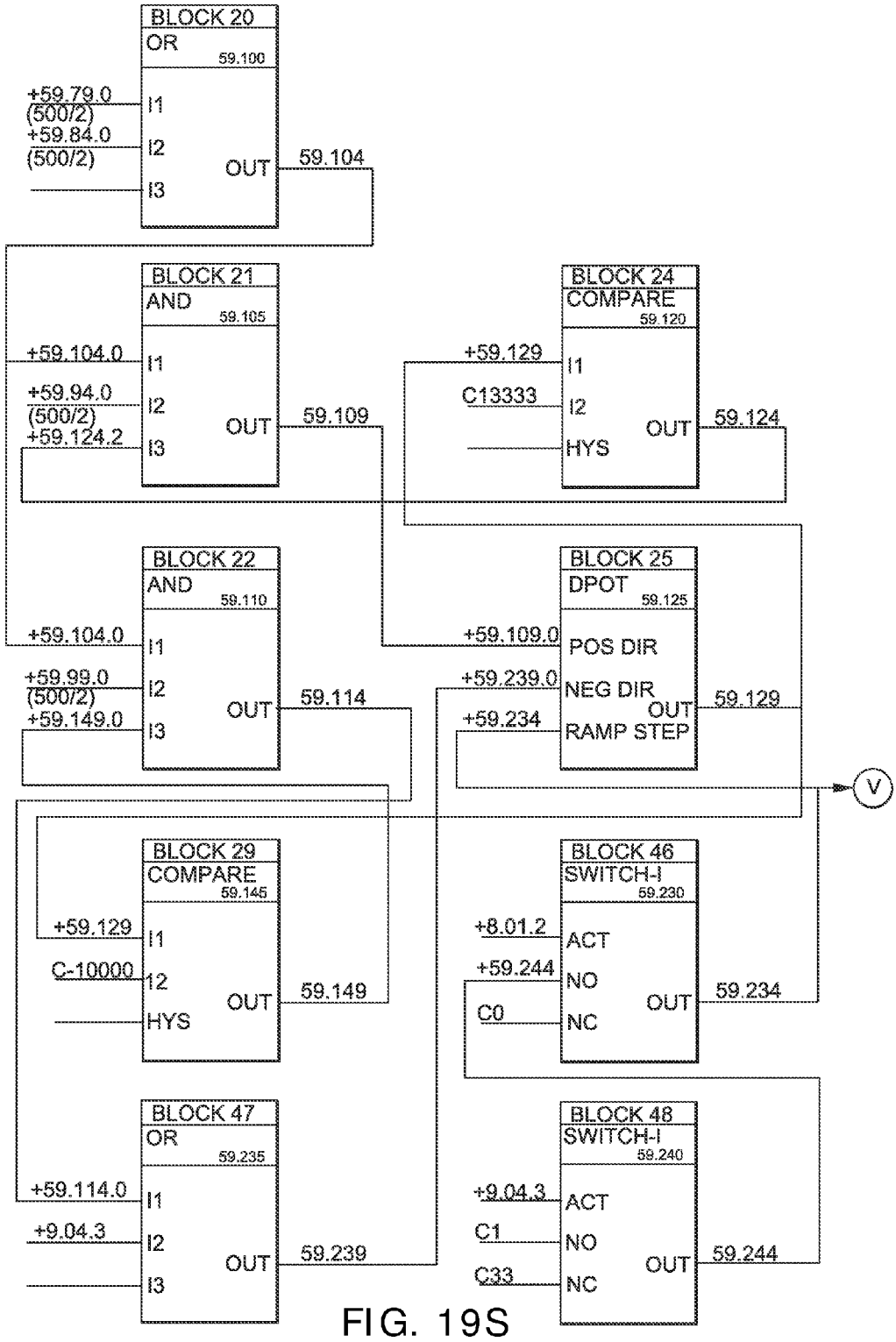
Figure 19T:
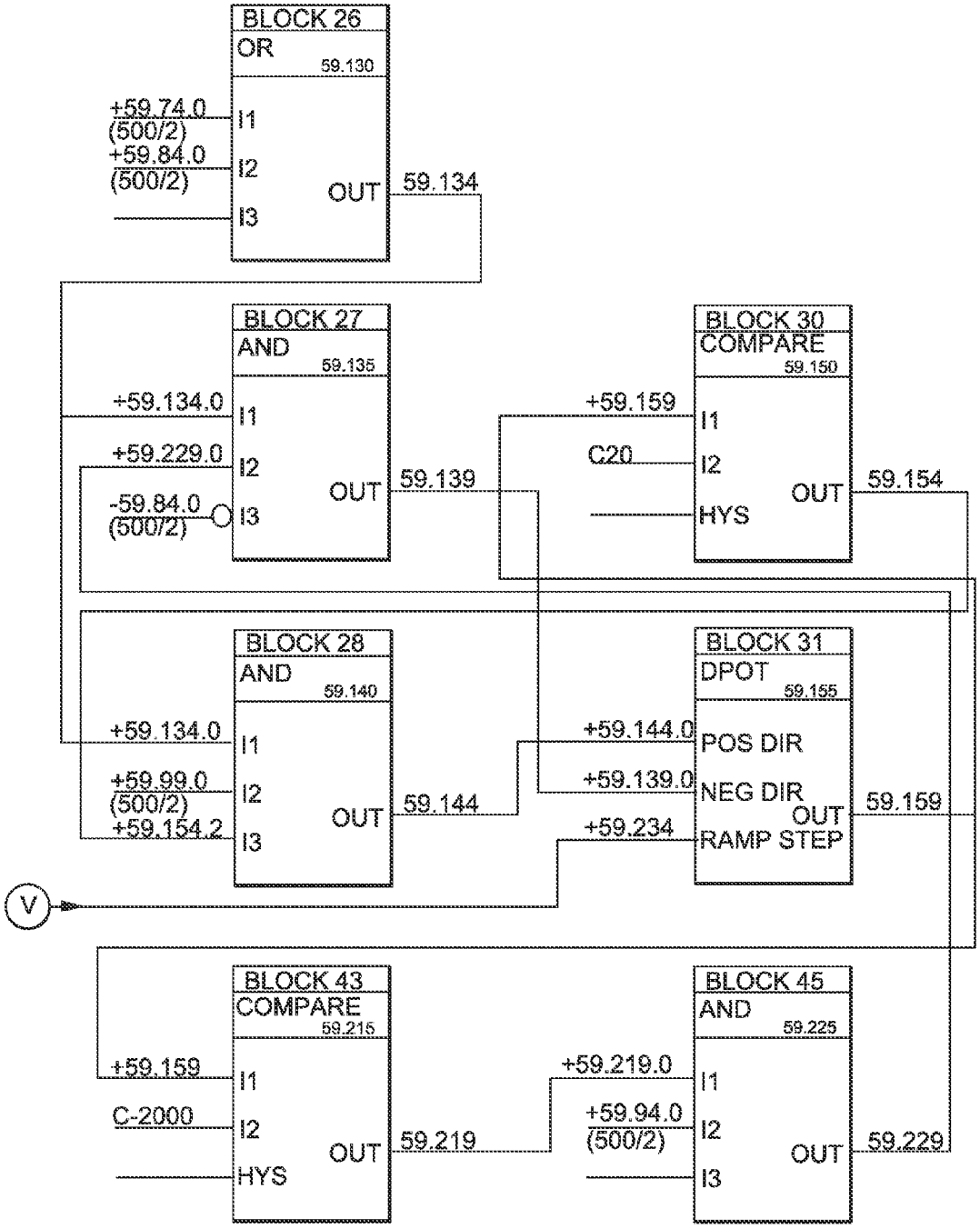
Figure 19U:
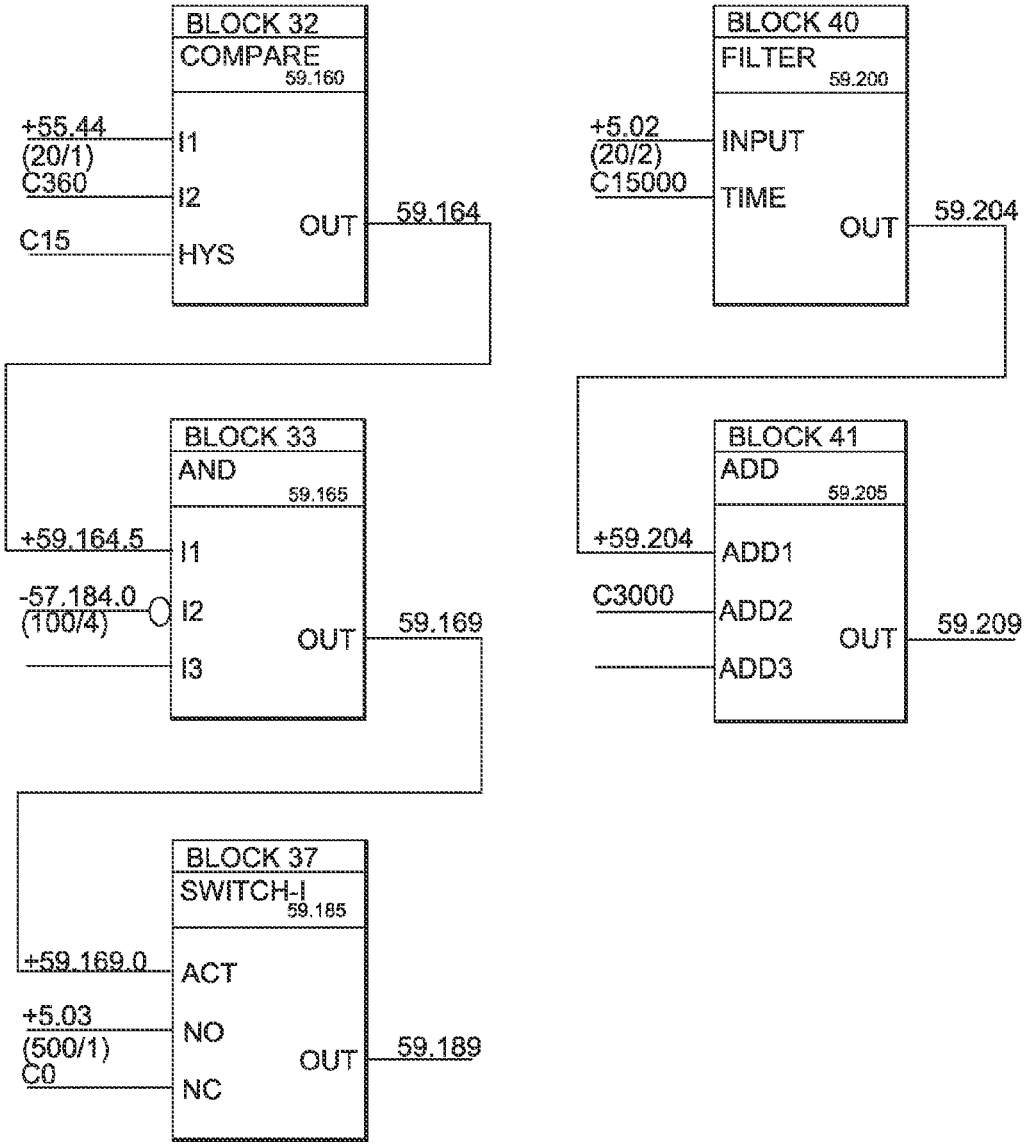
Figure 19V:
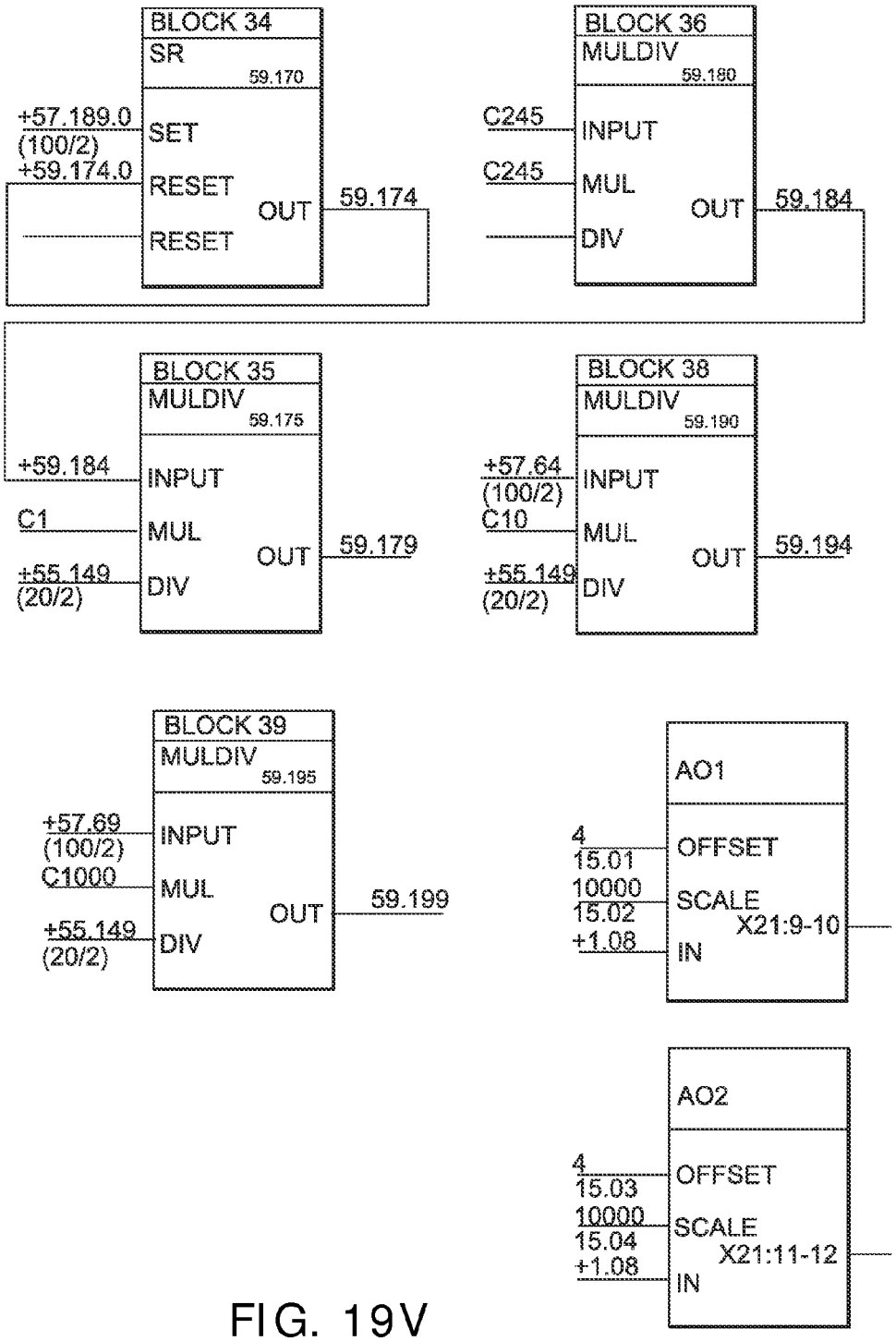

When calculating the position as described above, in our device's program (software) is a speed reference map that generates an instantaneous speed reference based on the real-time position. Therefore, each position has associated with it a speed reference. A technician encodes into the program of our device this speed map during initial start-up, programming the desired speed as units of % of the stroke cycle and the corresponding desired position as units of degrees (°) as depicted in FIG. 18. In the one embodiment corresponding to the graph of FIG. 18, there are 6 unique steps, each with its own corresponding speed reference. These steps are set in sequence and can be any location from 0° to 360°. FIG. 18 depicts a speed map for a long-stroke pumping unit.

Figure 10:
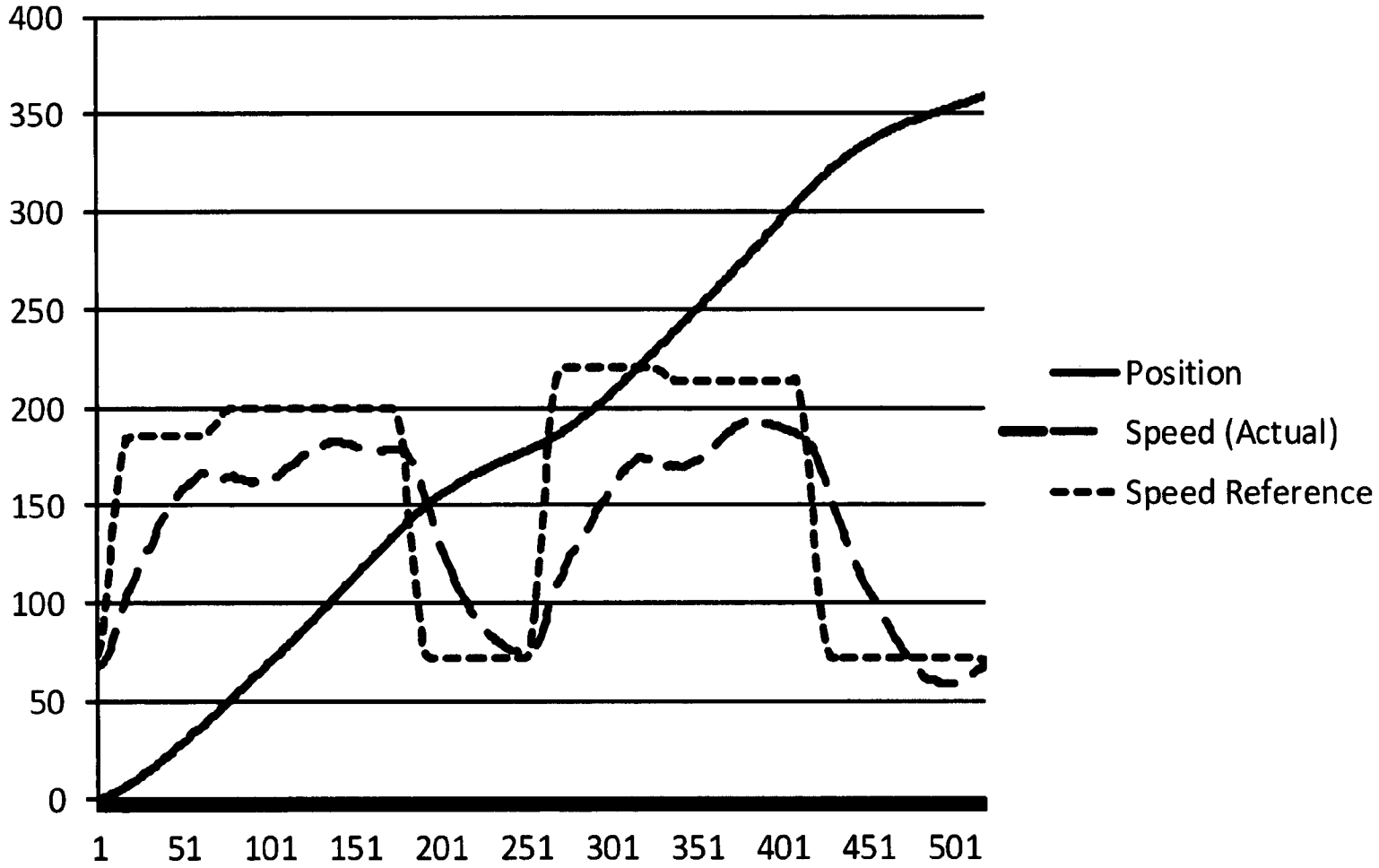
FIG. 10 is a graph depicting calculated position, estimate actual speed, and speed reference for a single stoke of a long-stoke pumping unit.

The curves depicted in FIG. 10 illustrate how the motor shaft speed changes over the course of a single stoke of a long-stoke pumping unit: the curve shown in solid line shows the position of the drive mechanism over the time it takes to complete one stroke cycle; the curve shown in dotted line is the speed reference map, and the curve shown in dashed lines is the actual (estimated) speed, measured or calculated. The ordinate in these curves is motor shaft speed in revolutions per minute and the abscissa is time (units of 25 milliseconds per division). There are many important characteristics of the curves shown in FIG. 10. The programming technician has the capability to set the speed reference. The technician can program position of each of the speed references and the magnitude of the speed reference. However, as can be seen from the curves shown in FIG. 10, the actual speed does not immediately follow the speed reference map. In fact there exists at almost all locations a difference (or error) between the actual speed and the speed reference. This error is primarily a function of the speed loop tuning.

Through experience and experimentation we have found that in order to enhance the desirable characteristics of a dynagraph (discussed subsequently in detail) and to minimize the undesirable characteristics of a dynagraph, a relatively "soft" speed loop tuning is required. The speed loop is a control loop that compares desired speed to actual speed and generates a torque reference. A "soft" speed loop is a speed loop that requires large error for a sustained period of time to generate a large or rapidly changing torque reference. A "firm" or "aggressive" speed loop is much more responsive. Relatively small and quick errors result in large and rapid changes to the torque reference. It is the torque reference, and subsequent actual motor torque, that actually changes the speed of the motor and the pumping unit. The relationship of torque to actual speed is complicated and depends on location of rod in the stroke; pump loading, pumping unit balance and torque and power limits programmed into the drive system.

Figure 11:
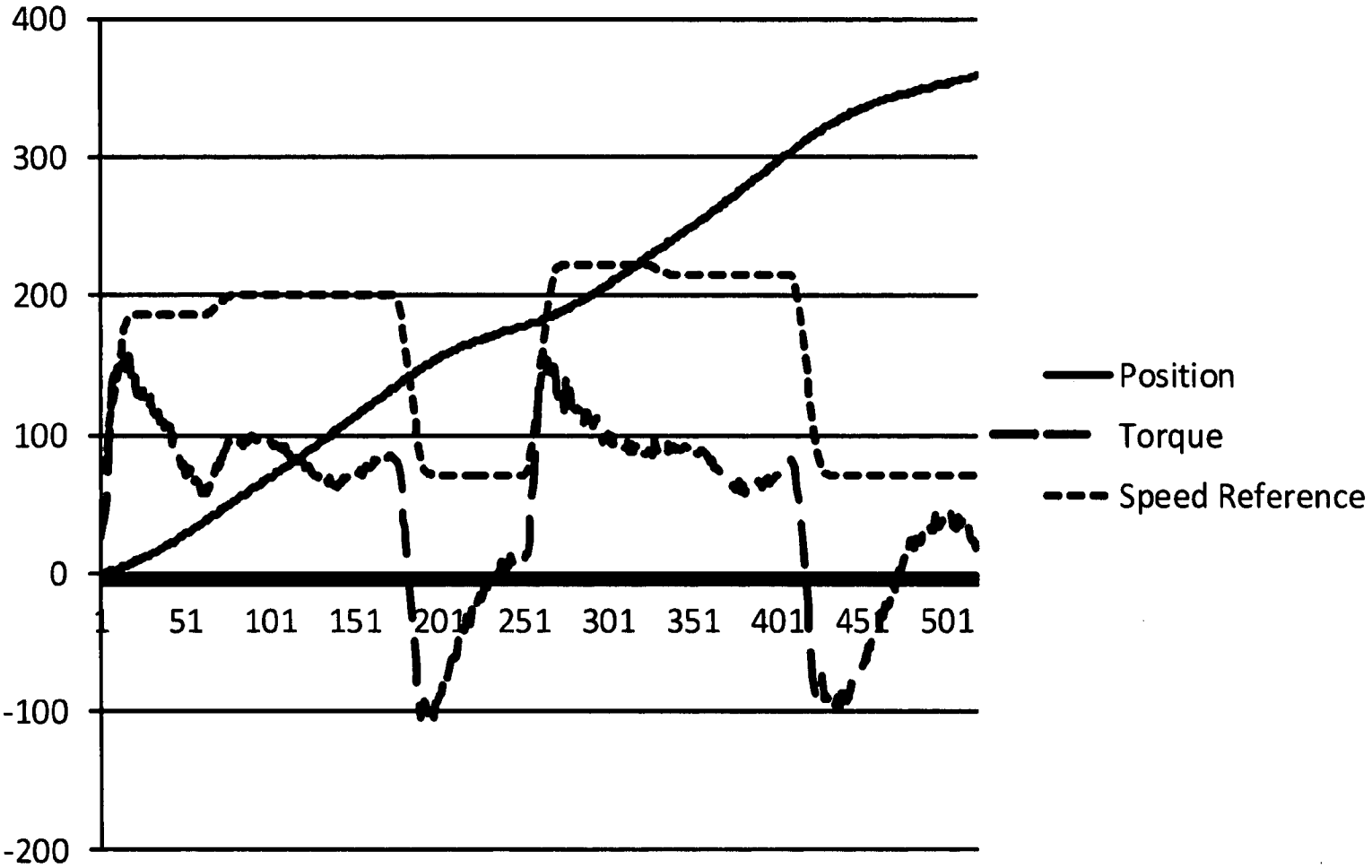
FIG. 11 is a graph depicting calculated position, estimate torque, and speed reference for a single stoke of the long-stoke pumping unit of FIG. 12.
Figure 12:
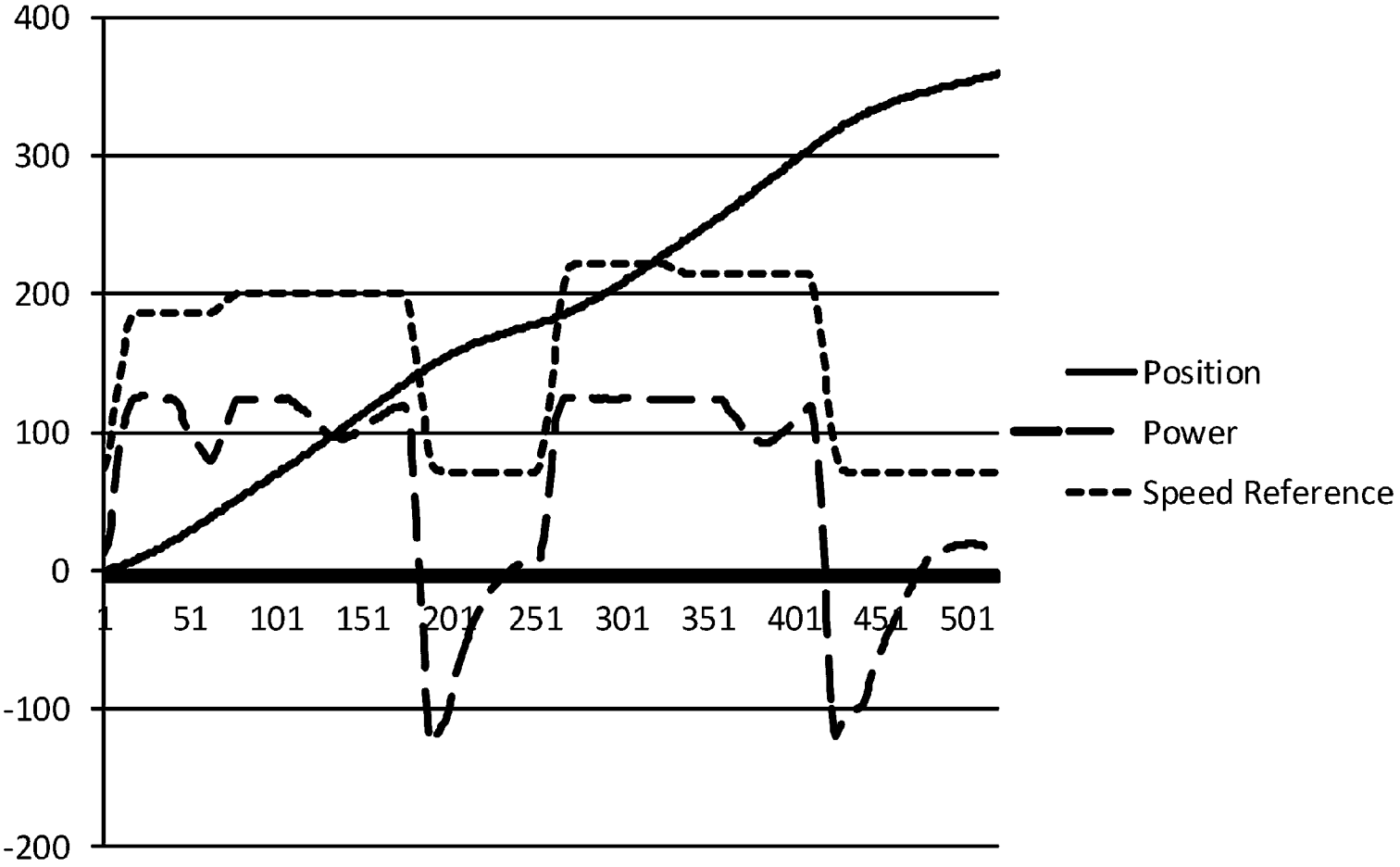
FIG. 12 is a graph depicting calculated position, estimate power, and speed reference for a single stoke of the long-stoke pumping unit of FIG. 12.

FIG. 11 is a graph of the same stroke illustrated in FIG. 10, except torque is shown as the speed reference in a dashed line curve, and FIG. 12 is a graph of the same stroke illustrated in FIG. 10, except power is shown as the speed reference in a dashed line curve. These graphs shown in FIGS. 10, 11 and 12 demonstrate how during each stroke, speed, torque and power are controlled to maintain a dynagraph for each stroke in an optimized condition, as discussed subsequently in greater detail. The exact same speed profile and resulting dynagraph would result if our device were to generate a position vs. torque reference map or a position vs. power reference map. Our device could just as easily and effectively control a power or torque reference based on calculated or measured position. The tuning of the speed loop is in fact a way of generating a torque reference.

Pump Load

As the well is pumped over a period of time, the level of fluid in the well begins to decrease. As the fluid level is decreased the overall pressure in the pump begins to increase. This is because the effective "head" of lift of the pump increases as the fluid level decreases. As the pressure on the pump increases, the force measured at the surface increases and the pump is required to do more work. This is a very good situation from a standpoint of production. The primary objective of a pumping unit is to pump fluid out of the well. If the pumping unit and its chamber 18 are sized correctly, the capacity of the well to produce fluid and the capacity of the pumping unit can pump will be equal, or the capacity of the pump will be slightly larger than capacity of the well.

The ideal circumstance is one in which the capacity of the pump and the pumping unit is slightly larger than the capacity of the well to produce fluid. This is ideal because, from a production standpoint, the oil operation is maximizing production from a well in this circumstance. The end result of this is that, under ideal production circumstances, the plunger and pumping unit will be required to work at the upper end of their design limits. This means that over a period of time, usually many days or weeks or months, the load on the pump will increase. Typically, this has little or no effect on the pumping unit or our device. This can affect a dynagraph in many ways, however. The most common side-effect of increased pump loading is a decrease in our device overall SPM. Typically, this effect is not large and is in the range of 2% to 4% decrease in overall SPM. The primary reason the overall SPM is decreased is the use of tension control. As the pump load increases the software will attempt to control the maximum tension level on the upstroke. The tension control on the upstroke as the pump loads will usually result in slower upstroke speeds. In most applications, however, this slight decrease in speed is considered to be a good trade-off with lower maximum tensions.

Consistency

Consistency of operation is the primary reason that there are many checks on the operation of the control system of our device. For example, if at any time the calculated real-time position goes above 360°, then the speed reference is set to a minimum value set point. The speed reference persists in this minimum set point until such a time that the calculated real-time position is less than 360°. In addition, the real-time position is stored at the end of each stroke. If the stored position from the last stroke is more than 12° different than 360°, then the speed reference is set to minimum. The usual circumstance for the real-time position to go above 360° is the circumstance where the end of stroke input was not received by the control system. This can happen on windy days on certain types of pumping units or can be the result of some type of wiring or control system failure. In such situations, a real-time position, calculated, greater than 360°, or the stored position being greater than 12° different from 360°, the control system will maintain the minimum speed reference until the problem is rectified. The end-result of this type of redundancy and error checking is a control system that operates identically at every increment of degree of every stroke.

Tension Regulation

A tension set point for the rod tension regulator is a programmed function of the rod position. The tension set point at each position is determined by the technician's programmed setting. The tension set point in general will be programmed by the technician in such a way as to minimize tension on the rod upstroke and to maximize tension on the rod down stroke. In addition, the tension regulator "orientation" is determined by the rods position in the stroke. In general PID regulators can be generalized into to "orientations": forward acting and reverse acting (sometimes also called heating and cooling). A forward acting PID regulator operates in such a way as to result in an increase in process variable or feedback as the output of the regulator is increased. A reverse acting PID regulator operates in such a way as to result in a decrease in process variable as the output of the regulator is increased. In general, in use as a tension regulation device, on the upstroke of the rod, an increase in motor power/speed will result in an increase in tension. But in general, on the down stroke of the rod, an increase in motor power/speed will result in a decrease in tension. Our device changes the tension regulation from a forward acting tension regulator on the upstroke, to a reverse acting regulator on the down stroke.

As the microprocessors become more powerful and memory is increased in the hardware that is used to implement our device, there will be many more unique speed references to map against the position, calculated or measured. As discussed above, we have six unique speed references depicted in FIG. 18 that can be activated at any point in the 360° of stroke position. In the future, we may have many more unique references available. For example, if in the future we had 360 unique speed references for each of the calculated 360° of position calculation, then the speed loop tuning of our device may not be needed. This is because each of the speed references could have very small changes between them. In that case, the speed reference curve shown as a dotted line in FIG. 10 could be programmed to correlate more closely with the actual speed of the motor in the pumping unit. In that case, the speed loop tuning would necessarily change and in many cases may not be needed. In addition, the position vs. speed reference map could be generated automatically by our device to optimize a dynagraph with the then current well conditions.

Well Manager

A modern "well manager" is an extremely complex, powerful and mature oil well control instrument. The technology and knowledge about oil wells that is present in the modern well manager has been developed over several decades by many different companies. The well manager's function is to maximize production in a given well in a safe and reliable manner. The well manager also allows oil production personnel to operate, troubleshoot, analyze and predict a well's performance. The well manager, when properly programmed and applied, can also be used to protect the well and its associated equipment from damage and increase the reliability of the pumping process. The well manager is the single most important control device associated with any well. In most cases, a well manager is dedicated to a well. There is one well manager per well. Again, in most cases, the well manager is contained in a relatively small electrical enclosure that is located in close proximity to the well and the pumping unit. The protective features of most modern well managers include, but may not be limited to, maximum tension limit, minimum tension limit, loss of tension feedback, loss of speed feedback, loss of position feedback, set point malfunction or loss of fluid load. With respect to most of these protective features the well manager will shut down the pumping unit as a response to detecting an unwanted condition as indicated by actuation of a protective feature.

Most modern well managers can be programmed to maximize well production when used with a variable frequency drive by calculating the "pump fill". In order to understand pump fill, one should consider FIG. 18 along with FIGS. 8A through 8C. The pump chamber 18 and plunger, located below the surface, is used to pump (pressurize) fluid that is contained in the tubing. The fluid produced from the pump flows all the way to the surface in the tubing. The fluid flows into the pump chamber from the fluid that is contained in the annulus inside the casing. As the well is pumped the fluid level in the annulus begins to drop. Ideally, the fluid level in the annulus drops all the way to the level of the plunger. If the fluid level can be maintained at the pump then the oil production personnel can be assured that the output of fluid from the well is exactly matched to the capacity of the well to produce fluid. If the capacity of the pump to produce fluid is higher than the capacity of the well to produce fluid, then the fluid level in the annulus will be at a level that will result in partial pump fill on each pump stroke. The well manager can detect this partial fill condition and even determine the exact amount of partial fill. The partial fill is typically displayed as a percentage of the maximum capacity of the pump. This is called "pump fill".

Typically, most oil production operations desire to have some level of partial pump fill. It is in this way that the oil production operation is assured that the pumping process is maximizing the output from any given well. If the pump fill is determined by the well manager to be below the pump fill set point, then the well manager will decrease the SPM of the pumping unit. Decreasing the SPM of the pumping unit is typically accomplished by means of a decreasing the signal level of an analog signal that is intended to be proportional to SPM. This analog signal is called SPM reference, or average speed reference signal from the well manager. Conversely, if the pump fill is determined to be above the pump fill set point, then the well manager will increase the SPM of the pumping unit. Increasing the SPM of the pumping unit is typically accomplished by means of increasing the signal level of the SPM reference. Through this process the pump fill is controlled to the desired pump fill set point regardless of changing well conditions or changing pumping unit conditions. A calculated pump fill is used to control the average SPM of the pumping unit.

While well managers can detect partial pump fill, technology has not advanced to a stage where the well manager can accurately detect the level of fluid in the annulus in those circumstances where a partial pump fill is not present. The fluid level in the annulus can be approximated by a modern well manager, but not determined with a great deal of precision. Our device incorporates the speed reference signal from the well manager into its control scheme. Our device uses the speed reference signal from the well manager as a reference for how many strokes must be executed, or accomplished, in one minute. Our device uses a measured position or an internal position calculation and a programmed speed map to control the speed at each predetermined increment of a degree of each stroke. It is the speed reference signal from the well manager that determines how many strokes should be accomplished per minute. In this way, real-time speed at each predetermined increment of a degree of each stroke is determined by our device.

Figure 13:
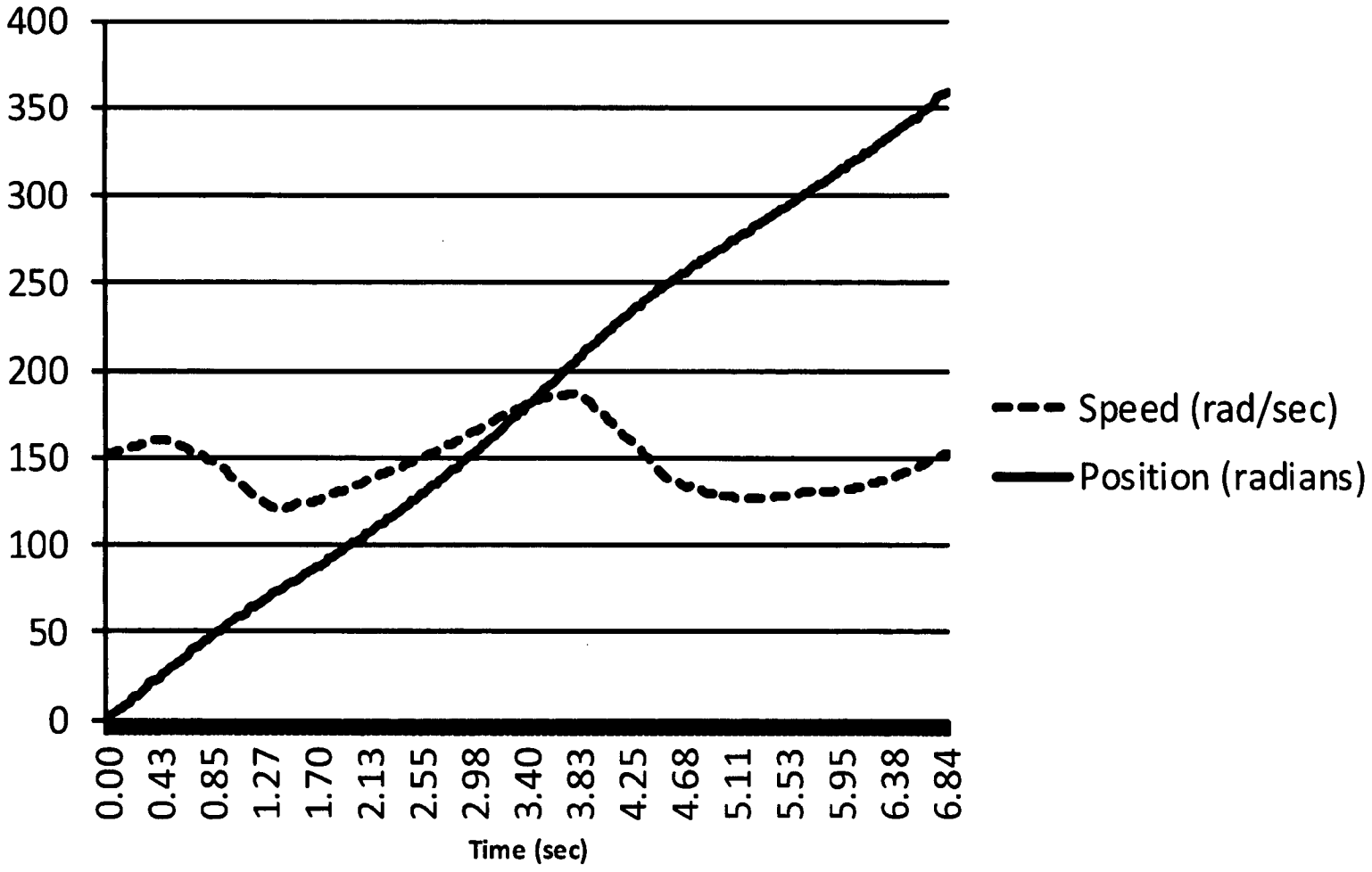
FIG. 13 is a graph depicting a pumping unit operating a 8.8 stokes per minute.
Figure 14:
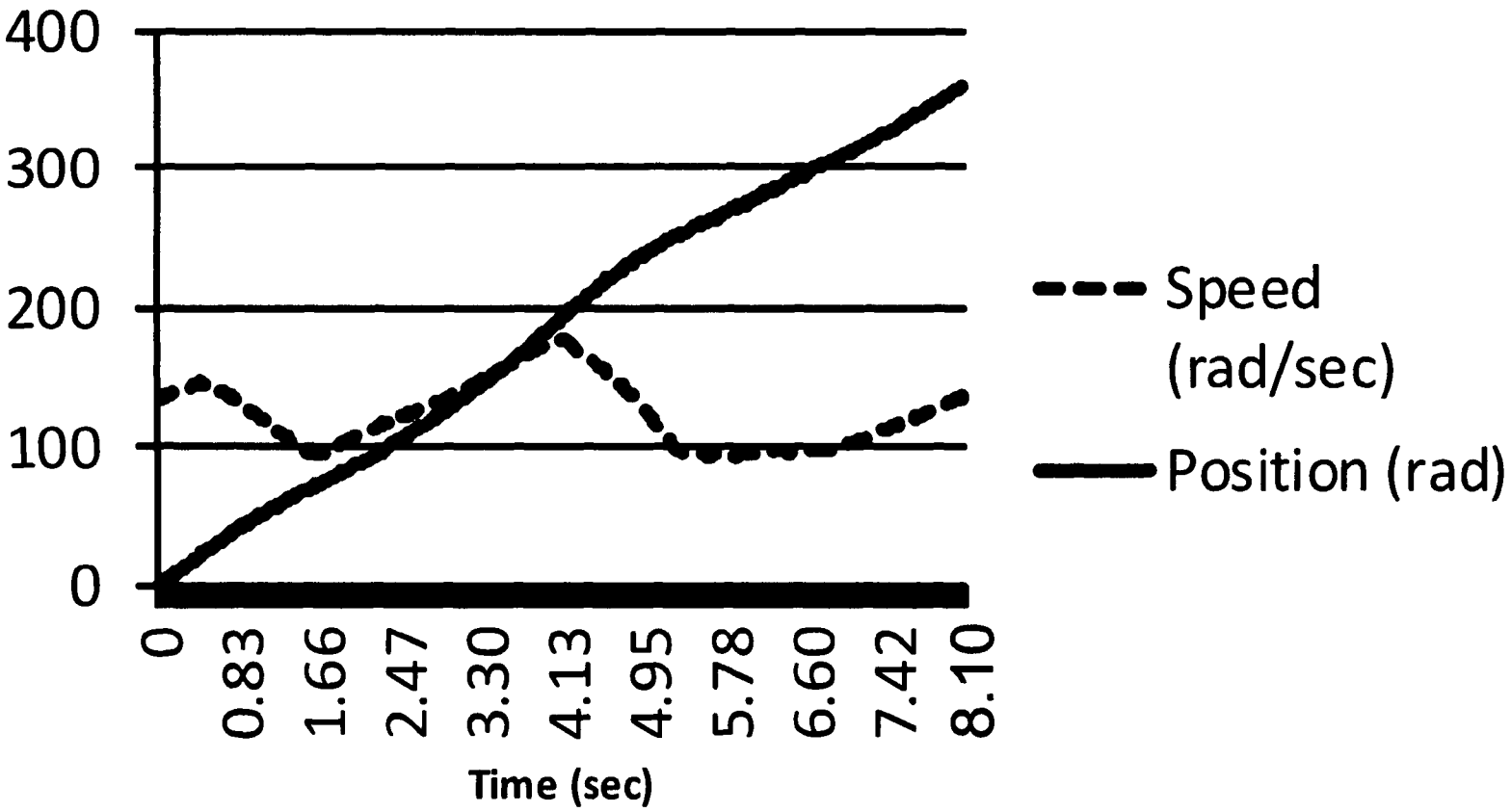
FIG. 14 is a graph depicting the same pumping unit as in FIG. 13 operating at 7.4 strokes per minute.

The frequency of the stroke, in strokes per minute (SPM), is controlled by the well manager as illustrated by FIGS. 13 and 14, which depict the same pumping unit operating at different strokes per minute (SPM). FIG. 13 shows a position curve in solid lines and a speed curve in dotted lines with the pumping unit operating at 8.8 SPM. At 8.8 SPM each stroke is completed in a time of 6.84 seconds. FIG. 14 shows position and speed curves for the same pumping unit operating at 7.4 SPM. At 7.4 SPM each stroke is completed in a time of 8.10 seconds. As can be seen in the above curves, our device is controlling the speed of the pumping unit as the pumping unit moves through each portion of the stroke. As the curves illustrate, our device is performing its control in essentially the same way at both the higher overall SPM (FIG. 13) and at the lower overall SPM (FIG. 14). The well manager is considering many aspects of the pumping unit and overall well performance. Given the time required to complete a single stroke, our device must accommodate the predetermined increment of a degree of each stroke, based on measured or calculated position within the stroke and the programmed speed reference map.

The "de-Bounce" Feature

A potential problem is that the magnet and the sensor may be physically mounted in such a way that the magnet actuates the sensor at more than one location per stroke. Combining these types of installation deficiencies with a heavy wind may cause several end of stroke detections at locations that are not at the end of stroke. These challenges are overcome by a signal "de-bounce" feature that is implemented in the software. i.e., the program of our device. This feature results in one, and only one, end of stroke detection per stroke. This feature is implemented by ignoring any end of stroke detection unless the position calculation is greater than 300°. This works well because immediately upon detection of end of stroke, the position calculation is reset to 0°. Any additional end of stroke detection signals are ignored until the position calculation again exceeds 300°. In cases when the end of stroke magnet and sensor are located in such a way that the end of stroke detection is at a location other than the actual end of rod stroke then an offset between the end of stroke and the 360° position calculation is introduced. However, this offset is typically not a problem in most installations. Any offset that is present simply shifts the position calculation in the software in relation to the rod position. If any shift is present the installation technician will simply adjust the speed reference vs. position map accordingly to achieve optimum pumping unit performance.

Other types of end-of-stoke signal detector could be used. The end-of-stoke signal detector need not be a sensor that physically measures the position of the pumping unit. The end-of-stoke signal detector could be any hardware, software or calculation that results in an accurate, reliable and consistent determination of the pumping unit position on each stroke.

Balance of the Pumping Unit

Balance as applied to pumping units refers to a broad range of systems incorporated into pumping unit mechanical design and manufacture that are intended to minimize the force required by the prime mover to move the rod through a stroke. The prime mover is an AC motor in our device. The force exerted by the pumping unit at the surface on the rod can be extremely large and always in an upwards direction. On larger pumping units and larger wells the force exerted on the rod by the pumping unit at the surface can be as high as 50,000 pounds at certain rod positions. Generally, as discussed previously, the force exerted by the pumping unit is larger on the upstroke and lower on the down stroke.

A system that assists with well "balance" can be as simple as a counter-weight incorporated into the design of the pumping unit. The pumping unit is designed mechanically in such way that, during specific locations during the stroke, the prime mover will lift the rod as the counter-weight falls. In this way, the counter-weight is assisting the prime mover by exerting force, through the mechanics of the pumping unit, to lift the massive weight of the rod. The pumping unit is designed mechanically in such a way that, during specific locations during the stroke, the prime move will lower (drop) the rod as the counter weight is lifted. In this way, the counter-weight is assisting the prime mover by exerting force, through the mechanics of the pumping unit, to lower (drop) the weight of the rod. In cases when the counter weight is properly installed the force required by the prime mover to lift the rod is similar to the force required to lower (drop) the rod.

Figure 15:
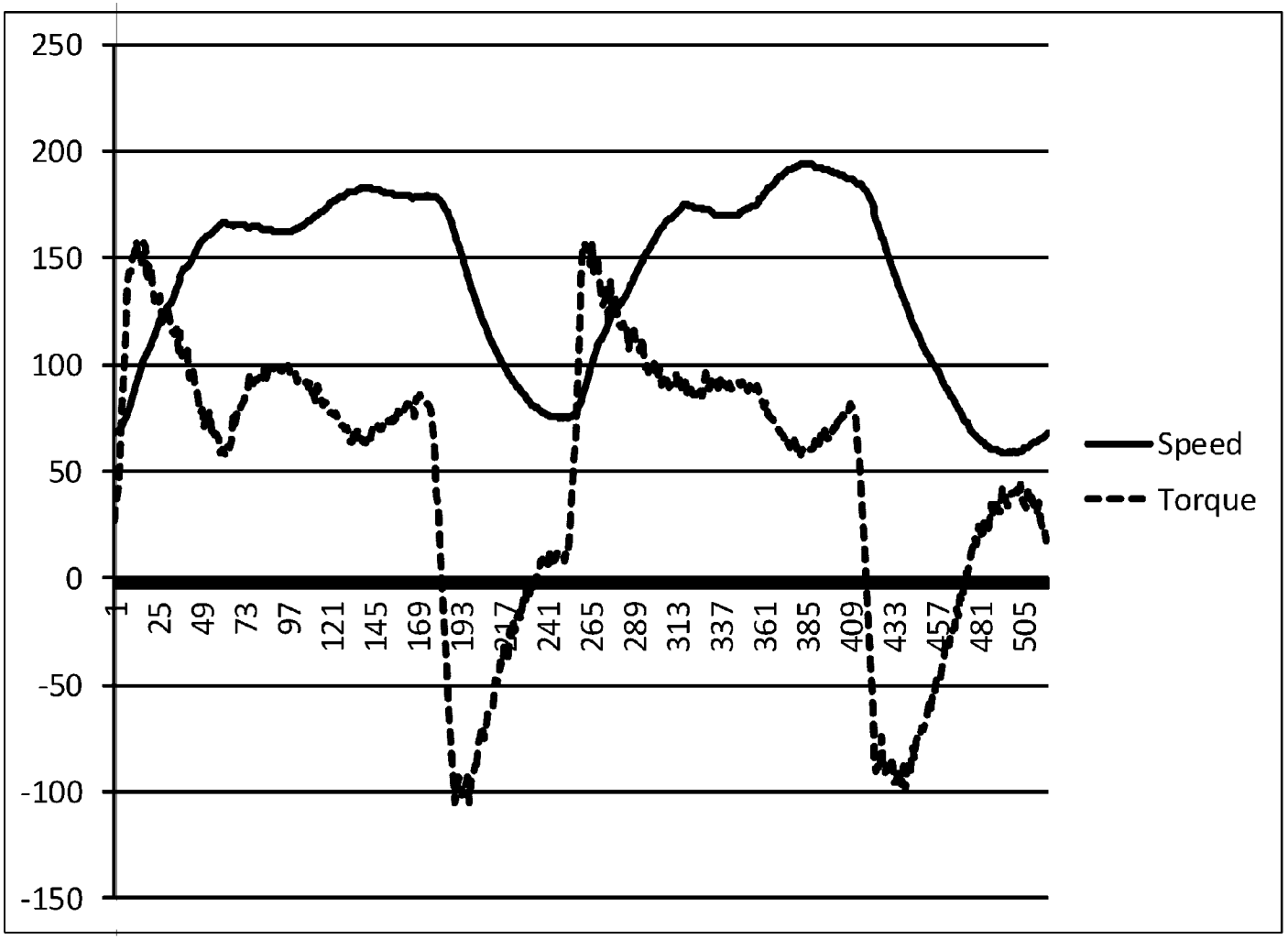
FIG. 15 is a graph depicting a balanced long-stoke pumping unit.
Figure 16:
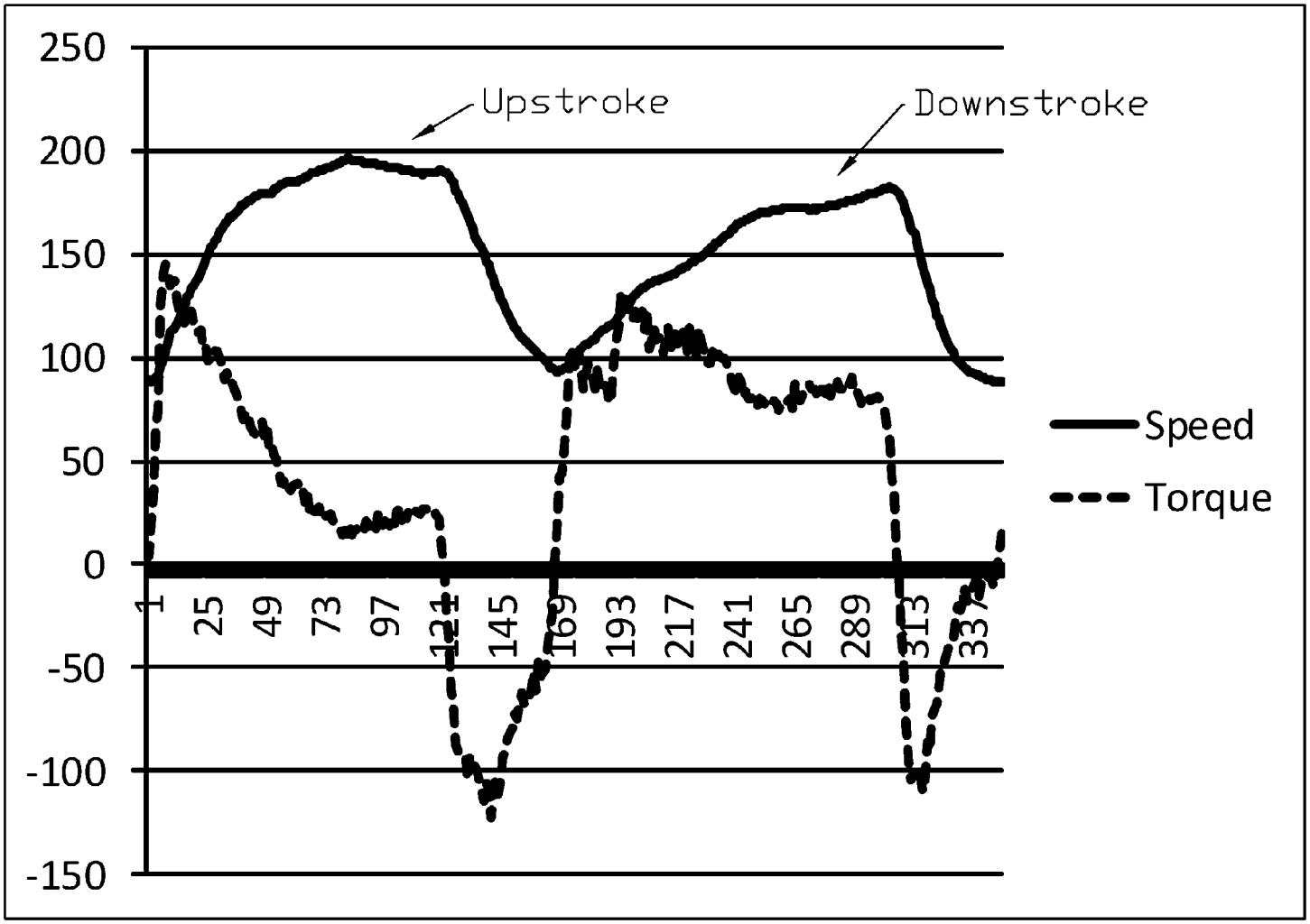
FIG. 16 is a graph depicting unbalanced long-stoke pumping unit.

The speed curve in solid lines and the torque curve in dotted lines shown in FIG. 15 illustrate a beam pumping unit that is balanced properly. Torque to lift and then decelerate is similar to lower and decelerate. The speed and torque curves of FIG. 16 illustrate a pumping unit that is not balanced properly. This pumping unit is said to be "weight heavy," meaning excessive mass used in the counter-weight. During the upstroke, the rod is being raised, while the counter weight is being lowered (dropped). Note the very low levels of positive torque required to lift the rod and lower the counter-weight. Then at the end of the upstroke, note the large and sustained amount of negative torque required to decelerate the rod at the end of its upstroke. To understand this large and sustained level of torque, one must consider the counter-weight rather than the rod. During the upstroke, the rod is being lifted while the counter-weight is being lowered (dropped). The large and sustained level of negative torque that is present at the end of the upstroke is not present to arrest, or slow, the movement of the rod upwards. Rather this large and sustained negative torque is required to arrest, or slow, the movement of counter-weight as it moves downwards.

During the down stroke the rod is being lowered (dropped), while the counter-weight is being lifted. Note the large and sustained levels of positive torque required to lower (drop) the rod and lift (raise) the counter-weight. Then at the end of the down stroke, note the relatively small and short negative torque required to decelerate the rod at the end of its down stroke. Again, to understand this relatively small and short level of negative torque, one must consider the counter-weight rather than the rod. During the down stroke, the rod is being lowered (dropped) while the counter-weight is being lifted (raised). The small and short level negative torque that is present at the end of the down stroke is not present to arrest, or slow, the movement of the rod downwards. Rather this small and short negative torque is all that is required to arrest, or slow, the movement of counter-weight as it is lifted.

The most interesting aspects of FIGS. 15 and 16 are the profiles of the speed curves for the same pumping unit in a balanced and unbalanced condition. The speed profiles of each of the curves in FIGS. 15 and 16, while not identical, are similar. Each of these pumping units is operating on a well that is performing at a high level of output with minimal pumping unit and rod string stress. Our device allows for high performance pumping unit operation even in circumstances of extremely out of balance pumping units. There are many aspects of our device that allow "out of balance" operation to occur. Because the system is calculating position during all stroke positions, the system will attempt to perform the same speed profile at each calculated position. This aspect of the system, combined with the ability of the regenerative variable frequency AC drive to supply large amounts of both positive and negative amounts of torque and power results in consistent performance even on pumping units that are extremely "out of balance." Operation of the pumping unit without our device in cases when pumping unit is extremely out of balance results in high levels of pumping unit and rod-string stress or damage. In most extremely "out of balance" circumstances the pumping unit must be re-balanced or the pumping unit must be slowed significantly. Re-balancing in this case, because the pumping unit is "weight-heavy," requires removing, or re-positioning, weight in the counter-weight.

Balance is not always a mechanical system of counter-weights. There are many different types of mechanical system that accomplish similar functions. Other than counter-weights, the most common type of well-balance system is "air-balance" as shown in the pumping unit 200*b* depicted in FIG. 3F. In an air-balance type of pumping unit compressed air is used to provide assisting force to lift the rod R. An air-cylinder 201 is designed and manufactured as part of the pumping unit. The air-cylinder 201 is positioned mechanically and controlled in such a way as to allow the compressed air force to assists the prime mover to lift (raise) the rod R. Then in similar fashion, the compressed air is "re-compressed" as the rod falls.

Our device does not make pumping unit balance irrelevant. Our device does not allow for high performance operation regardless of how "out of balance" a pumping unit may be. What our device does is minimize the impact of "out of balance" operation on pumping unit performance and minimize the mechanical stresses on the pumping unit and rod-string introduced by "out of balance" operation. This is true regardless of the type of balance used in the mechanical design of the pumping unit.

Power Flow

Figure 17A:
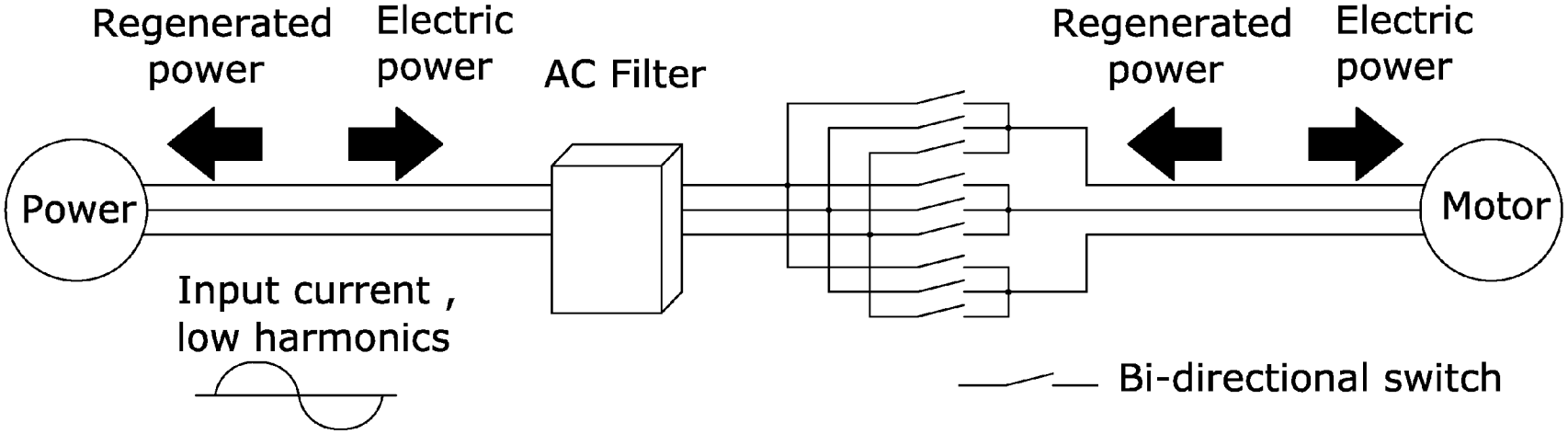
FIG. 17A is a circuit diagram illustrating power flow for a regenerative variable frequency AC drive unit constructed without a capacitive DC bus.
Figure 17B:
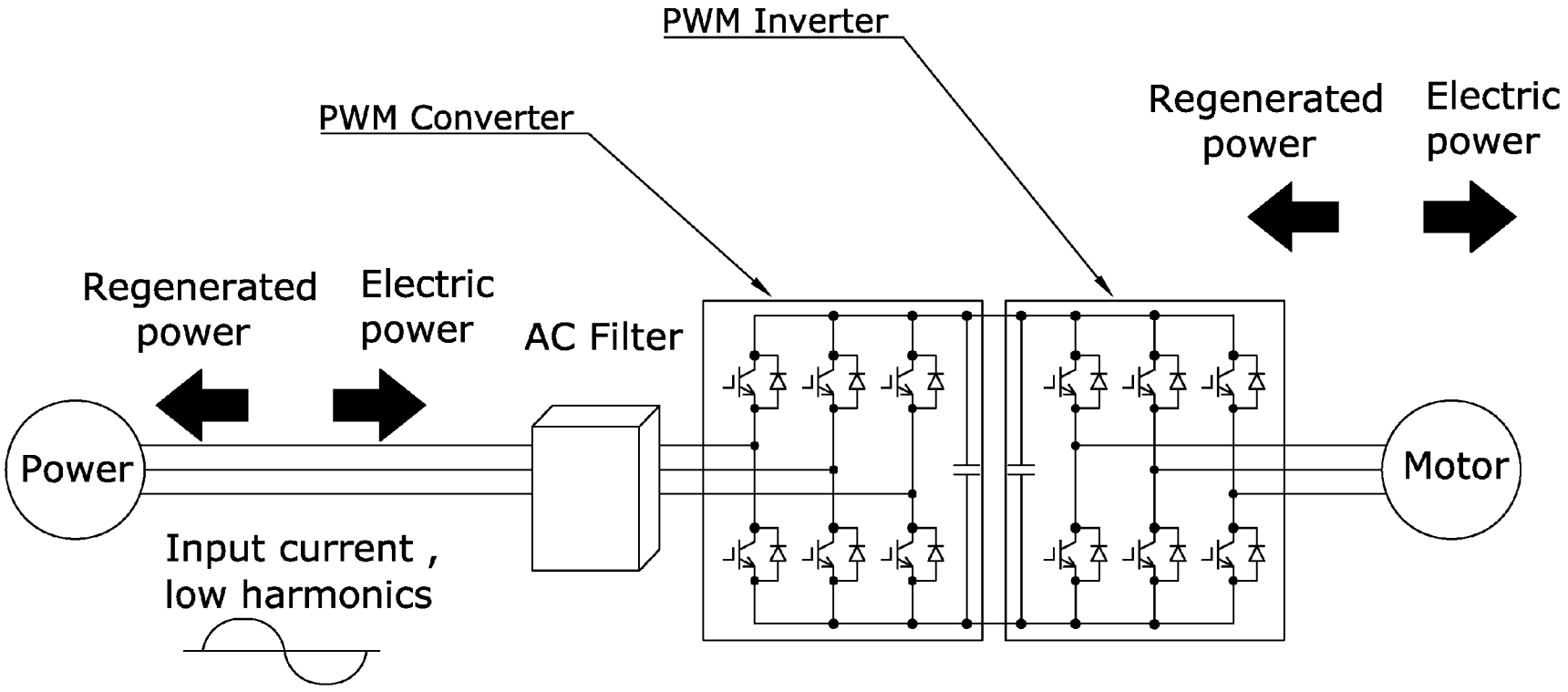
FIG. 17B is a circuit diagram illustrating power flow for a regenerative variable frequency AC drive unit constructed with a capacitive DC bus.

FIGS. 17A and 17B shows two different types of regenerative variable frequency AC drive units, and are helpful in understanding power flow and what is possible with different types of AC drive unit construction and topology. These types of regenerative variable frequency AC drive units are used to control the speed and torque of the shaft of an AC motor. We use the term variable frequency drive (VFD) when referring to the entirety of the electrical power and control components that comprise these two types of regenerative variable frequency AC drive units. Each of the VFD's shown in FIGS. 17A and 17B has a unique construction and topology, and both are capable of controlling large quantities of power both to and from the AC motor. Topology, as applied to VFD's, is a broad concept that refers primarily to the type of components that are used in the VFD and how they are connected electrically. As has been explained previously, when power is flowing to the AC motor from the VFD, the motor is providing power and torque to drive the motor in a given direction. This direction of power flow, from the VFD to the AC Motor, is typically called "motoring". However, when power is flowing from the AC Motor to the VFD then the motor is acting as a generator and power and torque are acting to slow, or brake, the mechanical load connected to the motor. This direction of power flow, from the AC Motor to the VFD, is typically called "braking".

As shown in FIGS. 17A and 17B, each type of VFD is regenerative. Meaning the VFD itself is capable of returning power back to the electrical power distribution system. In this way, there is not an external brake required and the VFD can usefully control the power flow, in both motoring and braking modes, of the motor when necessary. The regenerative VFD has the capacity to control large levels of power, in both the motoring and braking modes, for extended periods of time.

Our device uses a regenerative VFD and has the ability to determine the drive mechanism position and control appropriately the instantaneous motor velocity during each portion of each stroke. This ability, however, is not useful without the ability to operate the motor reliably and efficiently in both motoring and braking modes. In addition, the power levels required are usually large for our device to be useful. Large and sustained operational periods of motoring are required during each cycle. As are large and sustained operation periods of braking required during each cycle. The regenerative AC drive can be thought of as the brawn that is required to make our device useful. Our device can operate at high rates of speed through different parts of the stroke because our device can slow the pumping unit when required.

Operator Interface

Presently our device operates in a programmable logic structure that resides in a VFD control board. The VFD control board has logic, processing capability and memory that can be programmed to accomplish certain functions. Given the constraints of this platform our device functions well for its intended purpose. The technician programs the following parameters.

| Parameter Name | Units | Description |
|---|---|---|
| Minimum Reference Voltage | Volts DC | Minimum Voltage from well manager |
| Minimum Speed | Hertz | Minimum average frequency corresponding to minimum voltage from well manager |
| Maximum Speed | Hertz | Maximum average frequency corresponding to maximum voltage from well manager |
| Max Tension | Unit less | Tension set point used during upstroke only |
| Min Tension | Unit less | Tension set point used during down stroke only |
| Tension Control Gain | Unite less | Tension loop controller gain. Used to tune tension controller |
| Tension Control Time | Seconds | Tension loop controller integration time. Used to tune tension controller. |
| Tension Control Range | % | Allowable maximum output from tension controller. 0% setting turns off tension controller. |
| Position Scale | Unit less | Scale value explained in section c) previously |
| Transition 1 | Degrees | End of Section 1 |
| Speed 1 | % | Speed through section 1. This is a percentage of the scaled reference from the well manager. |
| Transition 2 | Degrees | End of Section 2 See explanation of Speed 1 |
| Speed 2 | % | End of Section 3 |
| Transition 3 | Degrees | See explanation of Speed 1 |
| Speed 3 | % | End of Section 4 |
| Transition 4 | Degrees | See explanation of Speed1 |
| Speed 4 | % | See explanation of Speed |
| Transition 5 | Degrees | See explanation of Speed 1. There is no |
| Speed 5 | % | Transition 6 because it is always the last |
| Speed 6 | % | section and ends at 360° |
| Speed Control Gain | Unit less | Speed loop control gain. |
| Speed Control Time | Seconds | Speed loop control integration time. |

Presently there are 6 different transition points (in the above table transition 1, 2, 3, 4, 5, and 6) in the position vs. speed map depicted in FIG. 18. In the future as more unique transition points are added, then the speeds reference that is programmed and associated with each transition may not be significantly different from one speed reference to the next speed reference during the stroke. If there were many more speeds, then a "firm" speed loop may be used, resulting in a desirable dynagraph as discussed subsequently. The programming of such a speed reference map would require much more time by the technician during initial start-up. An automated method of generating the position vs. speed may be developed, however. This automated method may include some sophisticated means of analyzing and optimizing dynagraphs by programming our device appropriately.

Dynagraphs

Figure 20:
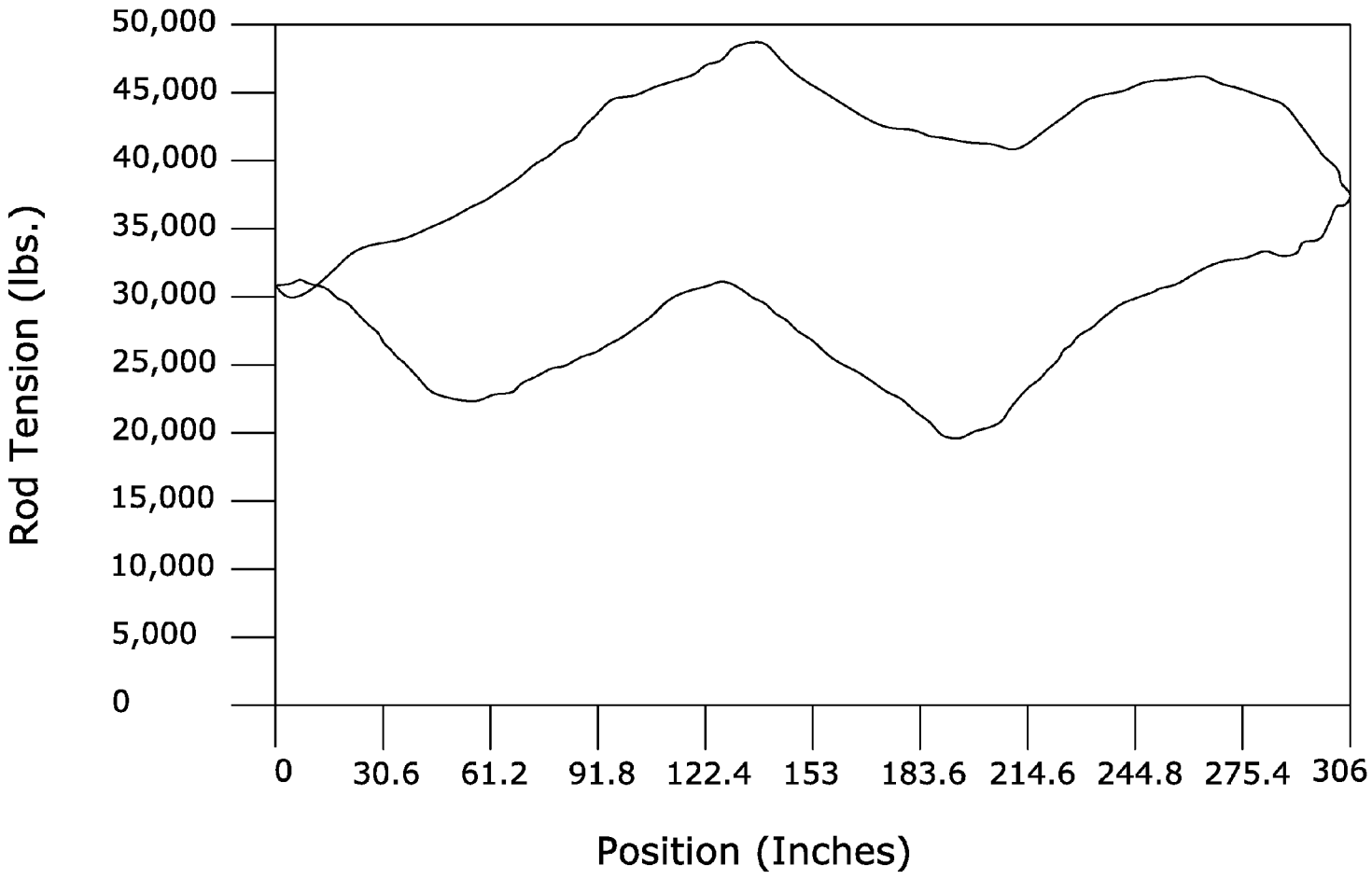
FIG. 20 is a typical dynagraph for a pumping unit.

A dynagraph, for example the graph shown in FIG. 20, is a graph of the rod tension versus rod position. Because it is measured at the surface, it is called a "surface card," With the abscissa being the rod position and the ordinate being measured rod tension, measured at the surface of the rod. In the graph shown in FIG. 20 the length of the stroke is 306 inches; therefore, the abscissa ranges from 0 inches to 306 inches. The measured rod tension ranges from a maximum of approximately 47,000 pounds (lbs) to a minimum of approximately 18,000 lbs. Maximum tension occurs on the upstroke and minimum tension occurs on the downstroke. Surface cards are always generated using calculated or measured surface tension and rod position.

To a skilled well analyst dynagraphs are the primary method of measuring past and present well performance, analyzing stress on the "rod string", analyzing stress on the pumping unit, maintaining the entire pumping process and predicting future well performance. There exists a dynagraph for each complete stroke of the rod. Dynagraphs, once measured, are stored in electronic form in a computer for future reference. Our device does not generate these dynagraphs, although our device does have a significant impact on the dynagraph. The dynagraph is generated by the well manager, or by software in a centralized control system that is operated by the oil production company.

Long-Stroke Pumping Unit Dynagraph

Figure 21:
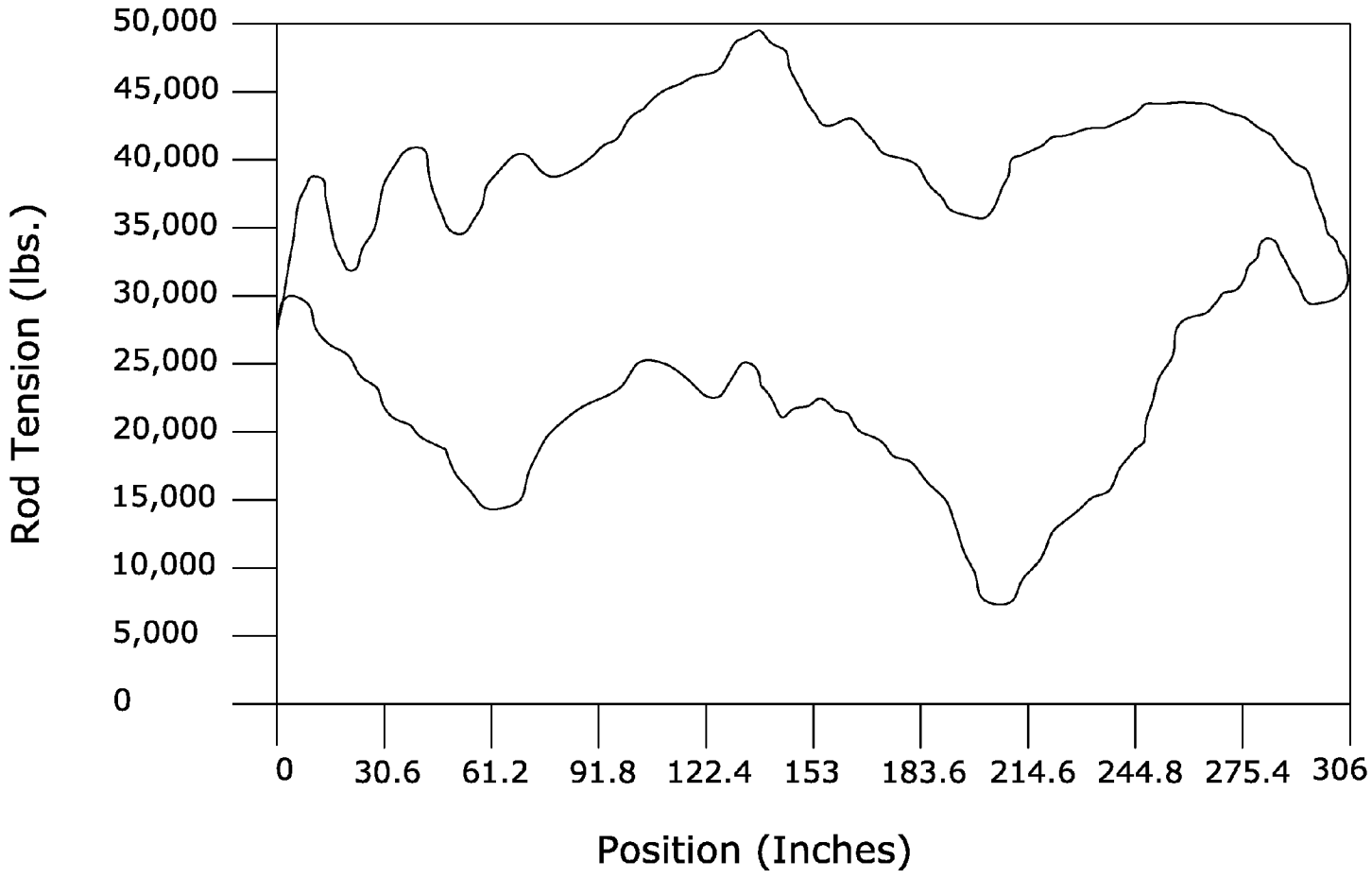
FIG. 21 is a dynagraph of a long-stroke pumping unit not being controlled by our device.
Figure 22:
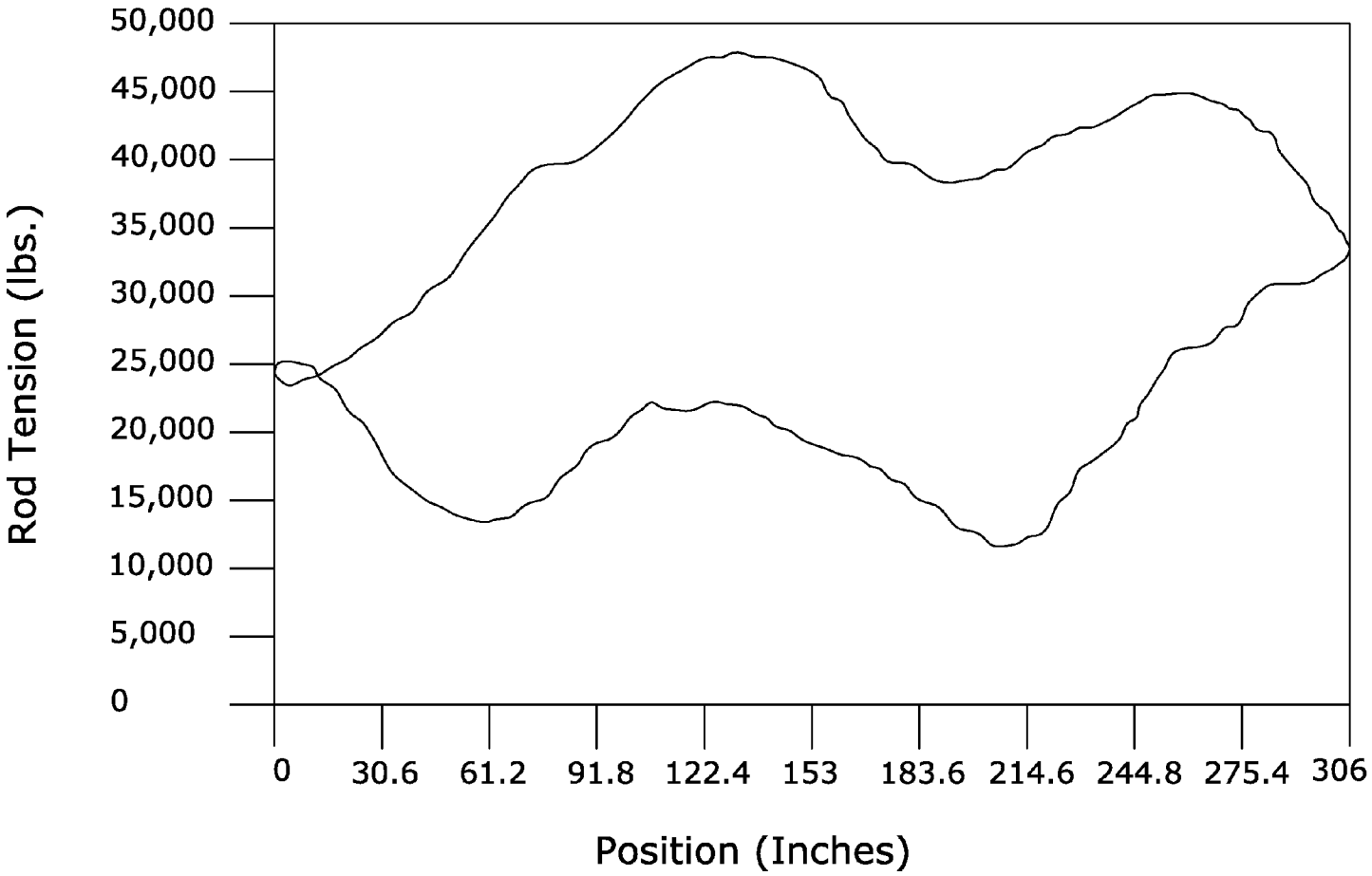
FIG. 22 is a dynagraph of the long-stroke pumping unit depicted in FIG. 21 but now being controlled by our device.

FIGS. 21 and 22 are dynagraphs for a well with a long-stroke pumping unit, the long-stroke well with our device as shown in FIG. 22 and the same long-stroke pumping unit without our device as shown in FIG. 21. The well of FIG. 21 has undesirable characteristics, namely, rapid changes in tension (high tension gradient), extremely high level of maximum tension and extremely low level of minimum tension. FIG. 21 dynagraph details: Surface Stroke: 306 Inches, Maximum Tension 49,985 lbs.; Minimum Tension 10,895 lbs. FIG. 22 depicts a well with a desirable dynagraph with the following desirable characteristics: low tension gradients, low overall tension changes, high level of "polished rod horsepower", low level of maximum tension and high level of minimum tension. In addition, many of the undesirable aspects shown by the dynagraph in FIG. 21 have been eliminated or minimized. The dynagraph shown in FIG. 22 is a result of proper application of our device. The motor and drive controlling this pumping unit have been sized, applied and programmed in such a way that the resulting dynagraph is substantially improved. FIG. 22 dynagraph details: Surface Stroke: 306 Inches, Maximum Tension 47,492 lbs.; Minimum Tension 12,967 lbs.

Mark II Pumping Unit Dynagraph

Figure 23:
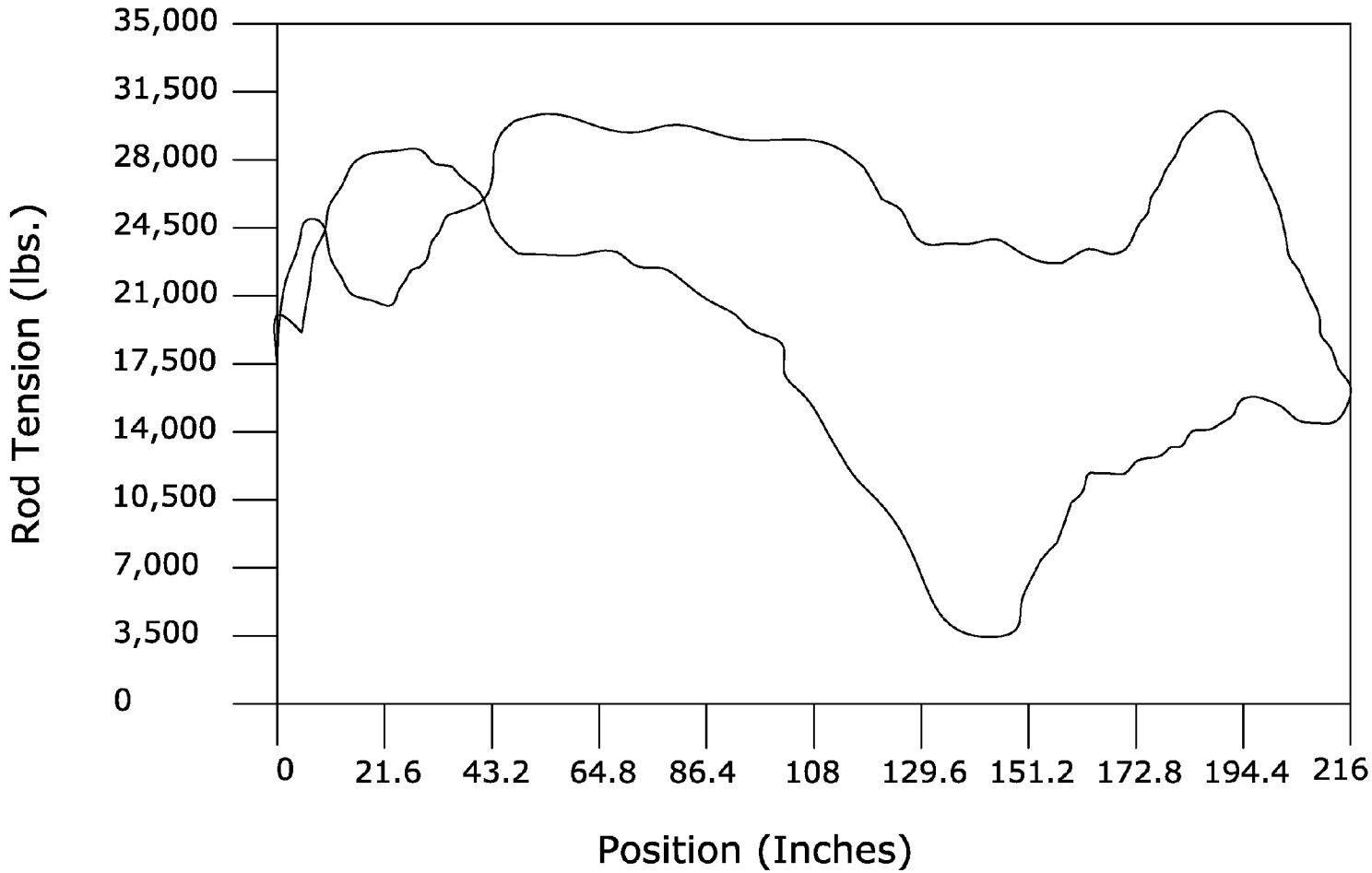
FIG. 23 is a dynagraph of a Mark II pumping unit not being controlled by our device.
Figure 24:
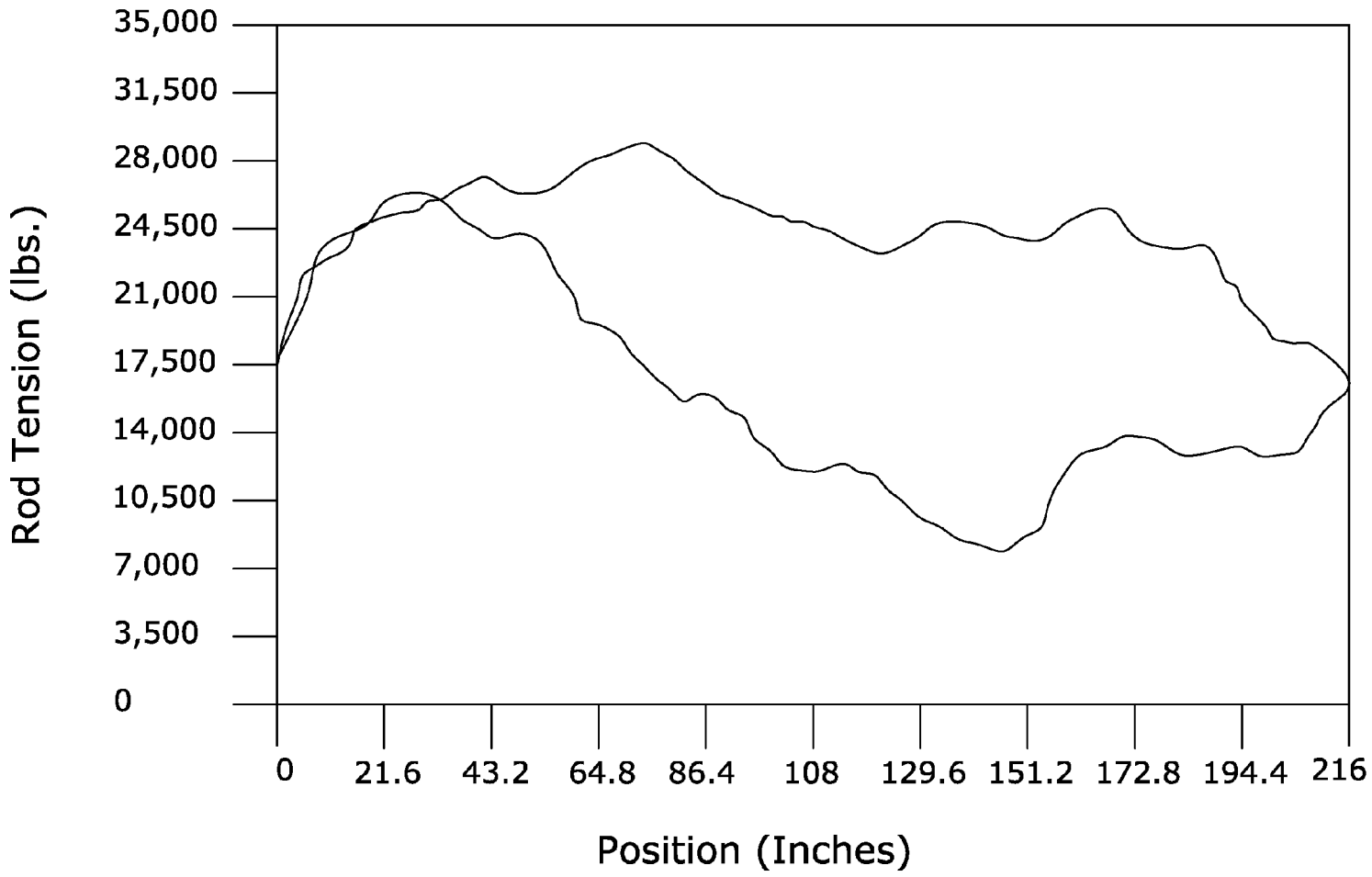
FIG. 24 is a dynagraph of the Mark II pumping unit depicted in FIG. 23 but now being controlled by our device.

FIGS. 23 and 24 are dynagraphs for a well with a Mark II pumping unit, the Mark II well with our device as shown in FIG. 24 and the same Mark II pumping unit without our device as shown in FIG. 23. The undesirable aspects of the dynagraph shown in FIG. 23 are rapid changes in tension (high tension gradient), extremely high level of maximum tension and extremely low level of minimum tension. FIG. 23 dynagraph details: Surface Stroke: 218 Inches, Maximum Tension 37,730 lbs.; Minimum Tension 13,792 lbs.

Desirable characteristics of dynagraph shown in FIG. 24 are the following: low tension gradients, low overall tension changes, high level of "polished rod horsepower", low level of maximum tension and high level of minimum tension. In addition, many of the undesirable aspects shown in FIG. 23 have been eliminated or minimized. The dynagraph shown in FIG. 24 is a result of proper application of our device. The motor and drive controlling this pumping unit have been sized, applied and programmed in such a way that the resulting dynagraph is substantially improved. FIG. 24 dynagraph details: Surface Stroke: 218 Inches, Maximum Tension 32,089 lbs; Minimum Tension 15,843 lbs.

Conventional Pumping Unit Dynagraph

Figure 25:
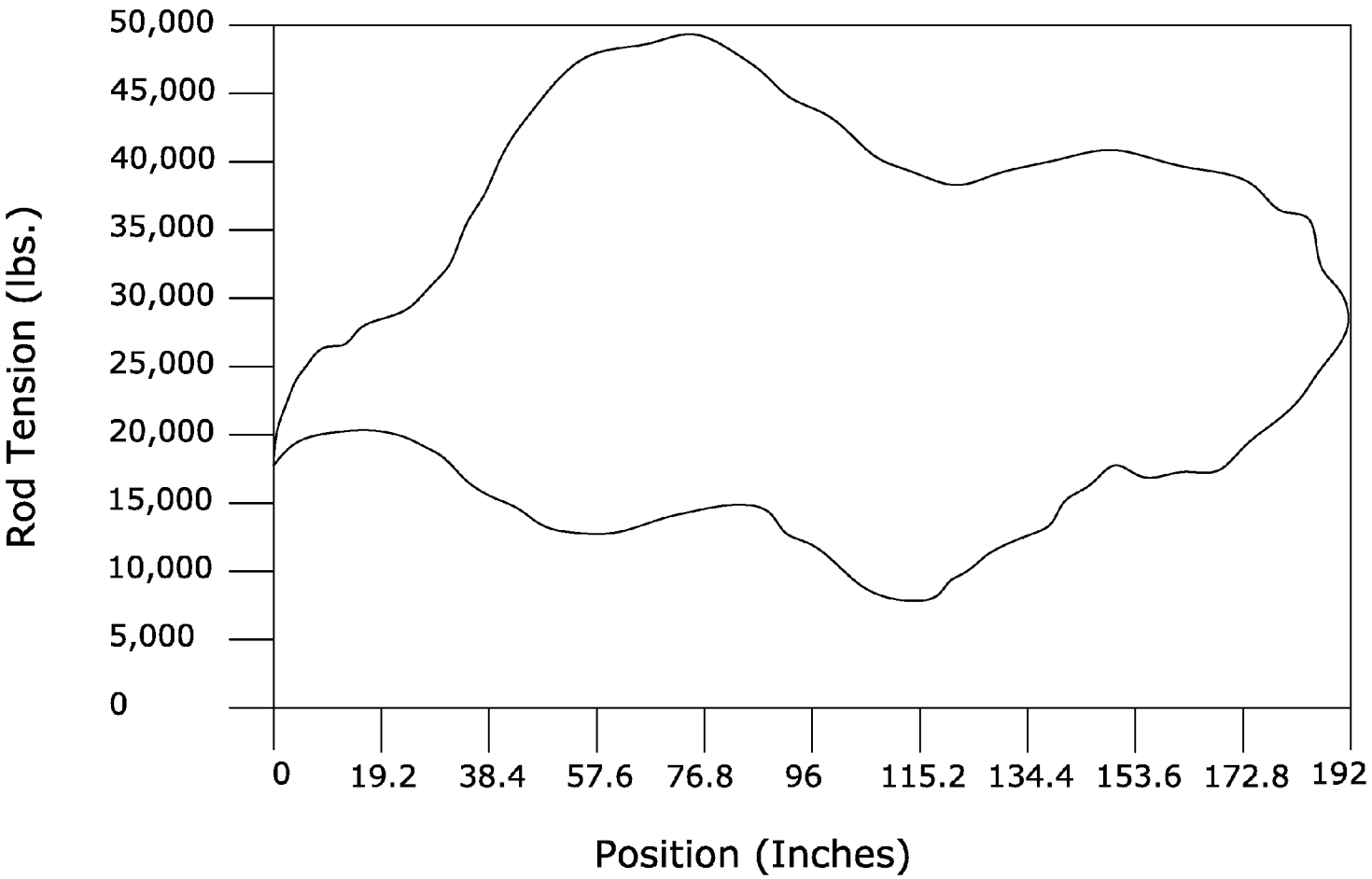
FIG. 25 is a dynagraph of a conventional pumping unit not being controlled by our device.
Figure 26:
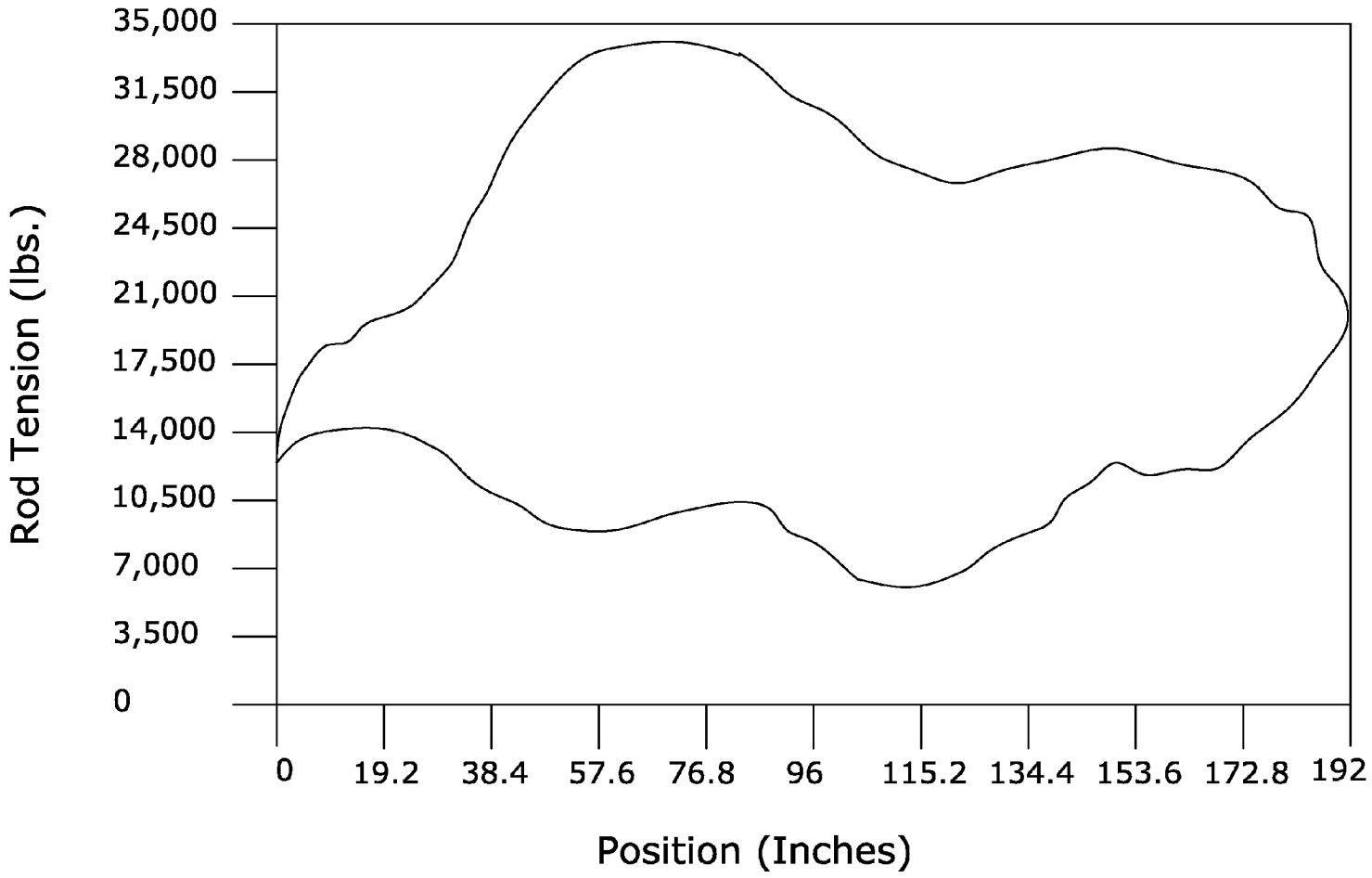
FIG. 26 is a dynagraph of the conventional pumping unit depicted in FIG. 25 but now being controlled by our device.

FIGS. 25 and 26 are dynagraphs for a well with a conventional pumping unit such as shown in FIG. 3E, the conventional well with our device as shown in FIG. 26 and the same pumping unit without our device as shown in FIG. 25. The undesirable aspects of the dynagraph shown in FIG. 25 are a high level of maximum tension and a low level of minimum tension. FIG. 25 dynagraph details: Surface Stroke: 194 Inches, Maximum Tension 35,363 lbs; Minimum Tension 10,562 lbs.

Desirable characteristics of dynagraph shown in FIG. 26 are the following: low tension gradients, low overall tension changes, high level of "polished rod horsepower", low level of maximum tension and high level of minimum tension. In addition, the dynagraph in FIG. 6 have been improved. The dynagraph shown in FIG. 26 is a result of proper application of our device. The motor and drive controlling this pumping unit have been sized, applied and programmed in such a way that the resulting dynagraph is improved. FIG. 26 dynagraph details: Surface Stroke: 194 Inches, Maximum Tension 34,991 lbs; Minimum Tension 10,182 lbs.

Our device is used to optimize the dynagraph for a given well on each stroke. Optimizing the dynagraph for reliability refers primarily to the reliability of the components of the pumping process that are located below the surface. These sub-surface components include the rod, pump, and tubing. But there is another important component of the pumping process that is not necessarily protected by simply optimizing the dynagraph. This other component is the pumping unit itself. Consider FIG. 10 showing the position vs. speed profile for a Rotaflex® pumping unit. FIG. 10 shows two points at which the speed of the motor is relatively low, just above 50 rpm. These two position points of relatively low speed are programmed to protect the Rotaflex® pumping unit. For it is exactly as these position points during each stroke that the pumping unit must execute a mechanical change in direction. During this mechanical change in direction, in order to protect the mechanical pumping unit, the speed is lowered to prevent unnecessary wear and tear on the pumping unit. With a Rotaflex® pumping unit, the slower the speed through these mechanical changes in direction, the better the long term reliability of pumping unit will be.

| | | Dynagraph Improvement with Our device | | |
|---|---|---|---|---|
| | | Decrease Max. Tension | Increase Min. Tension | Lower Tension Gradients |
| Type Of Pumping Unit | Rotaflex | Significant | Significant | Significant |
| | Mark II | Moderate | Significant | Significant |
| | Conventional | Moderate | Moderate | Trivial |
| | Air Balance | Moderate | Moderate | Trivial |

Our device dramatically increases the performance and reliability of the long-stroke pumping unit, and in particular the Rotaflex® unit. In fact, our device, when properly applied, improves the performance of the Rotaflex® unit so dramatically, our device applied to the Rotaflex® unit has the potential to dramatically increase the scope and pace of the oil-industry acceptance of such long-stroke pumping units. The benefits of our device for such long-stroke pumping units are many. Here is a partial list:

Increased Displacement—Pump displacement, as explained previously, can be increased by increasing the speed, SPM, of the pumping unit. Increasing speed of the long-stroke pumping unit is possible without our device. However, without our device, increasing SPM of the long-stroke pumping unit comes with several undesirable, and ultimately insuperable, problems. These problems include increased rod stress, unacceptable dynagraphs, increased stress on the pumping unit and its associated drive equipment.

Increased Mechanical Reliability—Regardless of the average speed of operation, SPM, our device reduces mechanical stress on the pumping unit, associated drive components and rod stress. There are several facets of our device, in combination with the long-stroke pumping unit, that cause these improvements. As illustrated in FIGS. 3A through 3B', illustrates of several aspects of the actual operation of a Rotaflex® long-stroke pumping unit using our control device. The Rotaflex® long-stroke pumping unit employs a mechanical transfer mechanism that causes an internal weight carriage WC to become attached to the portion of the drive chain DC that is traveling upwards when the rod R is to move downwards. Conversely, the mechanical transfer mechanism causes the internal weight carriage to become attached to the portion of the drive chain DC that is traveling downwards when the rod R is to move upwards. The transfer mechanism is actuated two times per cycle. One time when the rod R is at the bottom of its stroke and the weight carriage is at the top of its stroke. When the rod R is at the bottom of its stroke and the weight carriage is at the top of its stroke, the mechanical transfer mechanism operates in such a way that the weight carriage is transferred to the part of the drive chain that is moving downwards. The second time when the rod is at the top of its stroke and the weight carriage is at the bottom of its stroke. When the rod R is at the top of its stroke and the weight carriage is the bottom of its stroke, the mechanical transfer mechanism operates in such a way that the weight carriage is transferred to the part of the chain that is moving upwards. The rod and weight carriage move in a reciprocating motion, exactly 180 degrees out of phase relative to each other. In other words, when the weight stack is moving upwards at a given speed, the rod R is moving downwards at the same speed. Conversely, when the weight stack is moving downwards at a given speed, the rod R is moving upwards at the same speed.

The actual transfer operation when the weight carriage is transferred from one portion of the chain to the other portion of the chain is called a "transition". Typically, when operating on the pumping unit, one would refer to a "top transition" and a separate and distinct "bottom transition." As explained, the top transition occurs when the weight stack is at the top of its stroke and the rod is at the bottom of its stroke. The bottom transition occurs when the weight stack is at the bottom of its stroke and the rod R is at the top of its stroke. The pumping unit is designed mechanically in such a way that in operation the two transitions are remarkably reliable, sturdy and robust. However, as robust as the mechanical unit is, as a general statement, the mechanical unit is more reliable when the two transitions are performed at relatively low speed. Our device allows the pumping unit to operate at very high speed between transitions and relatively low speed through the transitions. For example, a technician may program the microprocessor 10*a* in such a way that the transitions are executed at a given speed relatively low speed. Between transitions, during the upstroke or during the downstroke, the pumping unit may be operated at a speed that can be 150% to 300% faster than the transition speeds. This allows the pumping unit to be operated at a relatively high average speed, while still maintaining the low speeds during the transitions that are desirable for good mechanical reliability and increased useful pumping unit life.

Although a stroke at speeds of up to 300% faster than transitions speeds, one may ponder what might occur if the pumping unit were operated for even a few strokes at such very high speed during a transition. The effects of very high-speed operation of the pumping unit through the transitions depend on several factors. However, the effects are in no way desirable, and in some cases, may cause immediate damage to the pumping unit, rod or other associated equipment. It is primarily, although not exclusively, this reason that the position feedback, described previously, is the focus of reliability and accuracy. It is for this reason that there are so many redundant checks of speed and position feedback for reliability and accuracy. Reliable and accurate position, either measured or calculated, insures the usefulness of our device.

Improved Dynagraph—Long-stroke pumping units are unlike beam pumping units in one very important aspect: transition of rod motion requires a change in mechanical configuration. Namely, the transition of the rod from a mechanical configuration in which the rod is moving upwards to a mechanical configuration in which the rod is moving downwards; conversely, the transition of the rod from a mechanical configuration in which the rod is moving downwards to a mechanical configuration in which the rod is moving upwards. These transitions of rod motion are very different between the two types of pumping units. When considering the transitions of rod motion on a beam pumping unit, one must consider the mechanical design and the geometry of the rod motion as it relates to pumping unit motion. Due to the construction of the beam pumping unit, the rod motion is very slow in, and near, the rod motion transition. This is because the rod motion is a sinusoidal function of the crank output motion. Due to the construction and geometry of the beam pumping unit, during the rod motion transition, very large changes in crank position result in very small changes in rod position. However, a long-stroke pumping unit does not have the benefit of this type of rod motion. The rod motion is basically a linear function of the chain speed, regardless of the exact rod position during the stroke. For this reason the rod motion transitions for a long-stroke pumping unit are not as smooth or seamless as those of a beam pumping unit. Our device makes the rod motion transition much smoother, because our device allows the rod motion transitions to occur at slower speeds. In fact, many characteristics of the programming of the microprocessor 10*a* in our device are intended to smooth the rod motion transition.

The rod motions transitions and the weight carriage transitions are different. The weight carriage transitions are slowed to increase the mechanical reliability of the pumping unit. The microprocessor 10*a* is programmed to improve both the rod motion transitions and the weight carriage transitions. An example of how this work is the following: On long-stroke pumping units, the rod motion transitions from downwards rod motion to upwards rod motion requires special attention. Frequently, this rod motion transition from down to up results in large tension gradients in the measured rod tensions. These are frequently called "snaps". These snaps are highly undesirable. Often these snaps are eliminated by slowing the rod motion considerably during this rod motion transitions. It just so happens that the rod motion transition from down to up occurs at precisely the same instant that the weight carriage is transferred from the upward drive chain to the downward drive chain. The end result of all of these simultaneous rod transitions and weight carriage transitions is that the speed through the top weight carriage transition and the bottom rod motion transition is a program in the microprocessor that protects the rod. The transition speed is lower that is necessary to protect the weight carriage, however, it is the transitions speed that is needed to protect the rod.

Decreased Pumping Unit Mechanical Stress—Mechanical stress on the pumping unit can result from many different aspects of the pumping unit operation. There is stress on the drive mechanisms, gear box, drive chain and mechanical transfer mechanism. There is also structural stress on the mechanical structure that contains the counter-weight assembly and supports the weight of the rod. Instantaneous rod tension, AC motor speed, AC motor torque and AC motor power are all monitored and controlled or limited by the microprocessor 10*a* to maximize the mechanical reliability of the pumping unit mechanism.

End of Stroke Signal (EOS)—The EOS is provided by the pumping unit manufacturer, well manager manufacturer or oil production company. There are many different types of EOS's in use on various types of long-stroke pumping units. In some cases, the EOS is simply a magnet with a sensor that actuates somewhere near the rod bottom of stroke. However, there are also some EOS employed that actuate off of a sensor placed on the drive chain. As it turns out, the drive chain is designed in such a way that there is one compete revolution of the drive chain per stroke. There exists in the drive chain a "master link" or "reference link" that can be used as an EOS. As a practical matter, all that is required of an EOS is that the EOS actuates at least one time per cycle at a known, predictable and consistent location in the stroke. The EOS could be in the middle of the stroke. For example, if the EOS were taken in the middle of the upstroke, that would have the same practical effect as simply shifting the speed vs. position map by negative 90°. In other words, adding any phase sift to the EOS signal results in the speed vs. position map being shifted by the same phase shift in the reverse direction. Please note, if the EOS were taken from a sensor connected to rod, or some other mechanical component associated with rod motion, the EOS would occur twice per stroke. For the case in which the EOS occurs more than one time per stroke, only one of the EOS is considered valid. See de-bounce for example.

Other Possible Long-stroke Construction or Control Methods—Our device will allow, in fact may encourage, new long-stroke pumping unit designs or control strategies. One possible control strategy, for example, is to use the existing long-stroke mechanical construction and rather than use the mechanical weight carriage transfer mechanism, one could simply reverse the direction of rod motion and weight carriage motion by simply reversing the direction of AC motor rotation. This control strategy would require using some portion, less than 100%, of the existing rod stroke. The control could, for example, use an EOS that is located at some point in the stroke that is offset from the actual existing mechanical end of rod stroke position. The control could execute a given motion profile, based on the position calculation and associated speed vs. position map. This concept could be described as an electronic stroke. The electronic stroke would require the microprocessor 10*a* to be programmed to result in very low speed and then an AC Motor reversal of rotation at the top and bottom of each electronic stroke. There would be a variety of methods to integrate the electronic stroke with the existing mechanical stroke. For example, the microprocessor could be programmed to operate some strokes using the shorter electronic stroke and other strokes using the existing mechanical stroke. This type of control might be desirable to distribute mechanical wear at different locations in the drive chain. In addition, there may be entirely new methods of designing and manufacturing long-stroke pumping units using the technology of our device. For example, a rack and pinion type of drive mechanism using a stationary pinion, connected to a motor, and moving rack. Another type of construction may be a stationary rack and a moving pinion, connected to a motor. Our device would be useful in any type of long-stroke pumping unit construction, because it takes advantage of the regenerative variable frequency AC drive and a position calculation or measurement that results in appropriate speeds at various locations of the rod or drive mechanism.

Scope of the Invention

The above presents a description of the best mode we contemplate of carrying out our method and control device for operating an oil well and a well using our control device, and of the manner and process of making and using them, in such full, clear, concise, and exact terms as to enable a person skilled in the art to make and use. Our method and control device for operating an oil well and a well using our control device are, however, susceptible to modifications and alternate constructions from the illustrative embodiments discussed above which are fully equivalent. Consequently, it is not our intention to limit our method and control device for operating an oil well and a well using our control device to the particular embodiments disclosed. On the contrary, our intention is to cover all modifications and alternate constructions coming within the spirit and scope of our method and control device for operating an oil well and a well using our control device as generally expressed by the following claims, which particularly point out and distinctly claim the subject matter of our invention:

The invention claimed is:

1. A method of operating an oil well where a pump attached to an end of a rod is raised and lowered by a drive mechanism through a stroke cycle, said method comprising the steps of operating the drive mechanism by means of an AC electric motor having a motor controller including a regenerative variable frequency drive, said regenerative variable frequency drive applying AC electrical energy from a power grid to the AC electric motor, decreasing motor speed by transferring the electrical energy from the motor to the power grid and increasing motor speed by transferring electrical energy from the power grid to the motor, said motor controller regulating the motor speed as determined by a program designed for said oil well that is encoded at setup with a speed map that contains a speed reference for positions of the drive mechanism from 0° to 360°, over the course of said stroke cycle, calculating said positions of the drive mechanism according to the following mathematical formula:

$$X=K\int_{o}^{T_o} V dt$$

where

X=instantaneous position of the mechanism along a path of travel,

V=estimated instantaneous motor shaft speed (revolutions per minute),

K=scaling constant, $T_o$=time at which a position signal is received, and at each said calculated position setting the motor speed to correspond to the speed reference called for by the speed map at said calculated position.

* * * * *